US007256550B2

(12) United States Patent
Park et al.

(10) Patent No.: US 7,256,550 B2
(45) Date of Patent: Aug. 14, 2007

(54) PLASMA DISPLAY PANEL

(75) Inventors: Hun Gun Park, Kumi-shi (KR); Moo Kang Song, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 12 days.

(21) Appl. No.: 10/293,557

(22) Filed: Nov. 14, 2002

(65) Prior Publication Data

US 2003/0090212 A1 May 15, 2003

(30) Foreign Application Priority Data

Nov. 15, 2001 (KR) ..... 10-2001-0071135
Nov. 15, 2001 (KR) ..... 10-2001-0071136
Nov. 15, 2001 (KR) ..... 10-2001-0071137
Nov. 19, 2001 (KR) ..... 10-2001-0071788

(51) Int. Cl.
*G09G 3/10* (2006.01)

(52) U.S. Cl. ..... 315/169.1; 315/169.4; 345/60

(58) Field of Classification Search ..... 315/169.1, 315/169.3, 169.4; 345/60, 76, 63, 67; 313/784, 313/502, 582, 585; 257/532, 535
See application file for complete search history.

(56) References Cited

U.S. PATENT DOCUMENTS 5,587,624 A * 12/1996 Komaki ..... 313/584
5,736,815 A 4/1998 Amemiya ..... 315/169.3
6,437,514 B1 * 8/2002 Kurata et al. ..... 315/169.4
6,486,530 B1 * 11/2002 Sasagawa et al. ..... 257/532
6,603,263 B1 8/2003 Hashimoto et al. ..... 315/169.3
6,744,413 B2 * 6/2004 Nunomura ..... 345/60
6,828,736 B2 * 12/2004 Homma ..... 315/169.4
2001/0024092 A1 * 9/2001 Kim et al. ..... 315/169.4
2002/0047566 A1 * 4/2002 Kim et al. ..... 315/169.3
2002/0101181 A1 * 8/2002 Lee et al. ..... 315/169.4
2005/0041001 A1 * 2/2005 Sumida et al. ..... 345/60

FOREIGN PATENT DOCUMENTS

| | | |
|---|---|---|
| CN | 1533582 | 9/2004 |
| JP | 06-251712 | 9/1994 |
| JP | 08-102260 | 4/1996 |
| JP | 10-92326 | 4/1998 |
| JP | 10-241577 | 9/1998 |
| JP | 11-120922 | 4/1999 |
| JP | 11-185644 | 7/1999 |
| JP | 2000-11899 | 1/2000 |

(Continued)

OTHER PUBLICATIONS

KR Office Action dated Oct. 28, 2003.

(Continued)

*Primary Examiner*—Tuyet Vo
*Assistant Examiner*—Jimmy Vu
(74) *Attorney, Agent, or Firm*—Fleshner & Kim, LLP

(57) ABSTRACT

There is explained a plasma display panel that is adaptive for improving brightness uniformity of an entire panel.

A plasma display panel according to an embodiment of the present invention has a width, a thickness and a gap of a driving electrode, barrier ribs, a black matrix and a dielectric layer etc in a central area set differently from those in a peripheral area of the plasma display panel.

34 Claims, 48 Drawing Sheets

FOREIGN PATENT DOCUMENTS

| | | |
|---|---|---|
| JP | 2000-348627 | 12/2000 |
| JP | 2000-357463 | 12/2000 |
| JP | 10-295454 | 4/2001 |
| KR | 1999-65917 | 8/1999 |
| KR | 2000-010046 | 2/2000 |
| KR | 10-279254 | 10/2000 |
| KR | 2000-67640 | 11/2000 |
| KR | 2000-0074094 | 12/2000 |
| KR | 2001-49129 | 6/2001 |
| KR | 1020010049129 A | 6/2001 |
| KR | 2001-73512 | 8/2001 |
| KR | 1020010073512 A | 8/2001 |
| KR | 2002-26653 | 4/2002 |
| KR | 2004-30641 | 4/2004 |
| WO | WO 00/75951 | 12/2000 |

OTHER PUBLICATIONS

Chinese Office Action dated Feb. 17, 2006.
European Search Report dated Sep. 16, 2005.

* cited by examiner

V−V'

VI−VI'

VII−VII'

PLASMA DISPLAY PANEL

BACKGROUND OF THE INVENTION

1. Field of the Invention

This invention relates to a method and an apparatus of driving a plasma display panel, and more particularly to a plasma display panel that is adaptive for improving brightness uniformity of an entire panel.

2. Description of the Related Art

Generally, a plasma display panel (PDP) radiates a fluorescent body using an ultraviolet with a wavelength of 147 nm generated upon discharge of an inactive mixture gas such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

Referring to FIG. 1, a discharge cell of the conventional three-electrode, AC surface-discharge PDP includes transparent electrodes 12Y and 12Z formed on an upper substrate 11 acting as a scan electrode and a sustaining electrode respectively, and an address electrode 17X formed on a lower substrate 16.

The transparent electrodes 12Y and 12Z are usually formed from indium-tin-oxide (ITO). There is metal bus electrodes 13 formed in each of the transparent electrodes 12Y and 12Z for reducing resistance. There are an upper dielectric layer 14 and a protective film 15 deposited on the upper substrate 11, where the transparent electrodes 12Y and 12Z are formed.

The address electrode 17X intersects the transparent electrodes 12Y and 12Z there are a lower dielectric layer 18 and a barrier rib 19 formed on the lower substrate on which the address electrode 17X is formed, and a fluorescent layer 20 is spread on the surface of the lower dielectric layer 18 and the barrier rib 19.

An inactive mixture gas such as He+Xe or Ne+Xe is injected into a discharge space defined between the upper and lower substrate 11 and 16 and the barrier rib 19 for a discharge.

Such a PDP drives one frame, which is divided into various sub-fields having a different discharge frequency, so as to express gray levels of a picture. Each sub-field is again divided into a reset period for having discharge generated uniformly, an address period for selecting a discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields. Each of the 8 sub-fields is divided into a reset period, an address period and a sustain period as mentioned above. Herein, the reset period and the address period of each sub-field are equal every sub-field, whereas the sustain period and its discharge frequency are increased at a ratio of $2^n$ (wherein n=0, 1, 2, 3, 4, 5, 6 and 7) at each sub-field. In this way, since the sustain period becomes different in each sub-field, it is possible to realize the gray level of the picture.

PDP has its size large-dimentionalized like 40", 50", 60" as compared with other flat panel displays PPD. Accordingly, because each of the electrodes 12Y, 12Z, 13, 17 of the PDP is long, a voltage drop due to the electrode length, which occurs in the central area, is relatively much more different from the voltage drop in the peripheral area. Further, because the PDP has discharge gas interposed into it with a lower pressure than atmospheric pressure, the strength applied to the substrates 11 and 16 in the central area where the upper/lower substrates 11 and 16 are only supported by the barrier ribs is different from the strength applied to the substrates 11 and 16 in the peripheral area where the upper/lower substrates 11 and 16 are joined by a sealant (not shown). As a result, a conventional PDP, as in FIG. 2, has the brightness of the central area 20% lower than that of the peripheral area, in both horizontal and vertical directions respectively though there is difference depending on the panel size.

SUMMARY OF THE INVENTION

Accordingly, it is an object of the present invention to provide a plasma display panel that is adaptive for improving brightness uniformity of an entire panel.

In order to achieve these and other objects of the invention, a plasma display panel according to an aspect of the present invention includes a pair of transparent electrodes for generating a sustaining discharge; and a plurality of metal bus electrodes formed at each of the pair of the transparent electrodes and having at least either a width or a gap between each other in a central area different from that in a peripheral area of the plasma display panel.

Herein, the width of the metal bus electrode is narrower in the central area than in the peripheral area of the plasma display panel.

Herein, the gap between the metal bus electrodes is narrower in the central area than in the peripheral area of the plasma display panel.

A plasma display panel according to another aspect of the present invention includes a plurality of pairs of transparent electrodes having at least either a width or a gap between each other in a central area different from that in a peripheral area of the plasma display panel.

Herein, the width of the pair of the transparent electrodes is wider in the central area than in the peripheral area of the plasma display panel.

Herein, the gap between the pair of the transparent electrodes is wider in the central area than in the peripheral area of the plasma display panel.

The plasma display panel further includes a plurality of metal bus electrodes formed at each of the pair of the transparent electrodes and having at least either a width or a gap between each other in the central area different from that in the peripheral area.

The plasma display panel further includes a plurality of blanks formed in parallel at each of the pair of the transparent electrodes in a hole shape.

Herein, at least either an area of the blanks or a gap between the blanks in the central area is different from that in the peripheral area.

Herein, the blank located at the peripheral area has larger area than the blank located at the central area.

Herein, the gap between the blanks located at the central area is wider than the gap between the blanks located at the peripheral area.

A plasma display panel according to still another aspect of the present invention includes a plurality of address electrodes to which an address voltage is applied to select a cell and having a width in a central area different from that in a peripheral area of the plasma display panel.

Herein, the width of the address electrode is wider in the central area than in the peripheral area of the plasma display panel.

The plasma display panel further includes a plurality of pairs of transparent electrodes to which a sustaining voltage is applied for generating a sustaining discharge and having at least either a width or a gap between each other in the central area different from that in the peripheral area.

The plasma display panel further includes a plurality of metal bus electrodes formed at each of the pair of the transparent electrodes and having at least either a width or a gap between each other in the central area different from that in the peripheral area.

The plasma display panel further includes a plurality of blanks formed in parallel at each of the pair of the transparent electrodes in a hole shape.

Herein, at least either an area of the blanks or a gap between the blanks in the central area is different from that in the peripheral area.

Herein, the blank located at the peripheral area has larger area than the blank located at the central area.

Herein, the gap between the blanks located at the central area is wider than the gap between the blanks located at the peripheral area.

A plasma display panel according to still another aspect of the present invention includes a plurality of barrier ribs having at least either a gap between each others a thickness or a height in a central area different from that in a peripheral area of the plasma display panel.

Herein, the gap between the barrier ribs is wider in the central area than in the peripheral area.

Herein, the thickness of the barrier ribs is thinner in the central area than in the peripheral area.

Herein, the height of the barrier ribs is higher in the central area than in the peripheral area.

A plasma display panel having a plurality of discharge cells formed in it according to still another aspect of the present invention includes a plurality of black matrixes formed between the discharge cells and having a width in a central area different from that in a peripheral area of the plasma display panel.

Herein, the width of each of the black matrixes gets wider as it goes from the central area to the peripheral area.

Herein, the width of each of the black matrixes is uniform and the black matrix has a different width in accordance with a position-of the plasma display panel.

The black matrix includes a horizontal black matrix being parallel to a horizontal direction of the plasma display panel; and a vertical black matrix being parallel to a vertical direction of the plasma display panel.

The plasma display panel further includes a dielectric layer formed between the horizontal black matrix and the vertical black matrix.

A plasma display panel according to still another aspect of the present invention includes a substrate; and a dielectric layer formed on the substrate and having a thickness in a central area different from that in a peripheral area of the plasma display panel.

Herein, the thickness of the dielectric layer gets thinner as it goes from the peripheral area to the central area.

Herein, the thickness of the dielectric layer gets thinner step by step as it goes from the peripheral area to the central area.

Herein, the thickness of the dielectric layer gets thinner linearly as it goes from the peripheral area to the central area.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
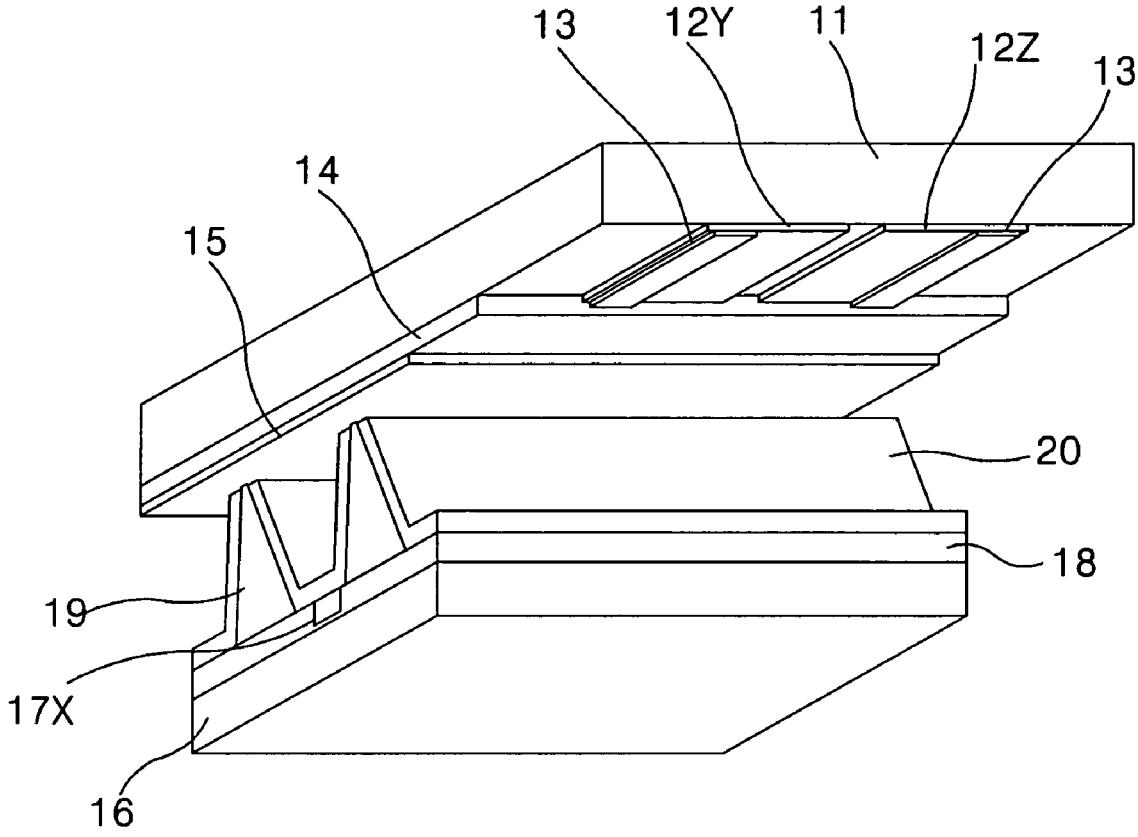
FIG. 1 RELATED ART
FIG. 1 illustrates a perspective view of a discharge cell structure of a conventional three-electrode AC surface discharge plasma display panel.
Figure 2:
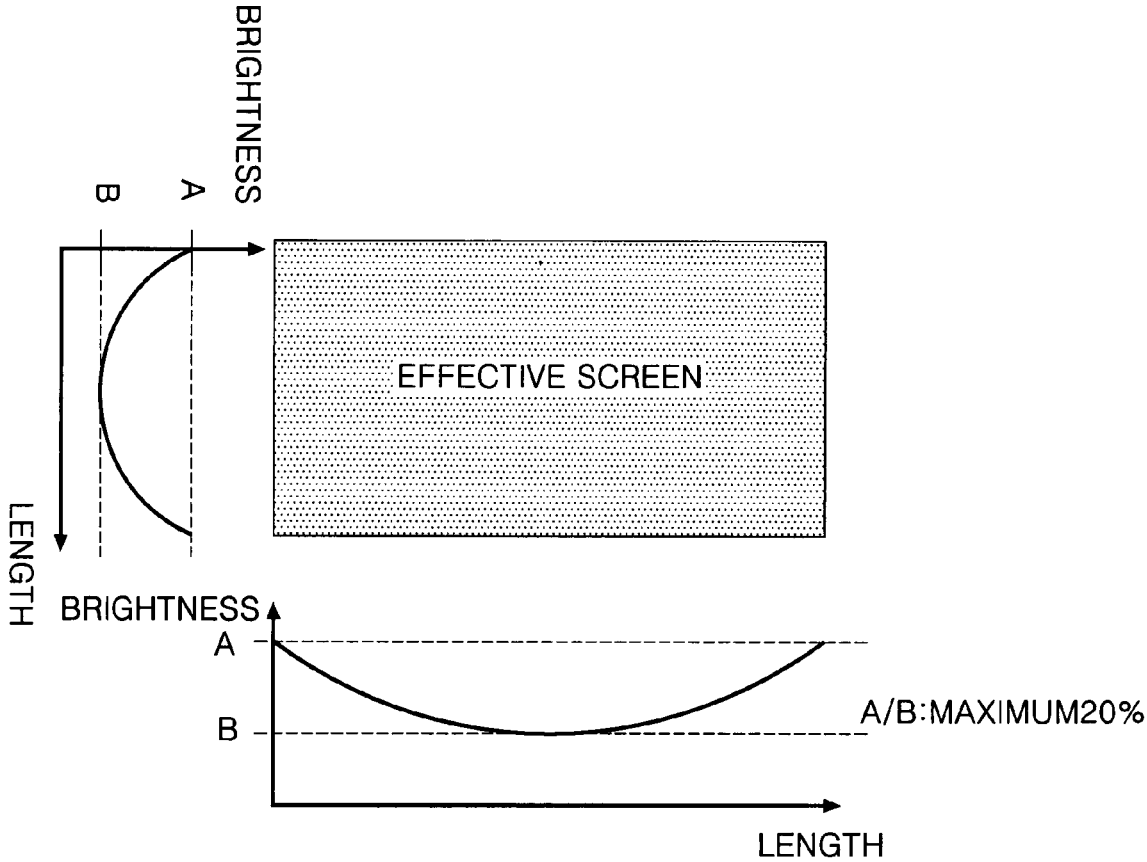
FIG.2 RELATED ART
FIG. 2 depicts a brightness inequality generated in the conventional three-electrode AC surface discharge plasma display panel shown in FIG. 1.
Figure 3:
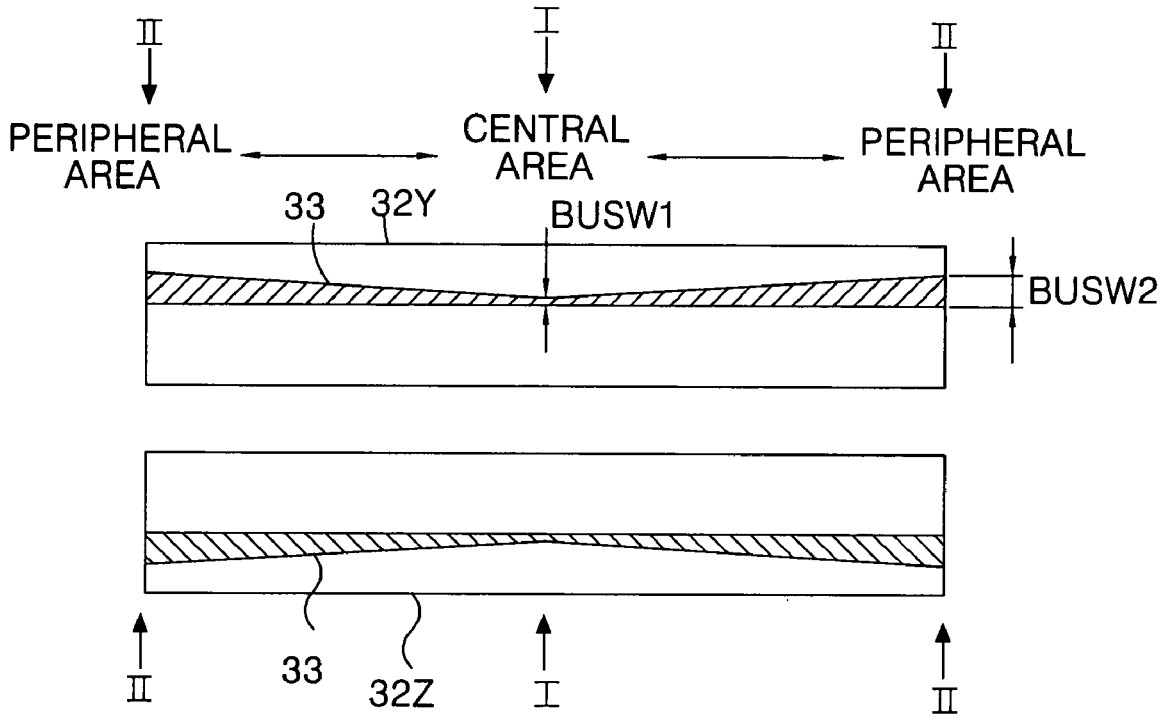
FIG. 3 illustrates a pair of sustaining electrodes of a plasma display panel according to the first embodiment of the present invention.
Figure 62:
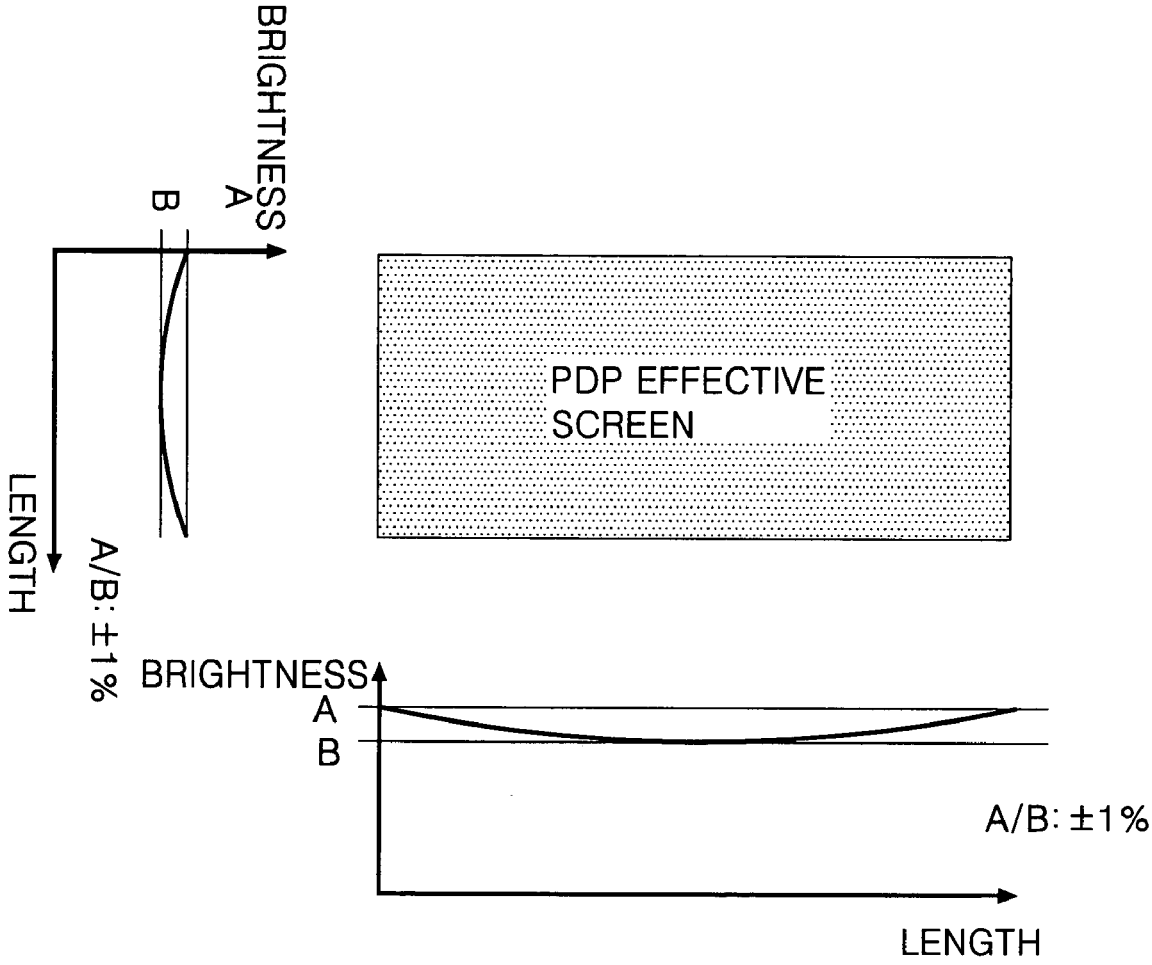
FIG. 62 is a graph representing a brightness deviation between a central area and a peripheral area of a PDP according to the present invention.

With reference to FIGS. 3 to 62, there are explained preferred embodiments of the present invention as follows.

Figure 4:
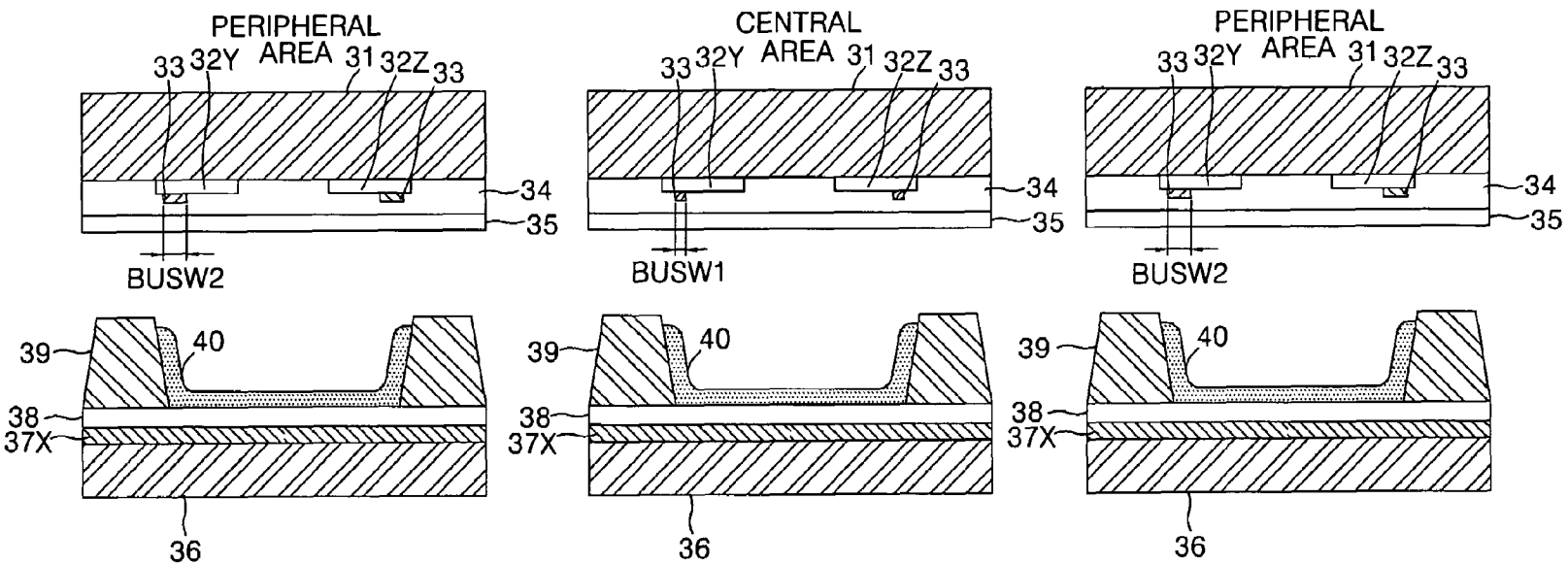
FIG. 4 illustrates a sectional view of a pair of sustaining electrodes located at a central area and a peripheral area of the PDP in FIG. 3, taken along the I-I' and II-II' lines.

Referring to FIGS. 3 and 4, a PDP according to the first embodiment of the present invention gets the width of a metal bus electrode 33, which is formed at each of a pair of transparent electrodes 32Y and 32Z, to be narrower as it goes from a peripheral area to a central area of the PDP.

Figure 5:
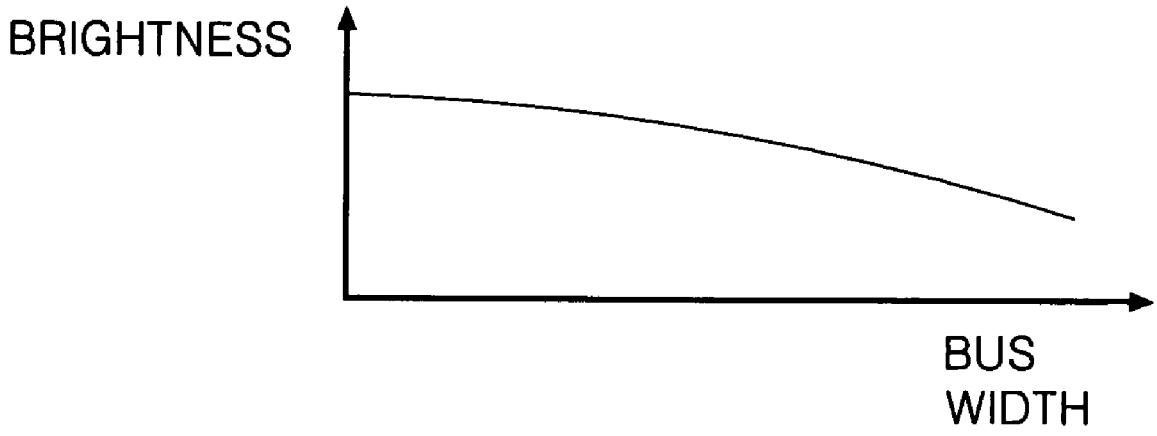
FIG. 5 is a graph representing a brightness change in accordance with a width change of a metal bus electrode in a PDP.
Figure 6:
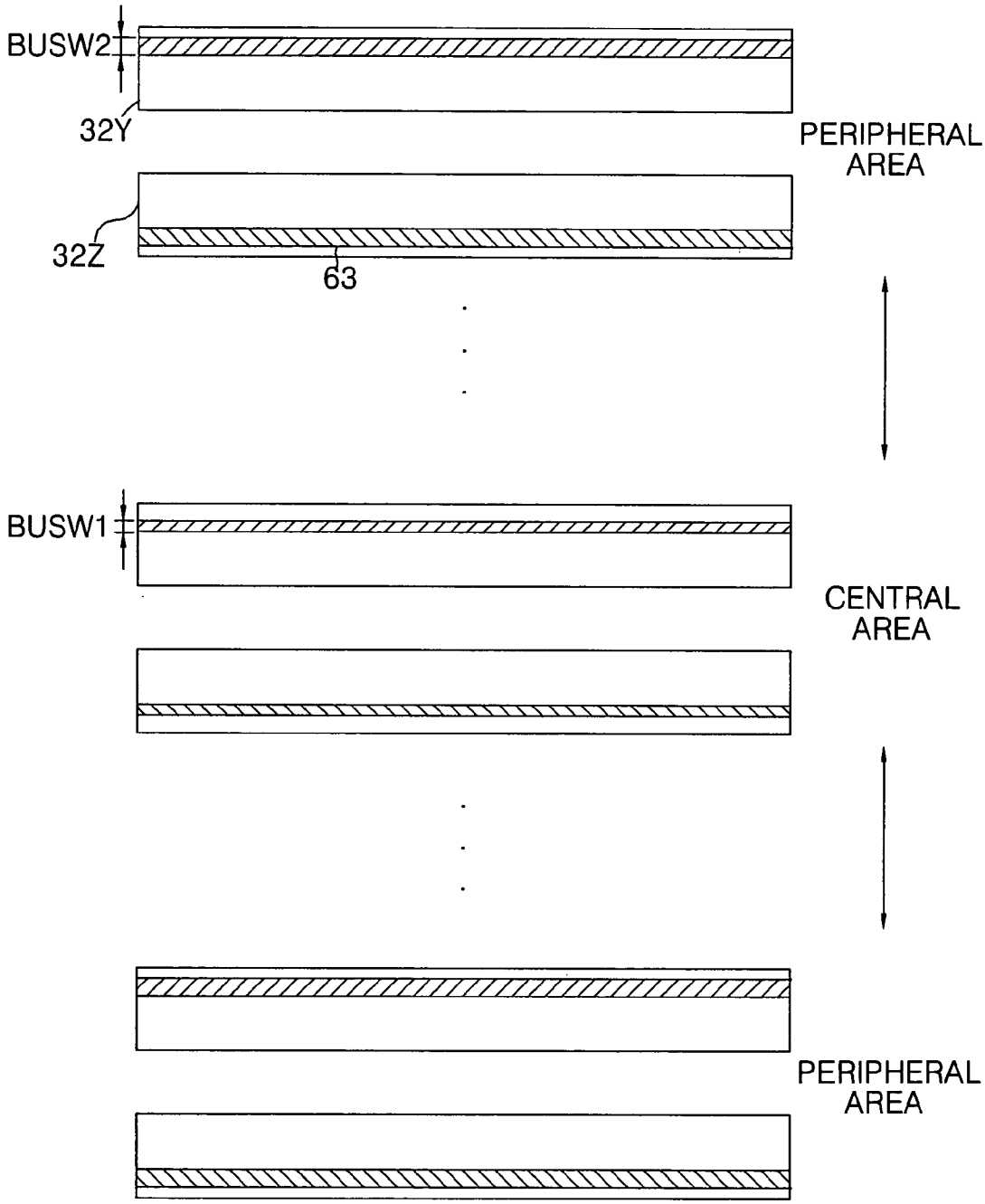
FIG. 6 illustrates pairs of sustaining electrodes of a PDP according to the second embodiment of the present invention.
Figure 7:
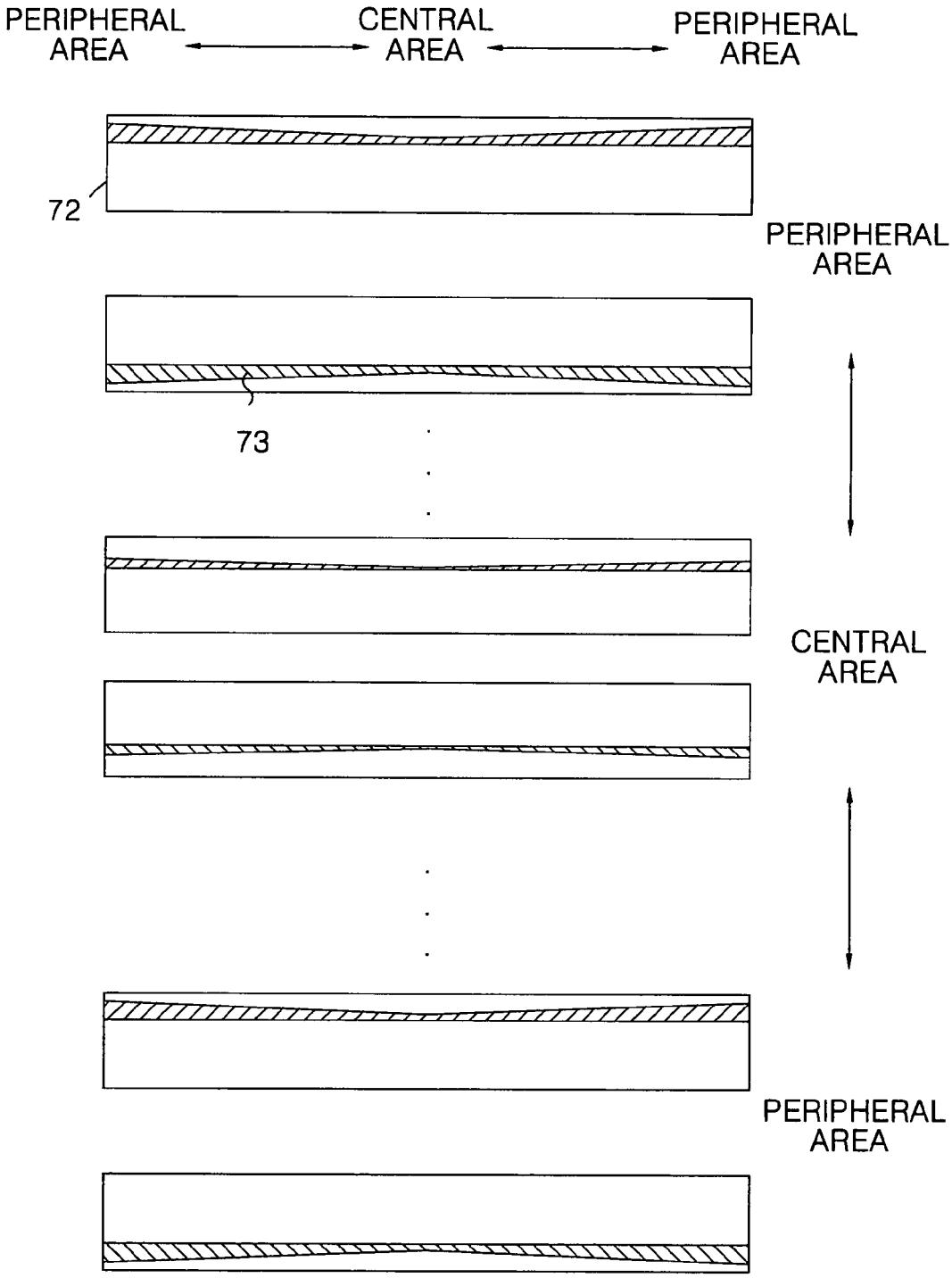
FIG. 7 illustrates a pair of sustaining electrodes of a PDP according to the third embodiment of the present invention.

In a relation between the width and the brightness of the metal bus electrode 33, the brightness of the PDP heightens as the width of the metal bus electrode 33 gets narrower, as in FIG. 5. Accordingly, because the width of the metal bus electrode 33 is narrower in the central area than in the peripheral area, it is possible to compensate the brightness difference between the central area and the peripheral area of the PDP. In consideration of a panel size and the brightness of the peripheral area, it may be desirable to set a central width BUSW1 of the metal bus electrode 33 to be narrower by 20% or less when compared with a peripheral width BUSW2.

There are an upper dielectric layer 34 and a protective film 35 deposited on an upper substrate 31 to cover the transparent electrodes 32Y and 32Z and the metal bus electrode 33. In the upper dielectric layer 34 are accumulated wall charges generated upon a plasma discharge. The protective film 35 prevents the damage of the upper dielectric layer 34 by the sputtering generated upon the plasma discharge, and increases the efficiency of secondary emission in addition. There is generally magnesium oxide MgO used for the protective film 35.

An address electrode 37X perpendicularly intersects the transparent electrodes 32Y and 33Z there are a lower dielectric layer 38 and a barrier rib 39 formed on a lower substrate 36 where the address electrode 37X is formed, and there is a fluorescent layer 40 spread over the surface of the barrier rib 39 and the lower dielectric layer 38, The barrier rib 39 is formed parallel to the address electrode 37X and prevents an ultraviolet and visible ray generated by the discharge from leaking to an adjacent discharge cell.

The fluorescent layer 40 is excited by the ultraviolet ray generated upon the plasma discharge to generate one visible ray out of red, green and blue rays.

There is an inactive mixture gas such as He+Xe, Ne+Xe or He+Ne+Xe for discharging interposed into a discharge space of the discharge cell provided between the upper/lower substrates 31 and 36 and the barrier rib 39.

In order to compensate a brightness difference between a central area and a peripheral area of a PDP in a vertical direction, the PDP according to the second embodiment of the present invention gets the widths BUSW1 and BUSW2 of a metal bus electrode 63, which is formed at each of a pair of transparent electrodes 62, to be narrower as it goes from the peripheral area to the central area. The peripheral area is located at upper/lower sides in a vertical direction.

A PDP according to the third embodiment of the present invention, as it uses both of the foregoing first and second embodiments, gets the widths BUSW1 and BUSW2 of a metal bus electrode 73, which is formed at each of a pair of transparent electrodes 72, to be narrower as it goes from a peripheral area to a central area in horizontal and vertical directions each, so that a brightness difference between the central and peripheral areas is compensated in both the horizontal and vertical directions.

Figure 8:
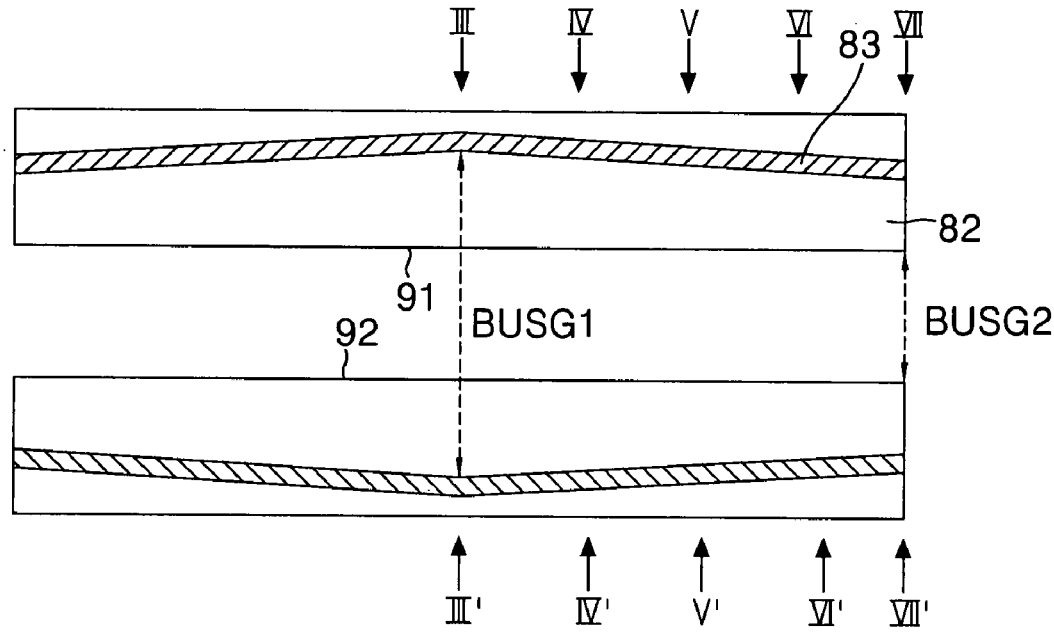
FIG. 8 illustrates a pair of sustaining electrodes of a PDP according to the fourth embodiment of the present invention.
Figure 9A:
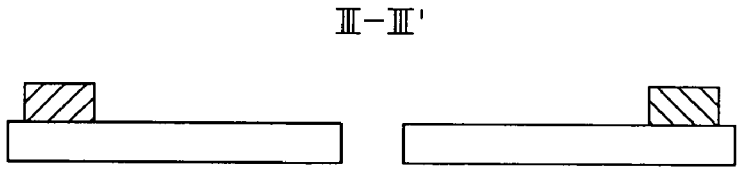
FIG. 9A is a sectional view representing a pair of sustaining electrodes of a PDP in FIG. 8, taken along the line III-III'.
Figure 9B:
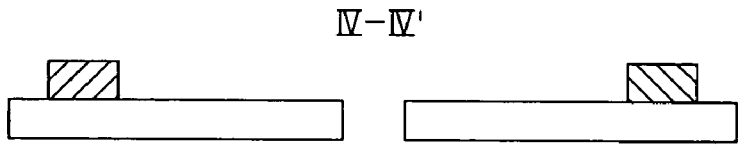
FIG. 9B is a sectional view representing a pair of sustaining electrodes of a PDP in FIG. 8, taken along the line IV-IV'.
Figure 9C:
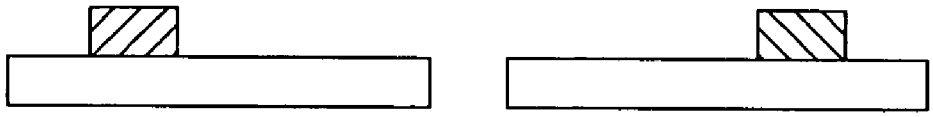
FIG. 9C is a sectional view representing a pair of sustaining electrodes of a PDP in FIG. 8, taken along the line V-V'.
Figure 9D:
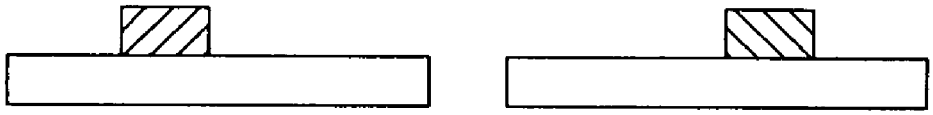
FIG. 9D is a sectional view representing a pair of sustaining electrodes of a PDP in FIG. 8, taken along the line VI-VI'.
Figure 9E:
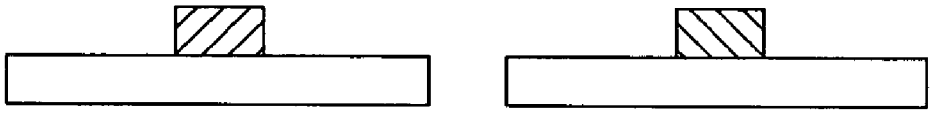
FIG. 9E is a sectional view representing a pair of sustaining electrodes of a PDP in FIG. 8, taken along the line VII-VII'.
Figure 10:
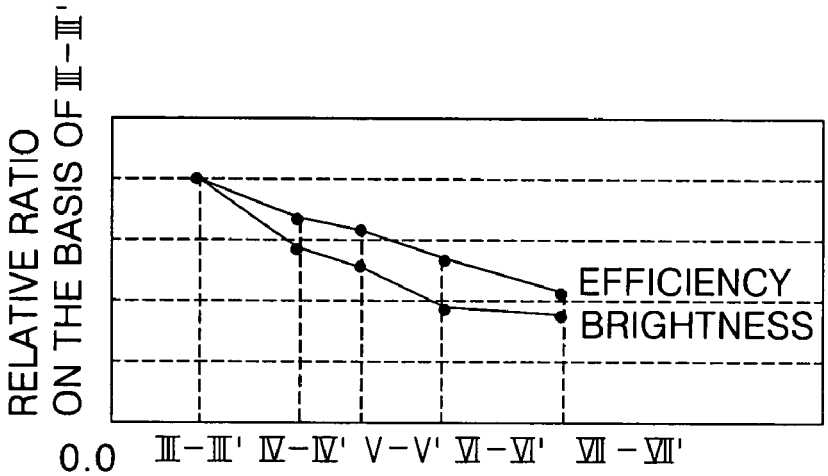
FIG. 10 is a graph representing a brightness change in accordance with a gap between metal bus electrodes in a PDP.

Referring to FIGS. 8 to 10, they illustrate a PDP according to the fourth embodiment of the present invention. The other area except a pair of sustaining electrodes of the PDP is the same as the foregoing embodiment of the PDP, so that a detailed explanation will be left out.

Referring to FIGS. 8 and 9A to 9E, the PDP according to the fourth embodiment of the present invention gets the gaps BUSG1 and BUSG2 of a pair of metal bus electrodes 83, which are formed at each of a pair of transparent electrodes 82, to be wider as it goes from a peripheral area to a central area.

In the relation between the brightness and the gaps between the metal bus electrodes 83, the brightness of the PDP heightens as the gaps BUSG1 and BUSG2 between the metal bus electrodes 83, as in FIG. 10, gets wider. Also, the efficiency of the PDP increases as the gap between the metal bus electrodes 83 gets wider. Accordingly, because the gap BUSG1 of the central area between the metal bus electrodes 83 is wider than that of the peripheral area, it is possible to compensate the brightness difference between the central area and the peripheral area of the PDP.

It is desirable to allow the gap difference between the metal bus electrodes 83 to have the position of the central area formed outwards by about 20% or less, as compared with the peripheral area, on the basis of each of sides 91 and 92 that a scan/sustaining electrode Y and a common sustaining electrode Z are facing. The width of each of the metal bus electrodes 83 is equally set in the central area and the peripheral area.

Figure 11:
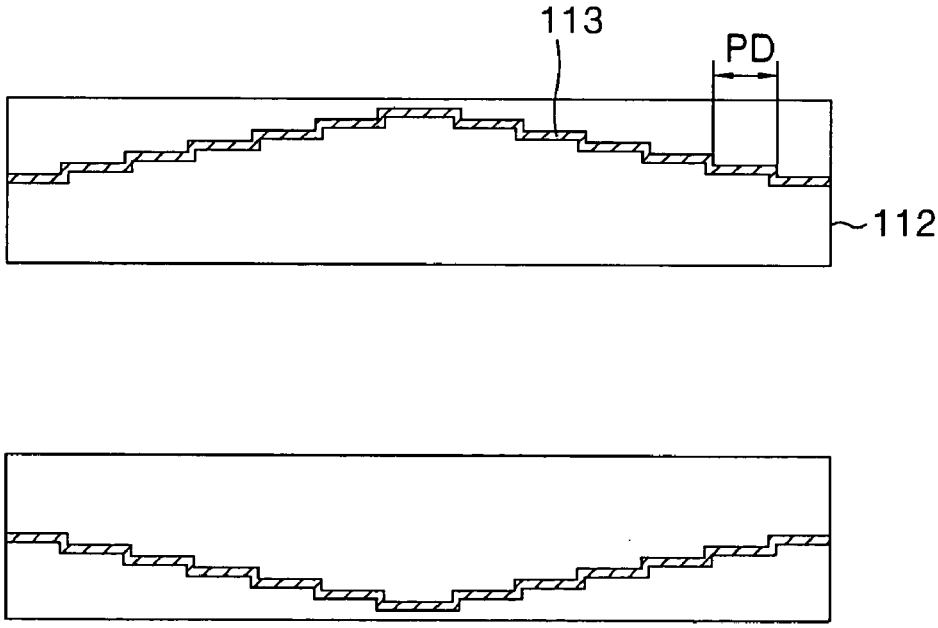
FIG. 11 illustrates a pair of sustaining electrodes of a PDP according to the fifth embodiment of the present invention.

Referring to FIG. 11, the PDP according to the fifth embodiment of the present invention gets the gap between a pair of metal bus electrodes 113, which are formed at each of a pair of transparent electrodes 112, to be wider at a certain pixel area unit PD as it goes from a peripheral area to a central area. Herein, the pixel area unit PD is set at a length including a few or several tens of pixels. Accordingly, the gap between the metal bus electrodes 113 gradually becomes wider as it gets nearer to the central area, having a length including a few or several tens of pixels as its unit.

Figure 12:
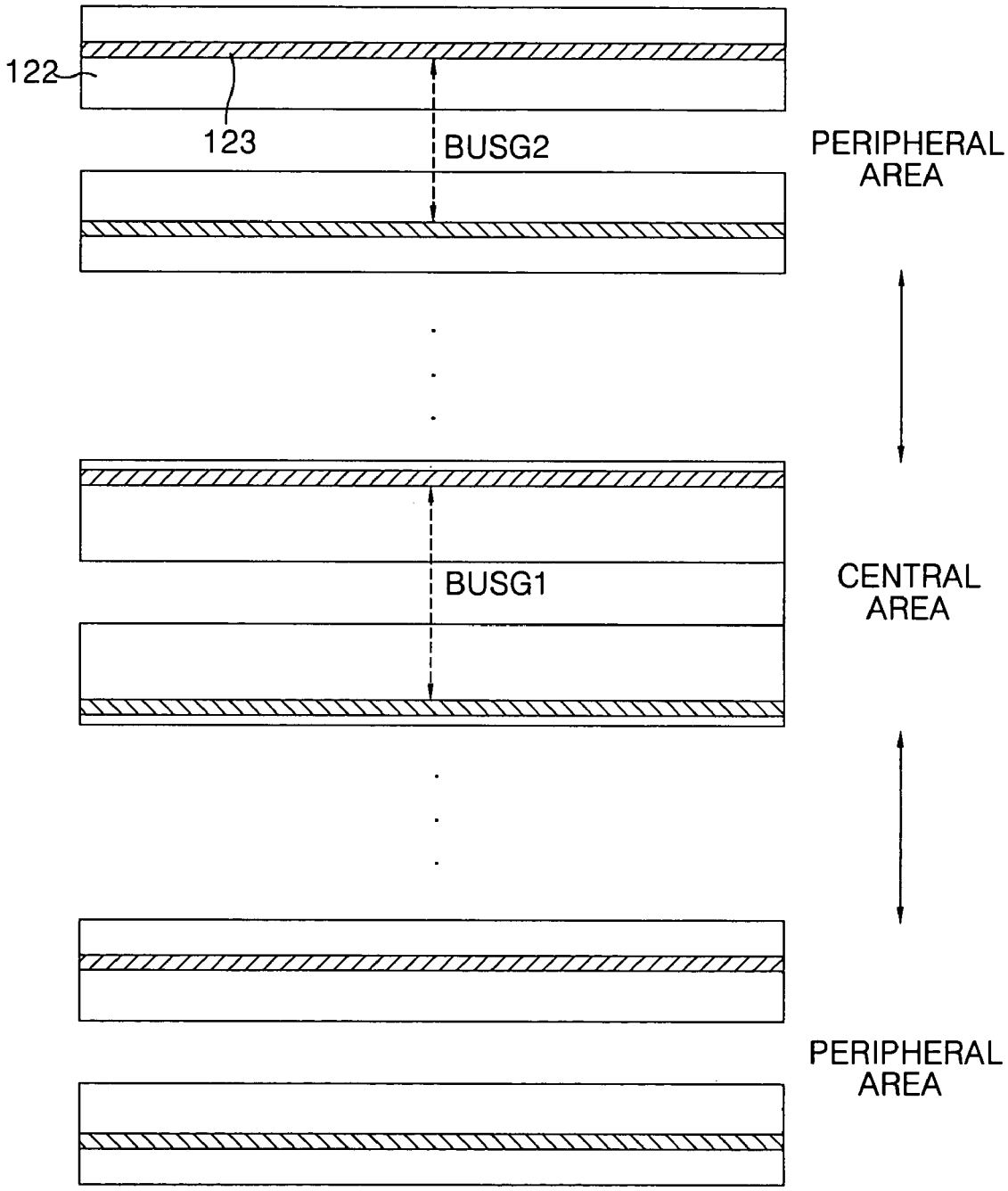
FIG. 12 illustrates pairs of sustaining electrodes of a PDP according to the sixth embodiment of the present invention.

Referring to FIG. 12, in order to compensate a brightness difference between a central area and a peripheral area of a PDP in a vertical direction, the PDP according to the sixth embodiment of the present invention gets the gap between a pair of metal bus electrodes 123, which is formed at each of a pair of transparent electrodes 122, to be wider as it goes from the peripheral area to the central area. The peripheral area is located at upper/lower edges in a vertical direction.

Figure 13:
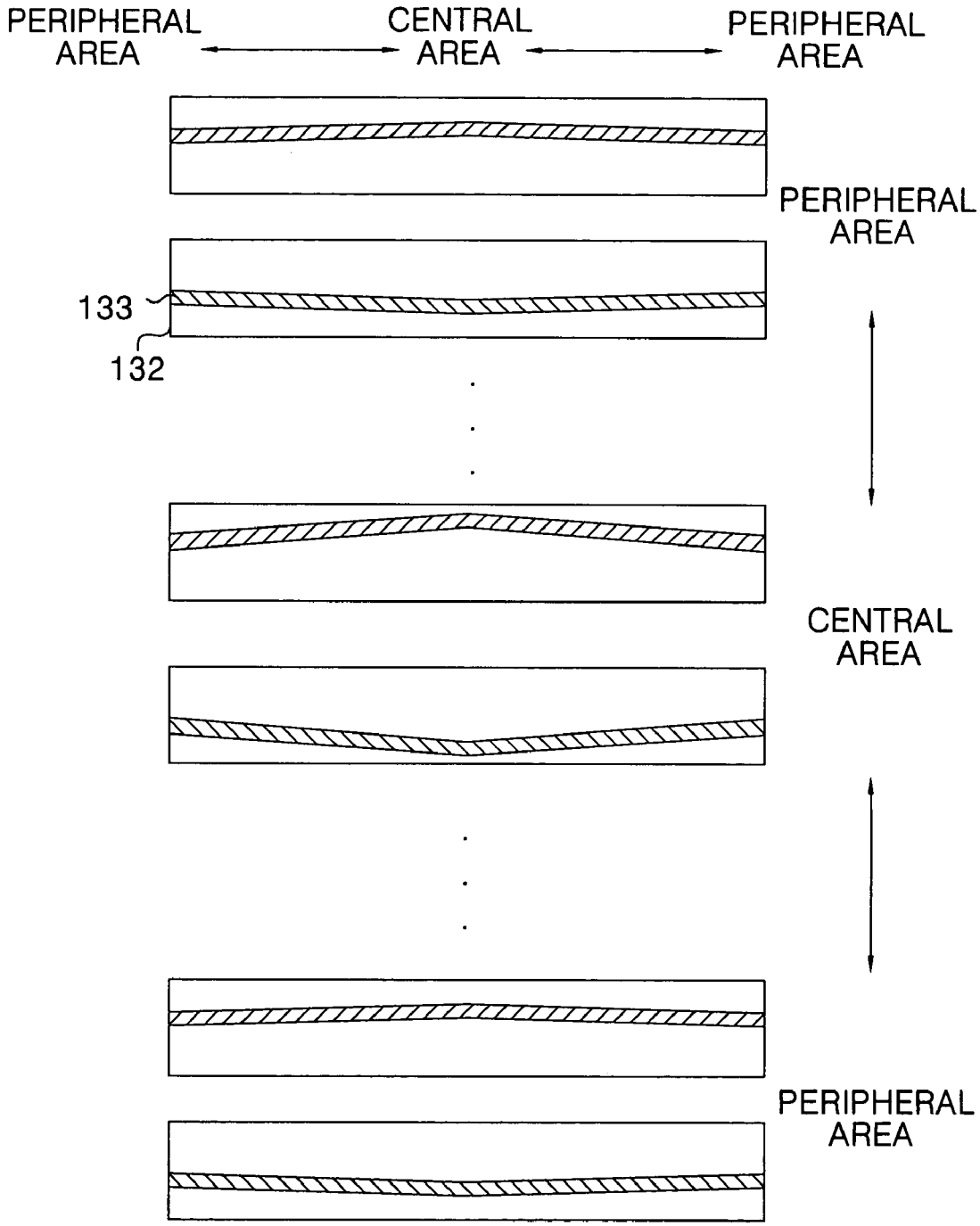
FIG. 13 illustrates pairs of sustaining electrodes of a PDP according to the seventh embodiment of the present invention.

Referring to FIG. 13, a PDP according to the seventh embodiment of the present invention gets the gap between a pair of metal bus electrodes 133, which is formed at each of a pair of transparent electrodes 132, to be wider as it goes from a peripheral area to a central area in horizontal and vertical directions each, so that a brightness difference between the central and peripheral areas is compensated in both the horizontal and vertical directions of the PDP.

Figure 14:
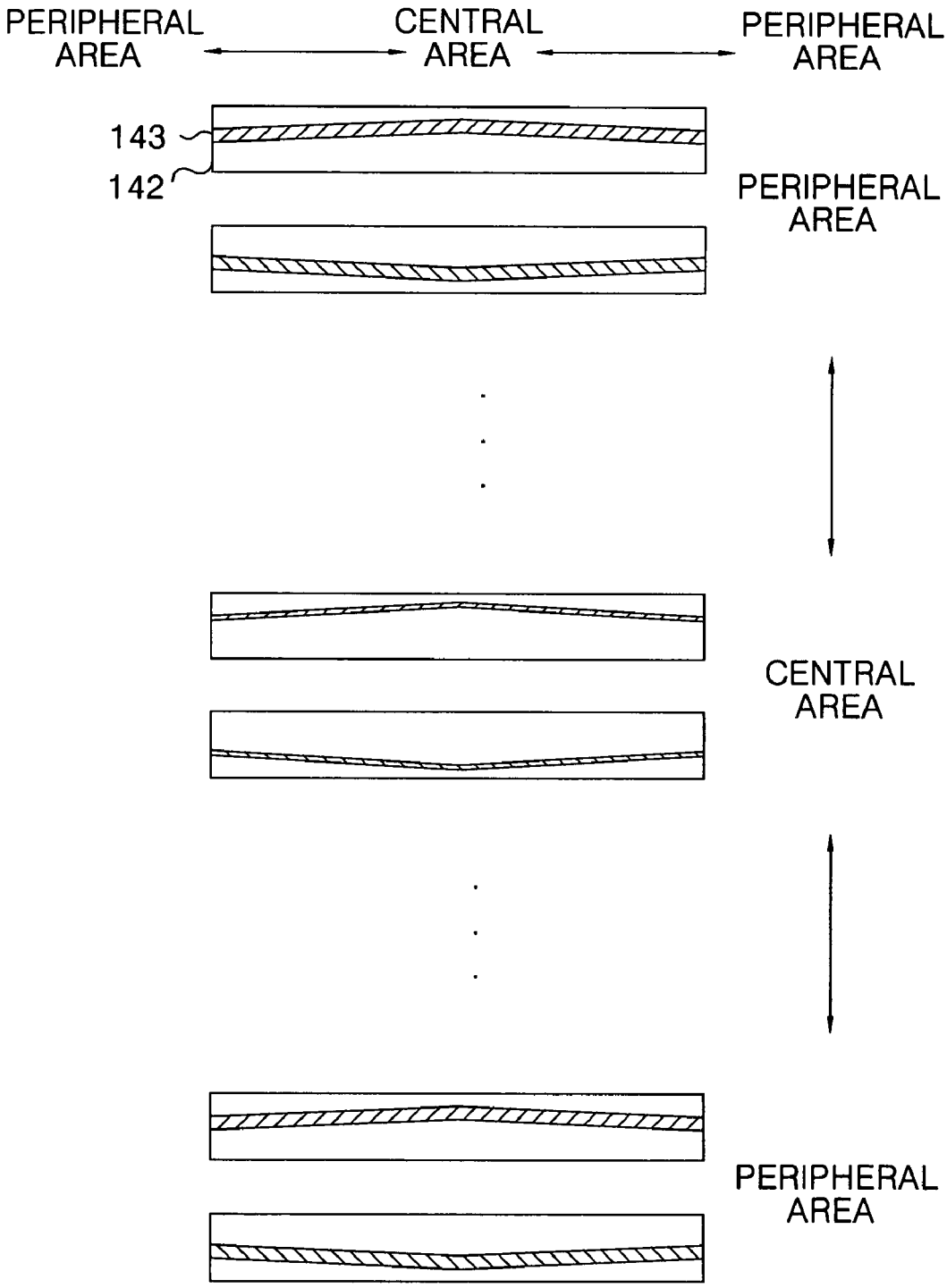
FIG. 14 illustrates pairs of sustaining electrodes of a PDP according to the eighth embodiment of the present invention.

Referring to FIG. 14, a PDP according to the eighth embodiment of the present invention gets the gap between a pair of metal bus electrodes 143, which is formed at each of a pair of transparent electrodes 142, to be wider as it goes from a peripheral area to a central area in horizontal and vertical directions each and the width of each metal bus electrode 143 to be narrower as it goes to the central area from the peripheral area located at the upper/lower edges in a vertical direction, so that a brightness difference between the central and peripheral areas is compensated in both the horizontal and vertical directions of the PDP.

Figure 15:
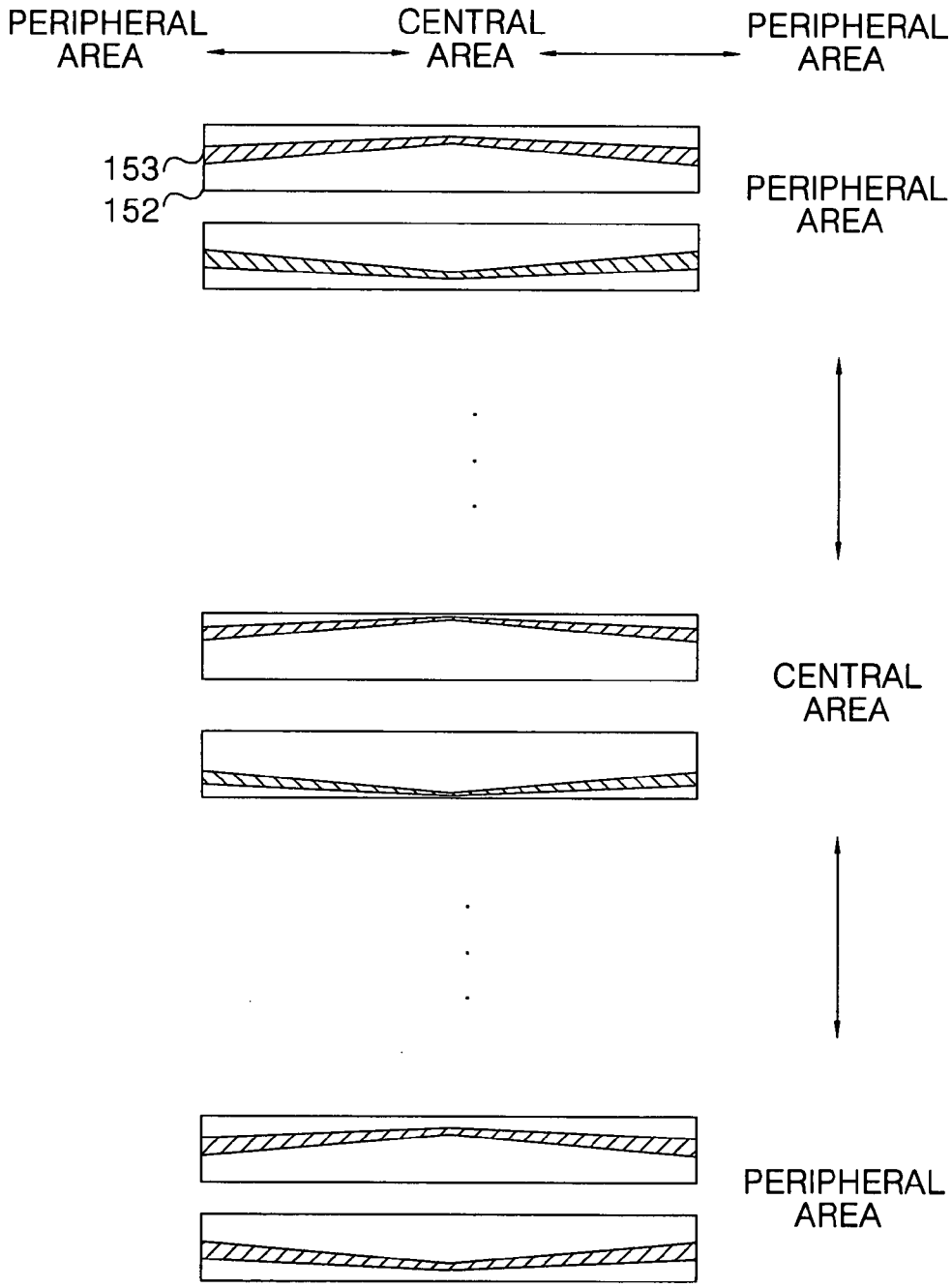
FIG. 15 illustrates pairs of sustaining electrodes of a PDP according to the ninth embodiment of the present invention.

Referring to FIG. 15, a PDP according to the ninth embodiment of the present invention gets the gap between a pair of metal bus electrodes 153, which is formed at each of a pair of transparent electrodes 152, to be wider as it goes from a peripheral area to a central area in horizontal and vertical directions each, and the width of each metal bus electrode 153 to be narrower as it goes to the central area from the peripheral area located at the upper/lower edges in a vertical direction, so that a brightness difference between the central and peripheral areas is compensated in both the horizontal and vertical directions of the PDP.

FIGS. 16 to 23 illustrate a transparent electrode of a PDP according to the embodiments $10^{th}$ through $16^{th}$ of the present invention.

Figure 16:
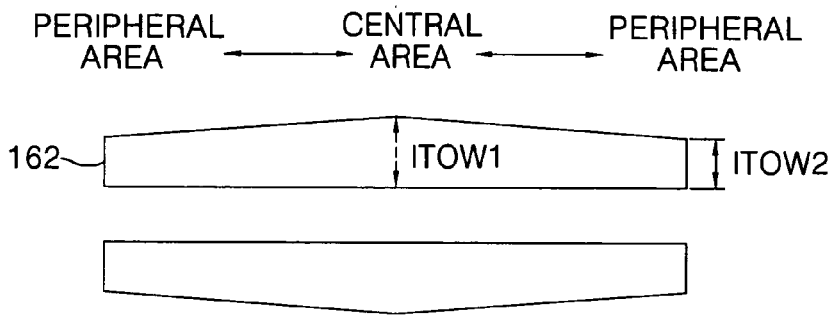
FIG. 16 illustrates a pair of transparent electrodes of a PDP according to the tenth embodiment of the present invention.
Figure 17:
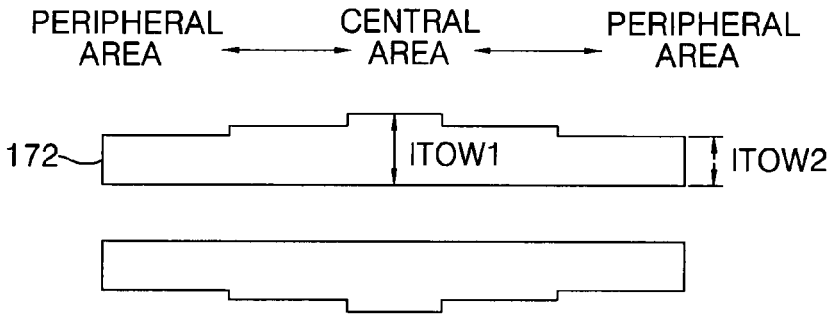
FIG. 17 illustrates a pair of transparent electrodes of a PDP according to the eleventh embodiment of the present invention.

Referring to FIGS. 16 and 17, a PDP according to the tenth and eleventh embodiments of the present invention gets the widths ITOW1, ITOW2 of pairs of transparent electrodes 162 and 172 to be wider as it goes from a peripheral area to a central area.

Figure 18:
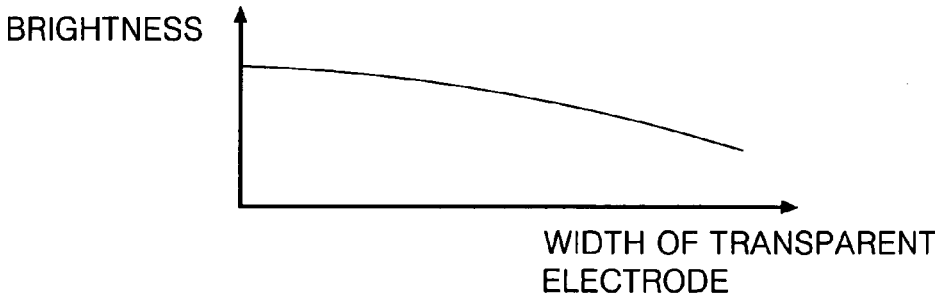
FIG. 18 is a graph representing a brightness change in accordance with a width of a transparent electrode in a PDP.

In the relation between the brightness and the widths ITOW1 and ITOW2 between the pairs of the metal bus electrodes 162 and 172, the brightness of the PDP heightens as the widths between the pairs of the metal bus electrodes 162 and 172, as in FIG. 18, gets wider. Accordingly, because the widths between the metal bus electrodes 162 and 172 is wider in the central area than in the peripheral area, it is possible to compensate the brightness difference between the central area and the peripheral area of the PDP. The central area's width ITOW1 of the pairs of the transparent electrodes 162 and 172 is wider by about 20% or less as compared with the width ITOW2 of the peripheral area.

FIG. 16 shows that an outer side of a pair of transparent electrodes 162 is patterned in a certain gradient and the other side is horizontally patterned so that their width is wider as it goes to a central area. FIG. 17 shows that an outer side of a pair of transparent electrodes 172 is patterned in a step shape and the other side is horizontally patterned so that their width is wider as it goes to a central area.

Figure 19:
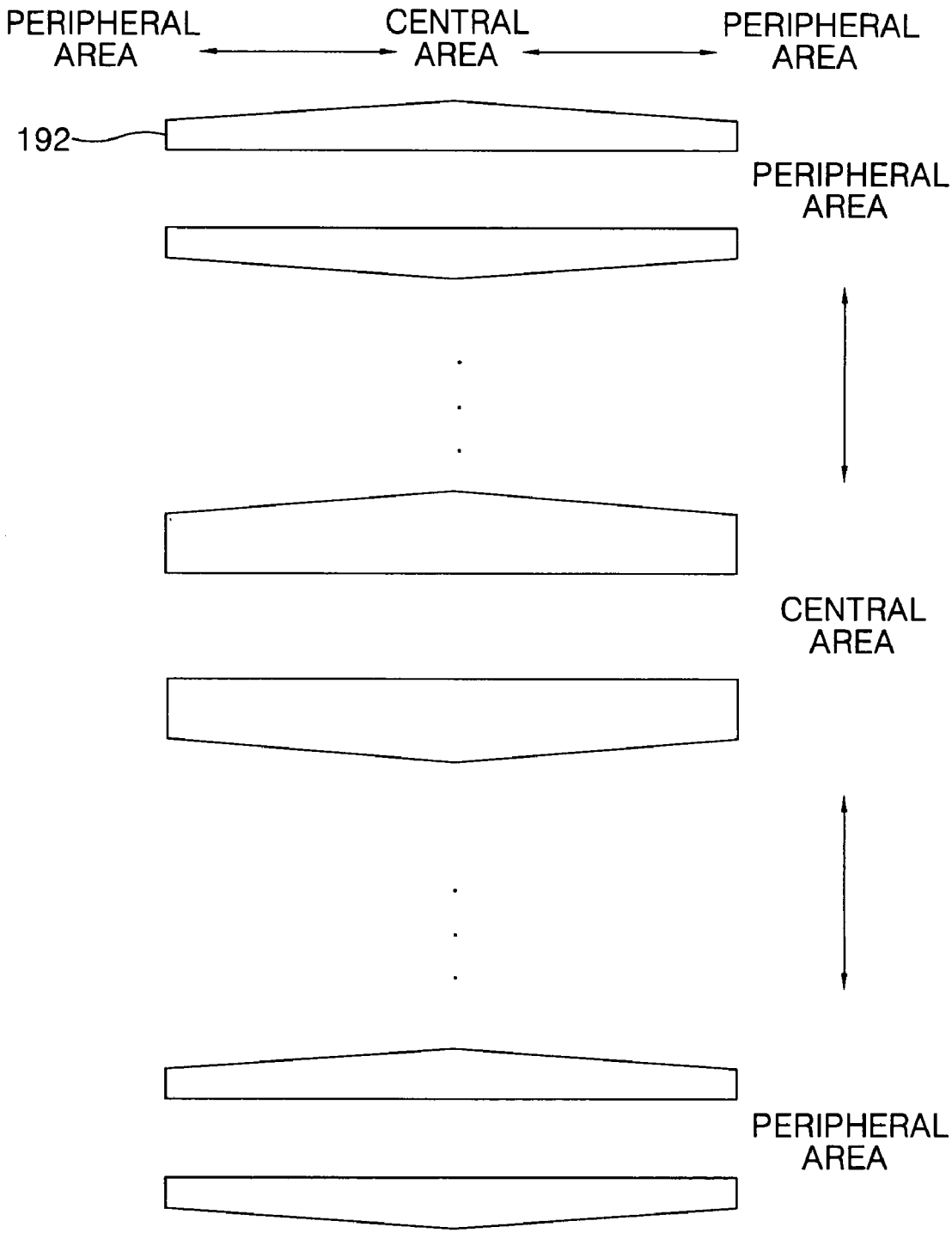
FIG. 19 illustrates pairs of transparent electrodes of a PDP according to the twelfth embodiment of the present invention.

Referring to FIG. 19, a pair of transparent electrodes 192 of a PDP according to the twelfth embodiment of the present invention gets their width to be wider as it goes from a peripheral area to a central area in horizontal and vertical directions each so that a brightness difference between the central area and the peripheral area is compensated. This embodiment is applied in the same way as in the step shape as in FIG. 17.

Figure 20:
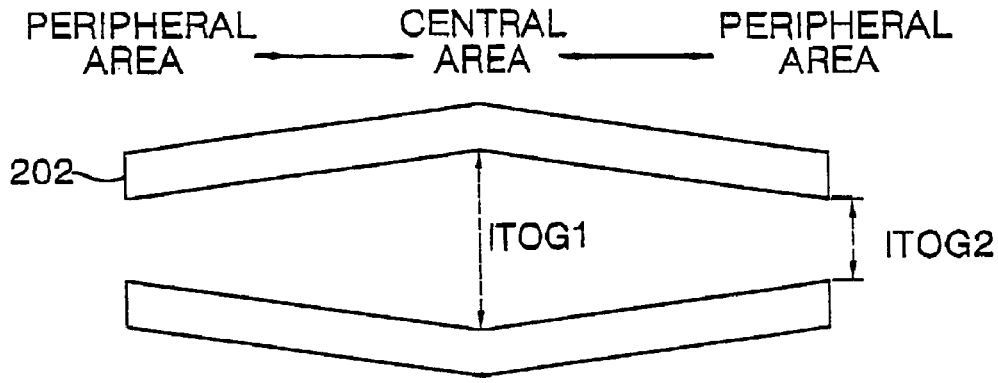
FIG. 20 illustrates a pair of transparent electrodes of a PDP according to the thirteenth embodiment of the present invention.
Figure 21:
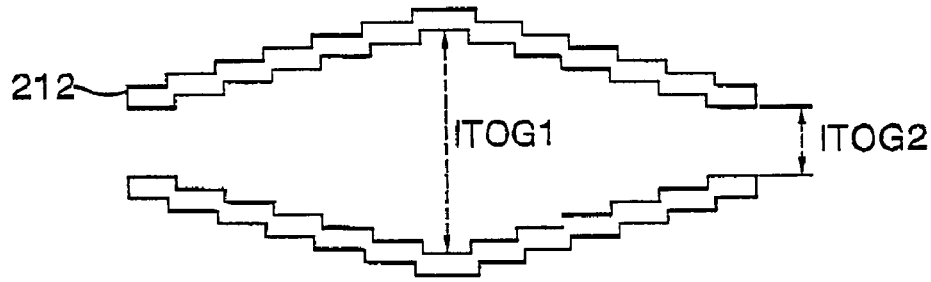
FIG. 21 illustrates a pair of transparent electrodes of a PDP according to the fourteenth embodiment of the present invention.

Referring to FIGS. 20 and 21, pairs of transparent electrodes 202 and 212 of a PDP according to the thirteenth and fourteenth embodiments of the present invention get their gaps ITOG1 and ITOG2 therebetween as it goes from a peripheral area to a central area.

Figure 22:
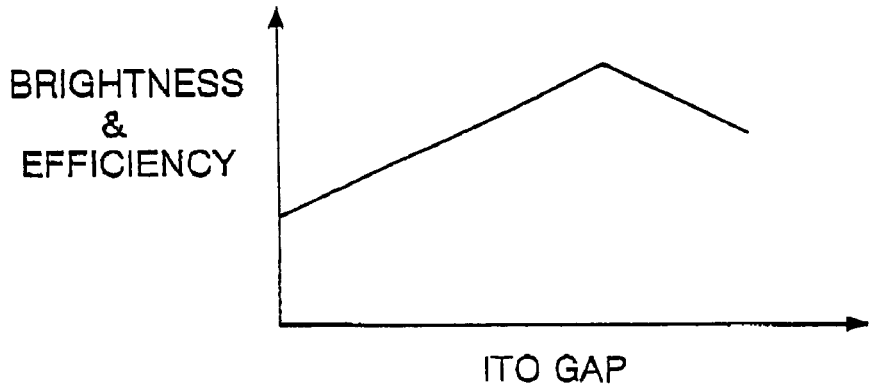
FIG. 22 is a graph representing a brightness change in accordance with a gap between transparent electrodes in a PDP.

In the relation between the brightness and the gaps ITOG1 and ITOG2 between the pairs of the metal bus electrodes 202 and 212, the brightness of the PDP heightens as the gaps ITOG1 and ITOG2 between the pairs of the metal bus electrodes 202 and 212, as in FIG. 22, gets wider and if it goes wider than a certain gap, the brightness decreases. Accordingly, because the gaps between the pairs of the metal bus electrodes 202 and 212 are wider in the central area of the PDP than in the peripheral area, it is possible to compensate the brightness difference between the central area and the peripheral area of the PDP. Here, the gap ITOG1 of the central area is set to be the same as or less than the value that starts to lower after the brightness rises. The gap ITOG1 of the pairs of the transparent electrodes 202 and 212 in the central area is wider by about 20% or less as compared with the gap ITOG2 of the peripheral area.

FIG. 20 shows that the pair of the transparent electrodes 202 rise and descend in a certain gradient and are patterned symmetrically so that the gap therebetween becomes wider as it goes to a central area. FIG. 21 shows that the pair of the transparent electrodes 212 is symmetrically patterned in a step shape so that the gap therebetween becomes wider as it goes to a central area.

Figure 23:
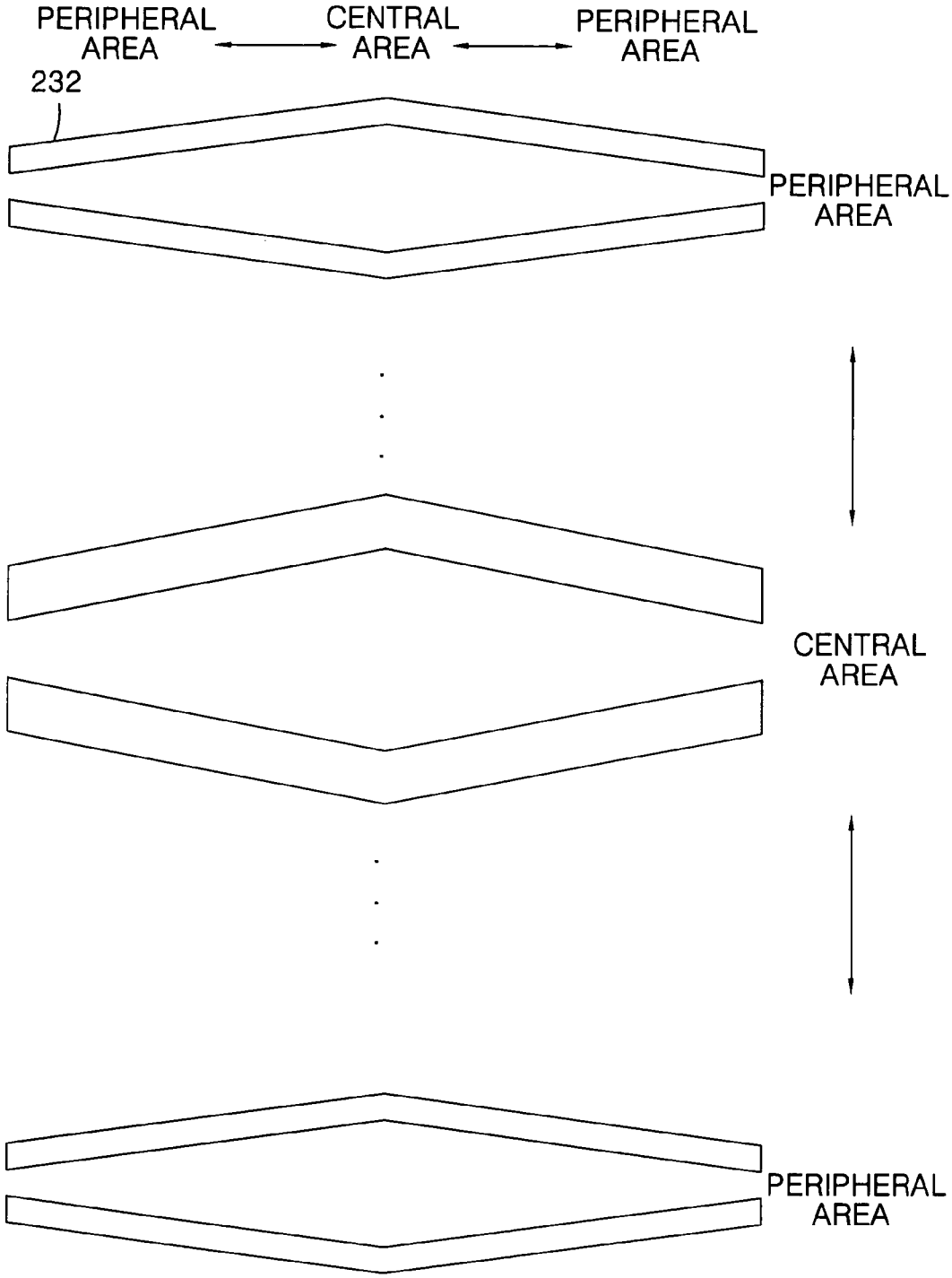
FIG. 23 illustrates pairs of transparent electrodes of a PDP according to the fifteenth embodiment of the present invention.

Referring to FIG. 23, a PDP according to the fifteenth embodiment of the present invention gets the gap between a pair of transparent electrodes 232 to be wider as it goes from a peripheral area to a central area in horizontal and vertical directions each, so that a brightness difference between the central area and the peripheral area is compensated in the horizontal direction and vertical directions of the PDP.

Figure 24:
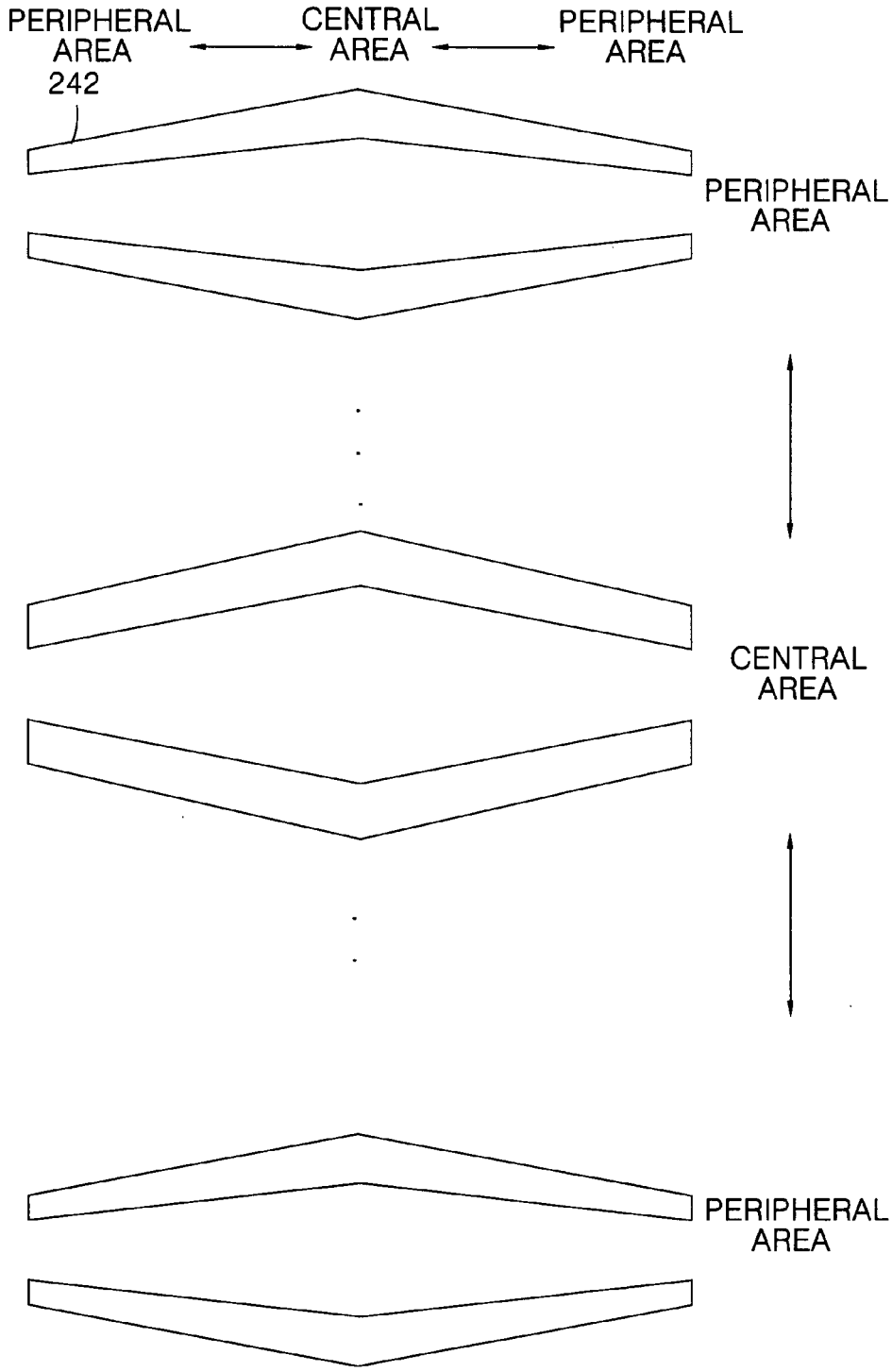
FIG. 24 illustrates pairs of transparent electrodes of a PDP according to the sixteenth embodiment of the present invention.

Referring to FIG. 24, a PDP according to the sixteenth embodiment of the present invention gets the gap between a pair of transparent electrodes 242 to be wider as it goes from a peripheral area to a central area in horizontal and vertical directions each and the width of each of the transparent electrodes 242 to be wider as it goes from the peripheral area to the central area in the horizontal and vertical directions each so as to compensate a brightness difference between the central area and the peripheral area in the horizontal direction and vertical directions of the PDP.

Figure 25:
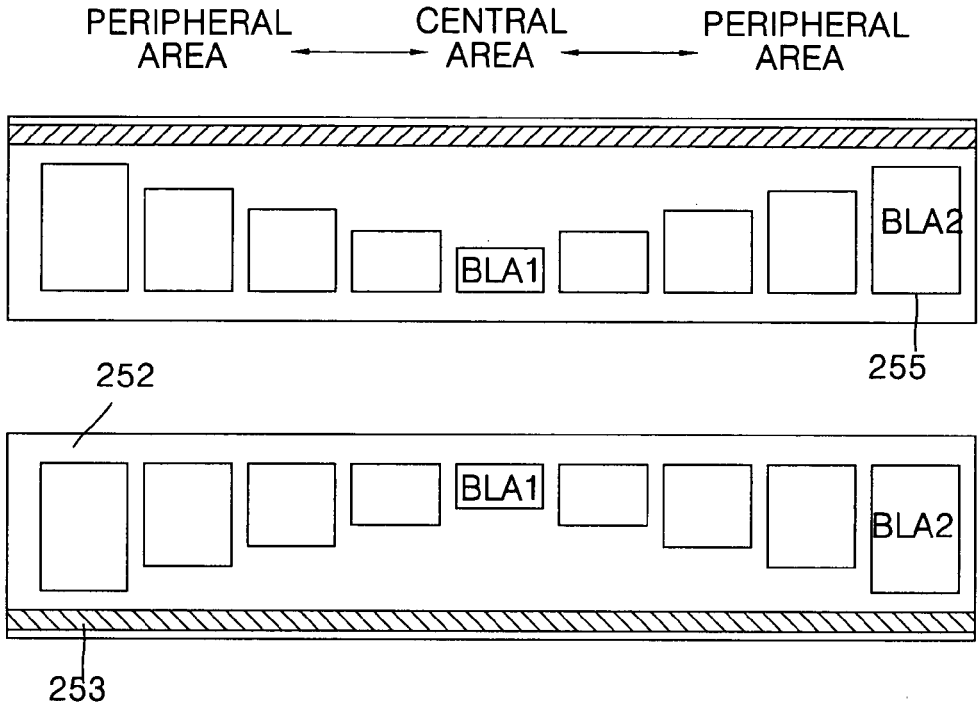
FIG. 25 illustrates a pair of sustaining electrodes of a PDP according to the seventeenth embodiment of the present invention.
Figure 26:
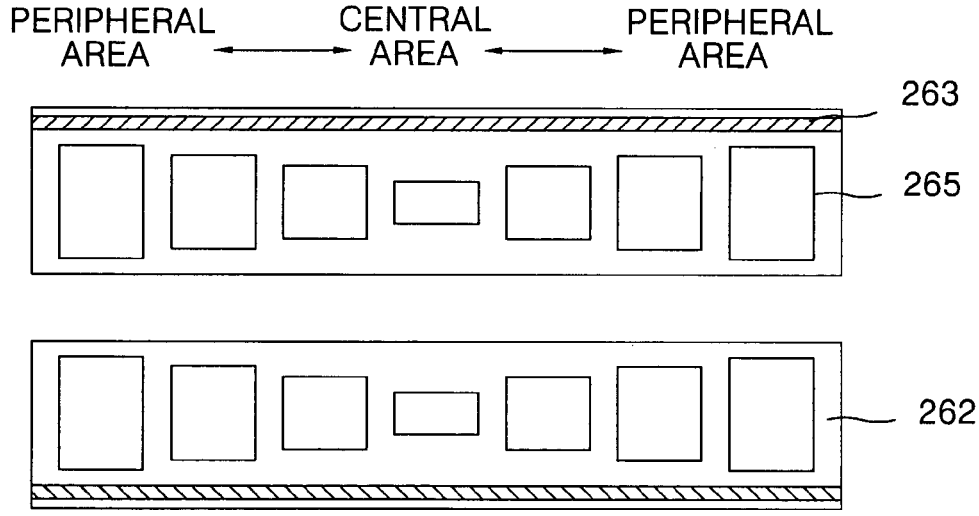
FIG. 26 illustrates a pair of sustaining electrodes of a PDP according to the eighteenth embodiment of the present invention.

Referring to FIGS. 25 and 26, a PDP according to the seventeenth and eighteenth embodiment of the present invention includes pairs of transparent electrodes 252 and 262 where a plurality of blanks 255 and 265 are formed for increasing the efficiency and brightness, and metal bus electrodes 253 and 263 formed at each of the pairs of the transparent electrodes 252 and 262.

The PDP has each width of the pairs of the transparent electrodes 252 and 262 increased by blanks 255 and 265 and the gaps of the pairs of the transparent electrodes 252 and 262 narrowed so that a discharge can be initiated with a low voltage and a discharge path lengthens, thereby increasing the efficiency and brightness.

The blanks 255 and 265 are formed in a hole shape in the pairs of the transparent electrodes 252 and 262, and the length of a vertical side shortens as it goes from a peripheral area to a central area so that areas BLA1 and BLA2 get smaller as it goes to the central area.

Figure 27:
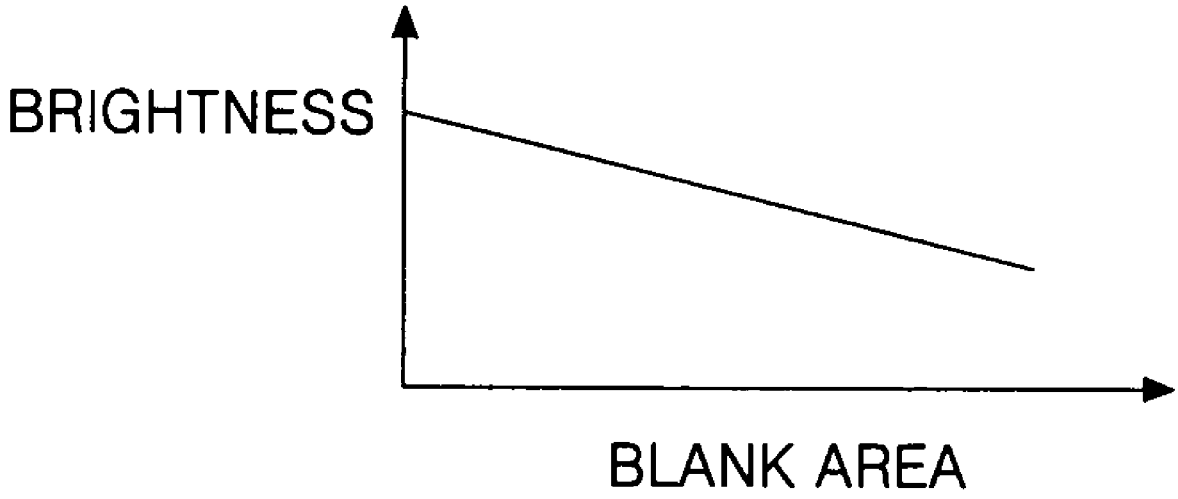
FIG. 27 is a graph representing a brightness change in accordance with the area of a blank in a PDP.

In the relation between the brightness and the areas BLA1 and BLA2 of the blanks 245 and 255, the brightness of the PDP heightens as the areas BLA1 and BLA2 of blank 245 and 255, as in FIG. 27, gets smaller. Accordingly, because the areas of the blanks 245 and 255 are smaller as it goes to a central area of the PDP, it is possible to compensate a brightness difference between the central area and a peripheral area of the PDP. The area BLA2 of the blanks 255 and 265 located in the peripheral area is larger by 5~40% as compared with the area BLA1 of the blanks 255 and 265 located in the central area.

FIG. 25 shows that the gap between the blanks 255 that vertically face each other is the same both in the central area and in the peripheral area. FIG. 26 shows that the gap between the blanks 265 that vertically face each other gets wider as it goes from a peripheral area to a central area to make the gap between the blanks 265 that vertically face each other bigger, thereby increasing the brightness of the central area.

Figure 28:
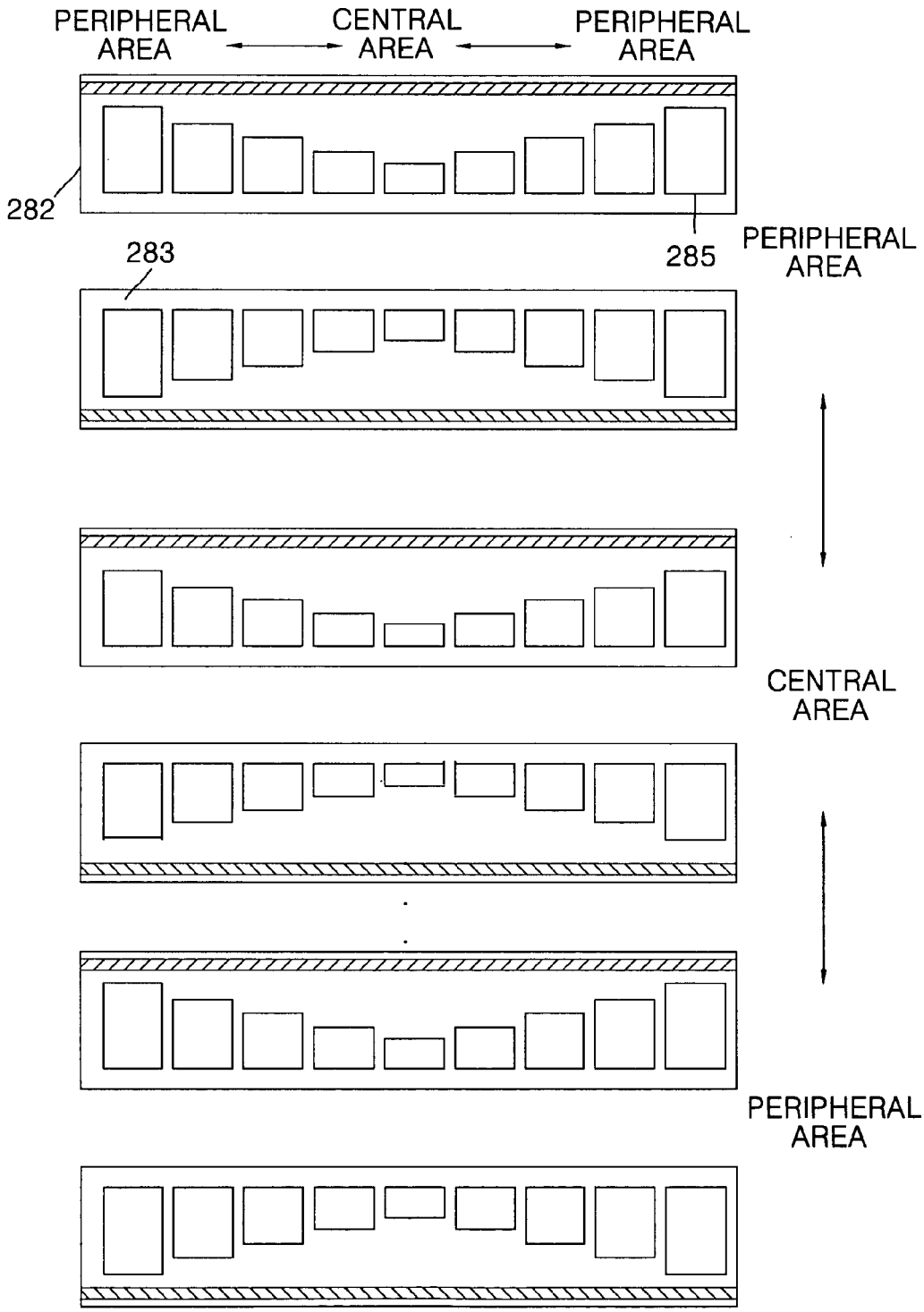
FIG. 28 illustrates pairs of sustaining electrodes of a PDP according to the nineteenth embodiment of the present invention.

Referring to FIG. 28, a PDP according to the nineteenth embodiment of the present invention gets the area of a blank 285 to be smaller as it goes from a peripheral area to a central area in horizontal and vertical directions each so as to compensate a brightness difference between the central area and the peripheral area in the horizontal direction and vertical directions of the PDP. In the same manner, the blank 265 shown in FIG. 26, though not shown, may get its area to be smaller as it goes from the peripheral area to the central area in the horizontal and vertical directions each.

Figure 29:
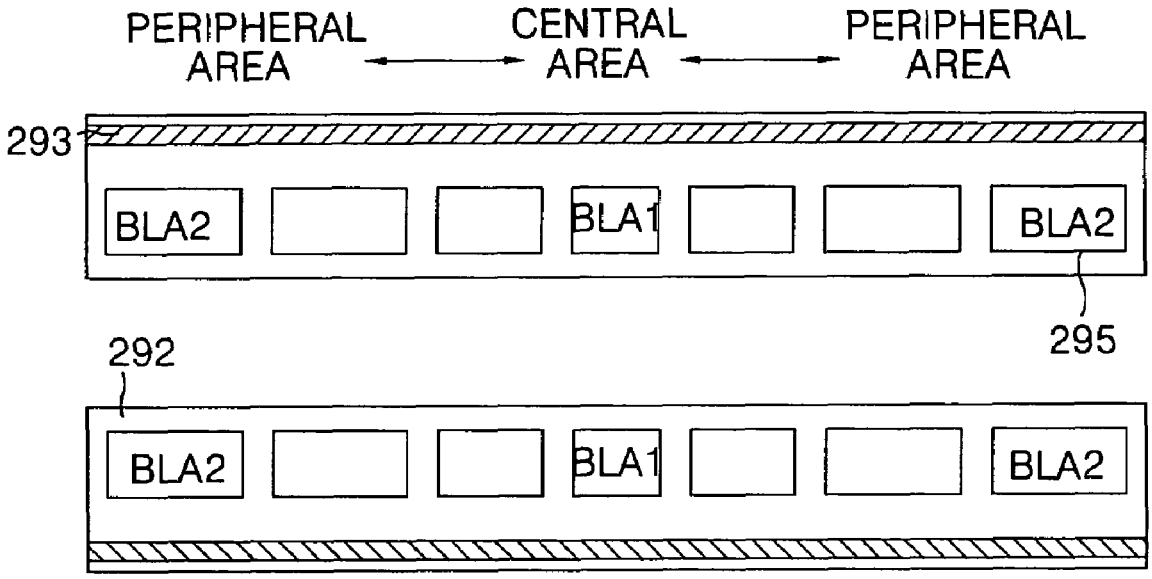
FIG. 29 illustrates a pair of sustaining electrodes of a PDP according to the twentieth embodiment of the present invention.

Referring to FIG. 29, a PDP according to the twentieth embodiment of the present invention includes a pair of transparent electrodes 292 where a plurality of blanks 295 are formed for increasing the efficiency and the brightness of the PDP, and a metal bus electrode 293 formed at each of the pair of the transparent electrodes 292.

The blanks 295 get the length of a horizontal side to be shorter as it goes from a peripheral area to a central area so that the areas BLA1 and BLA2 get smaller as it goes to the central area. Because the brightness of the central area of the PDP may heighten as compared with the peripheral area due to this, it is possible to compensate a brightness difference between the central area and the peripheral area of the PDP. The area BLA2 of the blanks 295 located in the peripheral area is larger by 5~40% as compared with the area BLA1 of the blanks 295 located in the central area.

Figure 30:
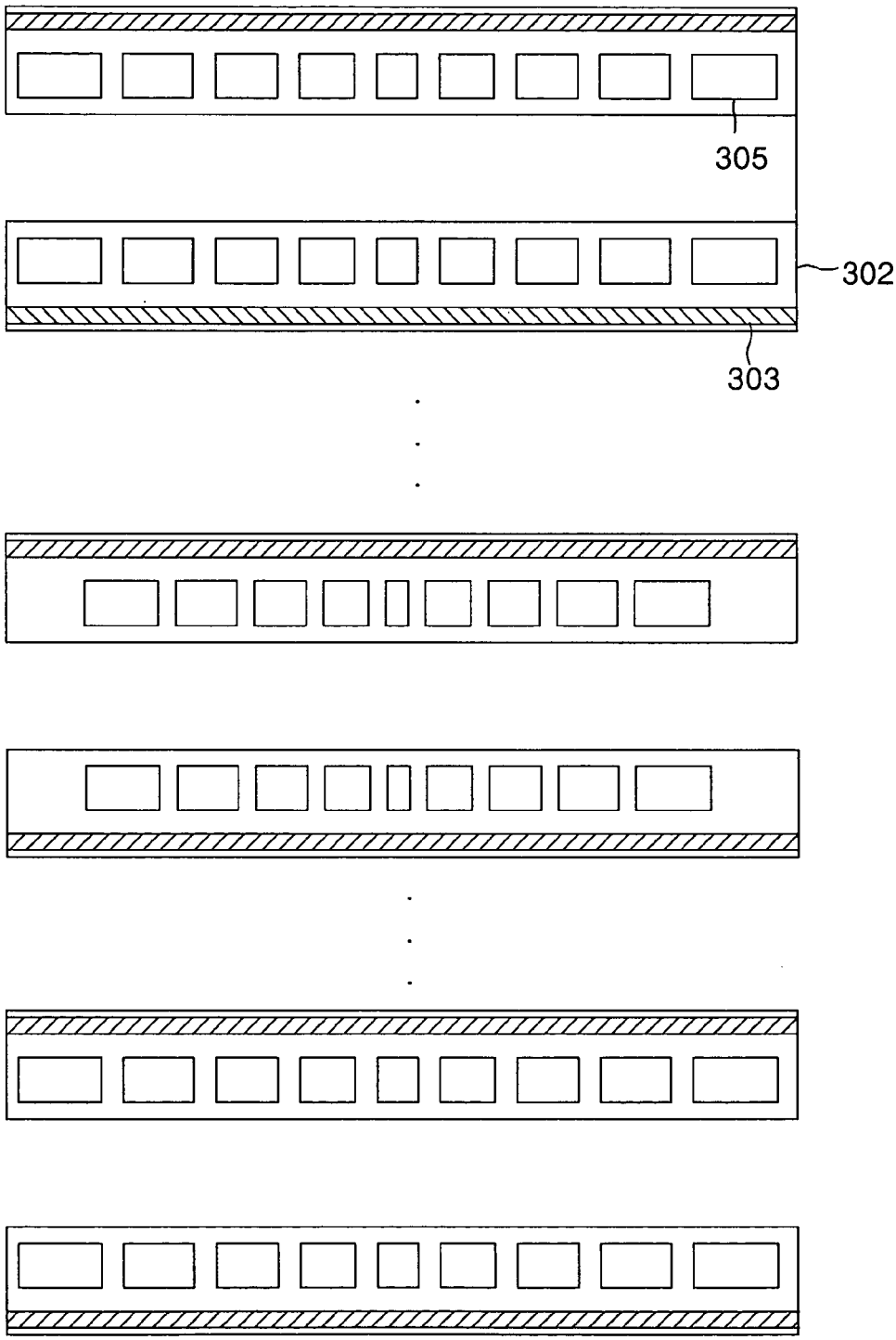
FIG. 30 illustrates pairs of sustaining electrodes of a PDP according to the twenty first embodiment of the present invention.

Referring to FIG. 30, a PDP according to the twenty first embodiment of the present invention gets the area of a blank 305 to be smaller as it goes from a peripheral area to a central area in horizontal and vertical directions each so as to compensate a brightness difference between the central area and the peripheral area in the horizontal direction and vertical directions of the PDP.

Figure 31:
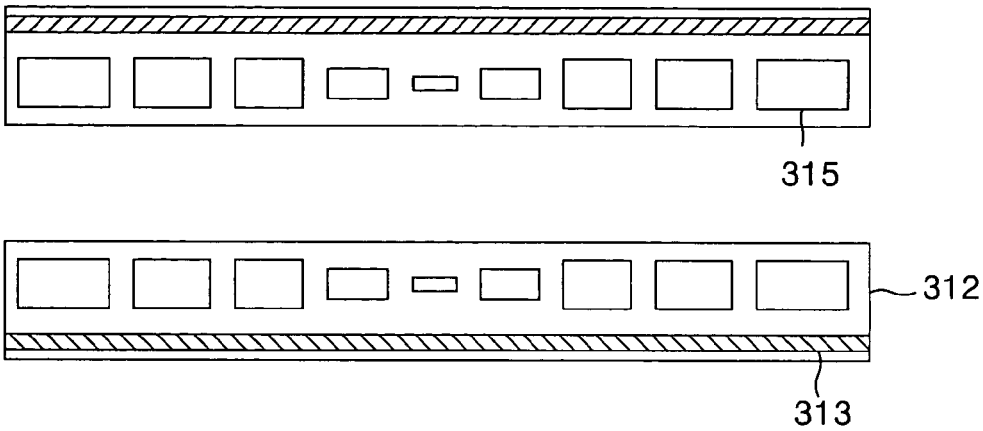
FIG. 31 illustrates a pair of sustaining electrodes of a PDP according to the twenty second embodiment of the present invention.

Referring to FIG. 31, a blank 315 of a PDP according to the twenty second embodiment of the present invention gets its areas BLA1 and BLA2 to be smaller as it goes to a central area since the lengths of a horizontal side and a vertical side shorten as it goes from a peripheral area to the central area. The blank 315, though now shown, is applied in both of the horizontal and vertical directions so as to compensate a brightness difference between the central area and the peripheral area in the horizontal direction and vertical directions of the PDP.

Figure 32:
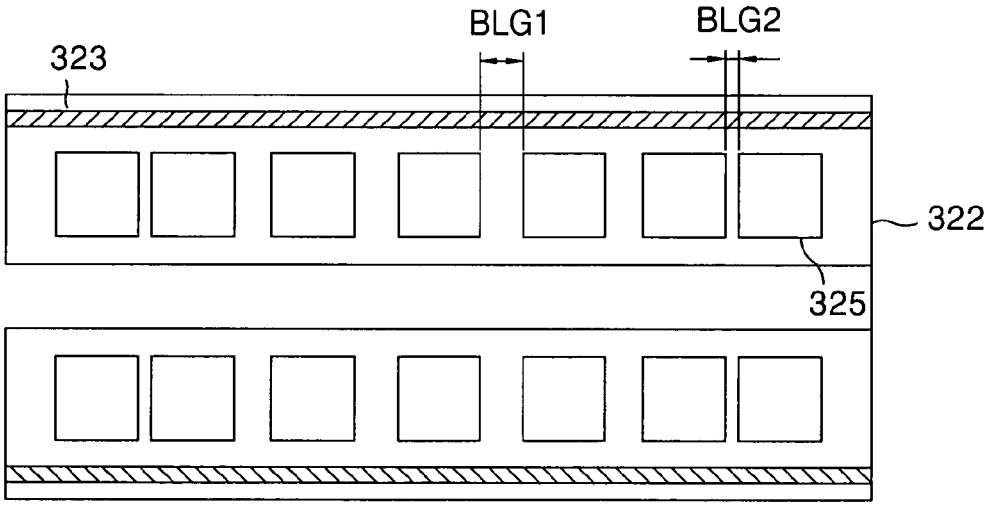
FIG. 32 illustrates a pair of sustaining electrodes of a PDP according to the twenty third embodiment of the present invention.
Figure 33:
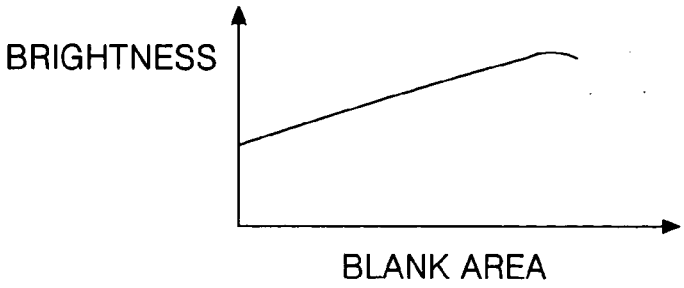
FIG. 33 is a graph representing a brightness change in accordance with a gap between blanks in a PDP.

Referring to FIG. 32, gaps BLG1 and BLG2 between blanks 325 in a peripheral area of a PDP according to the twenty third embodiment of the present invention are made different from those in a central area.

The gaps BLG1 and BLG2 between the blanks 325 get bigger as it goes from a peripheral area to a central area, while the areas of the blanks 325 are the same.

In the relation of the brightness and the gaps BLG1 and BLG2 between the blanks 325, the brightness of the PDP heightens as the gap between the blanks 325 gets wider. Accordingly, because the gap between the blanks 325 gets bigger as it goes to the central area, it is possible to compensate a brightness difference between the central area and the peripheral area of the PDP. The gap BLG1 between the blanks 325 located in the central area is wider by 140% or less as compared with the gap BLG2 of the peripheral area.

Figure 34:
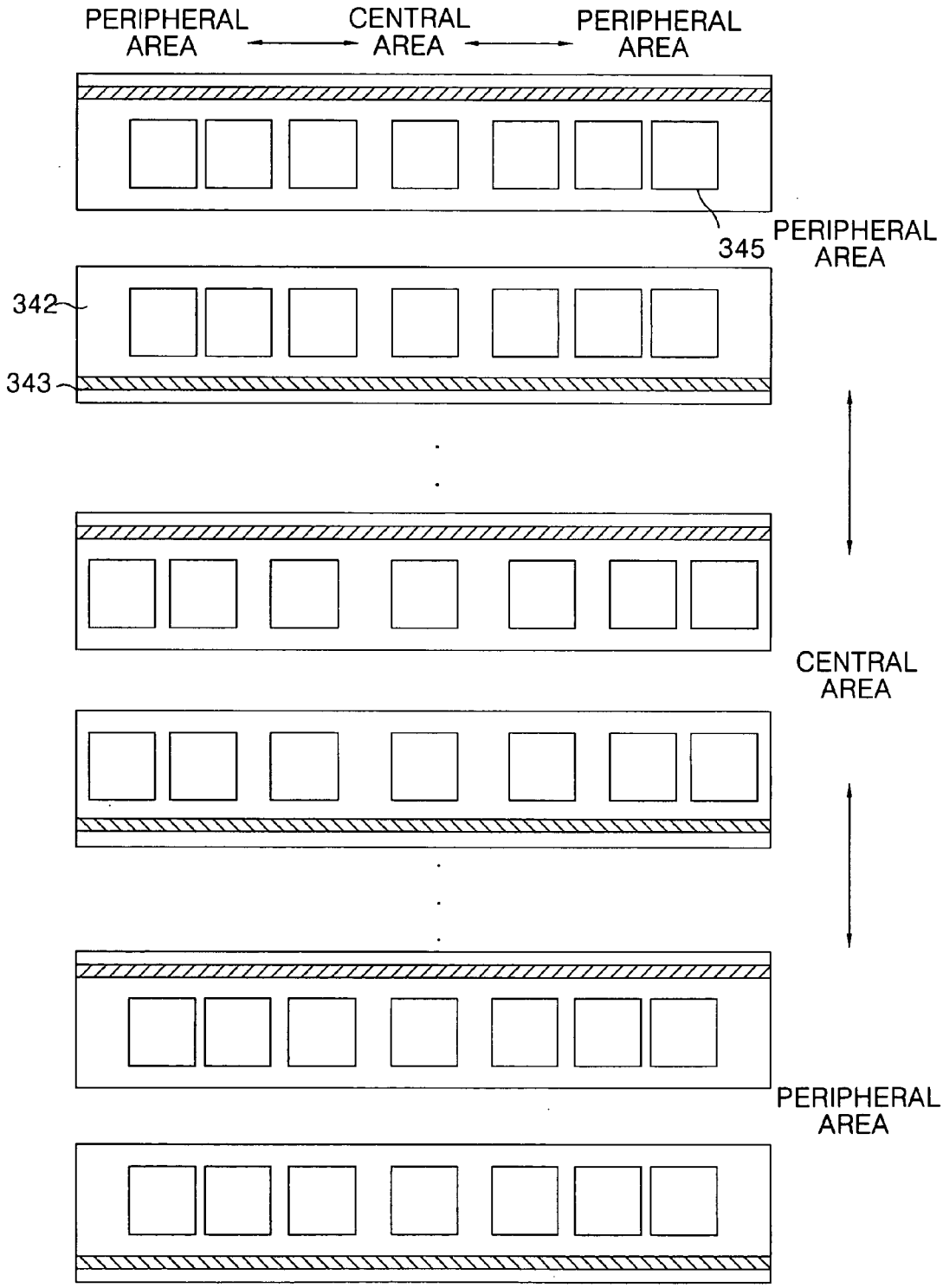
FIG. 34 illustrates pairs of sustaining electrodes of a PDP according to the twenty fourth embodiment of the present invention.

Referring to FIG. 34, a PDP according to the twenty fourth embodiment of the present invention, while having the areas of the blanks 335 identical, gets the gap between the blanks 335 to be wider as it goes from a peripheral area to a central area in horizontal and vertical direction each so as to compensate a brightness difference of the central area and the peripheral area in the horizontal and vertical directions of the PDP.

Figure 35:
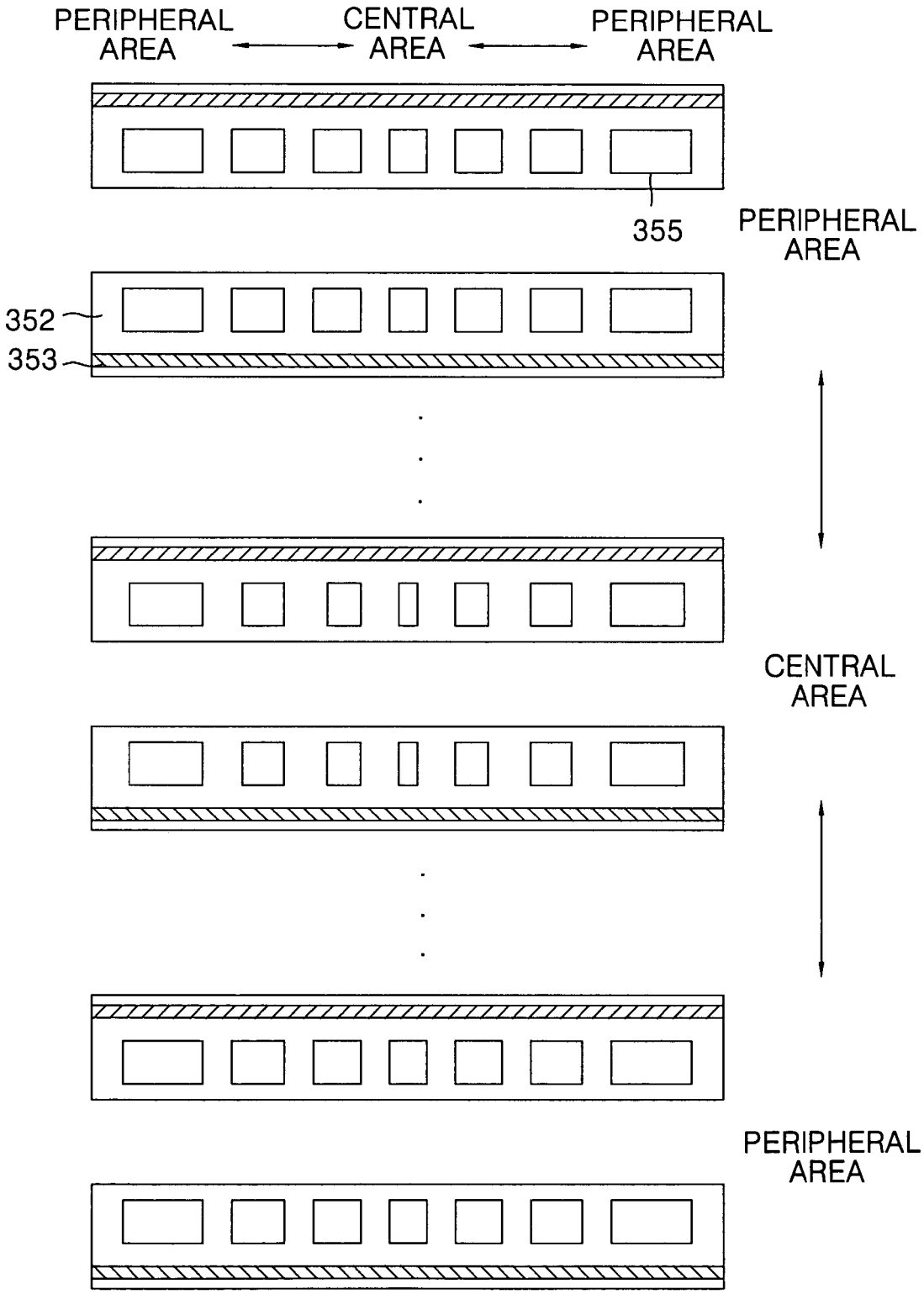
FIG. 35 illustrates pairs of sustaining electrodes of a PDP according to the twenty fifth embodiment of the present invention.
Figure 36:
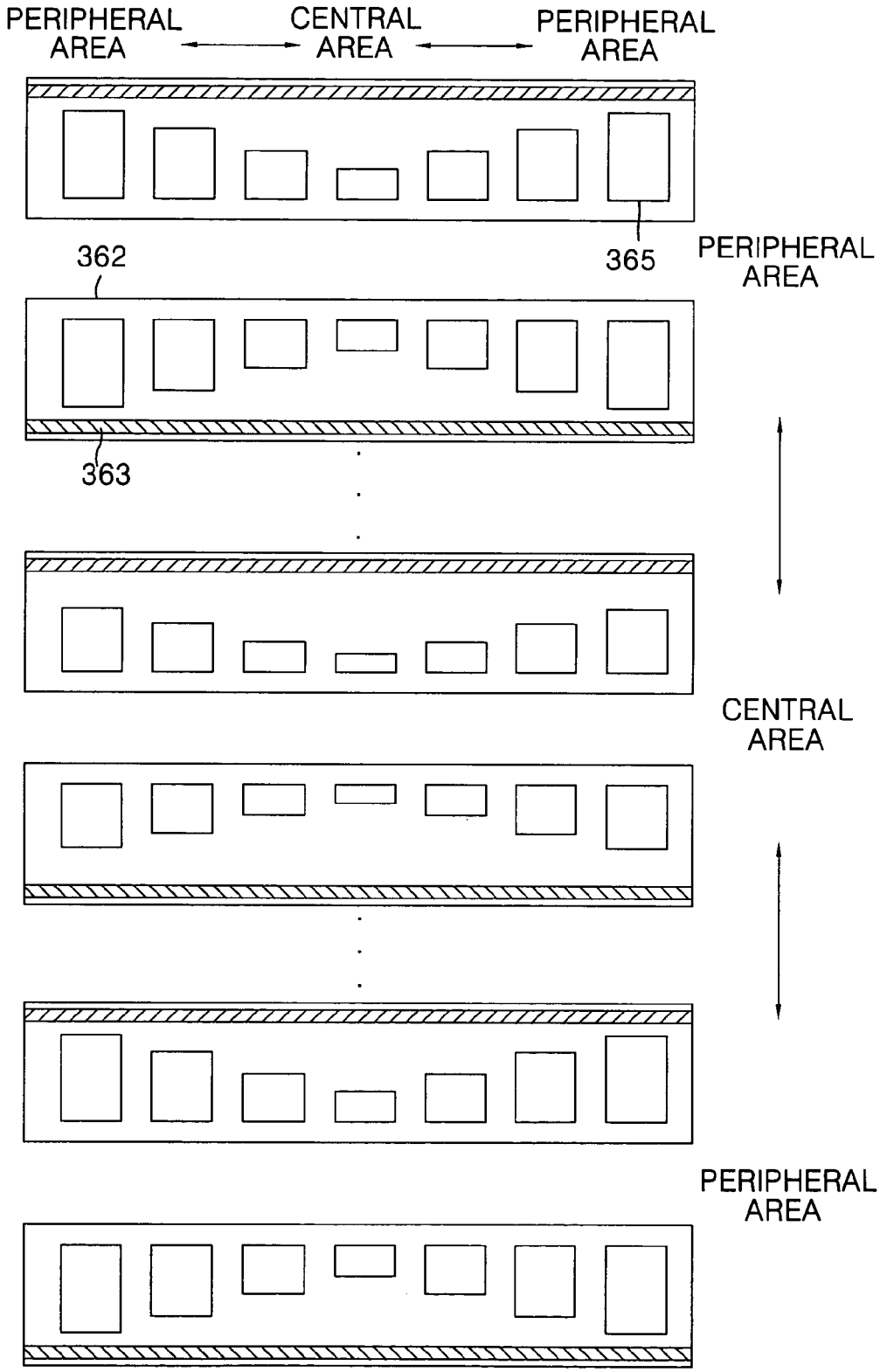
FIG. 36 illustrates pairs of sustaining electrodes of a PDP according to the twenty sixth embodiment of the present invention.

FIGS. 35 and 36 represents PDP's according to the twenty fifth and twenty sixth embodiments of the present invention.

Referring to FIGS. 35 and 36, the areas of a blank 355 and 365 get smaller and the gap between the blanks 355 and 365 get wider, as it goes from a peripheral area to a central area in horizontal and vertical directions each.

In this way, the metal bus electrode that has the width and gap in the central area different from those in the peripheral area may be formed on the transparent electrode of the PDP having the width and gap of the pair of the transparent electrodes in the peripheral area different from those in the central area or the area and gap of the blank different.

Figure 37:
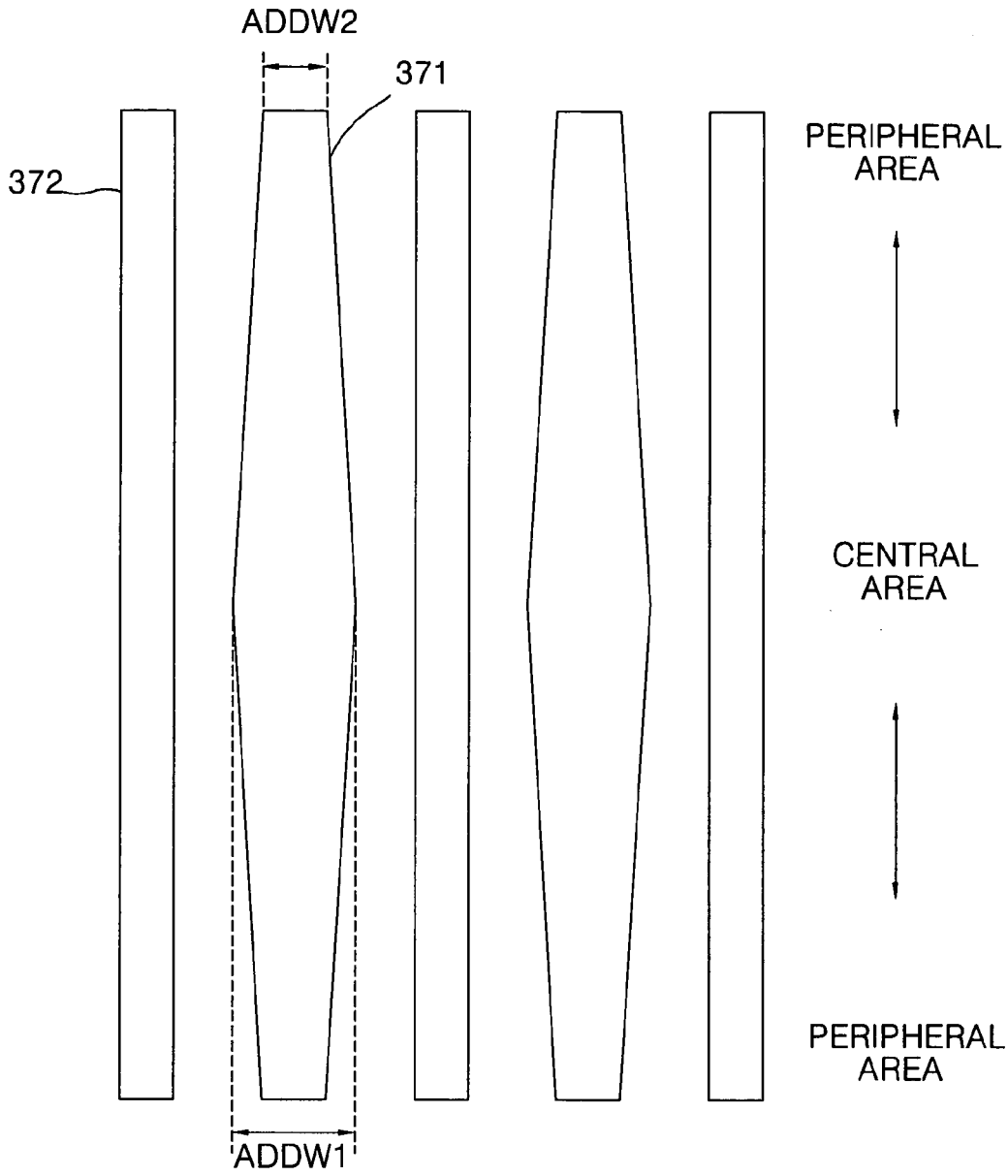
FIG. 37 illustrates address electrodes of a PDP according to the twenty seventh embodiment of the present invention.

FIG. 37 shows an address electrode of a PDP according to the twenty seventh of the present invention.

Referring to FIG. 37, a PDP according to the twenty seventh embodiment of the present invention includes an address electrode 371 having its width in a peripheral area different from that in a central area.

The address electrode 371 has the widths ADDW1 and ADDW2 increased as it goes from a peripheral area to a central area in a vertical direction.

Figure 38:
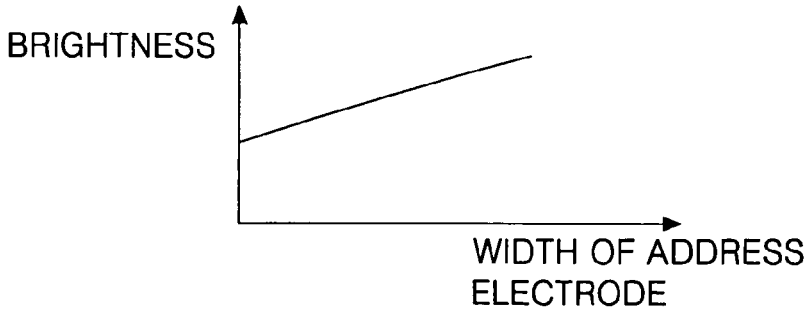
FIG. 38 is a graph representing a brightness change in accordance with a width of an address electrode in a PDP.

In the relation between the brightness and the widths ADDW1 and ADDW2 of the address electrode 371, the brightness of the PDP heightens as the widths ADDW1 and ADDW2 of the address electrode 371 as in FIG. 38. Accordingly, because the widths ADDW1 and ADDW2 of the address electrode 371 is wider in the central area than in the peripheral area, it is possible to compensate a brightness difference between the central area and the peripheral area of the PDP. The central area width ADDW1 of the address electrode 371 is wider by about 20% or less as compared with the peripheral area width ADDW2.

Figure 39:
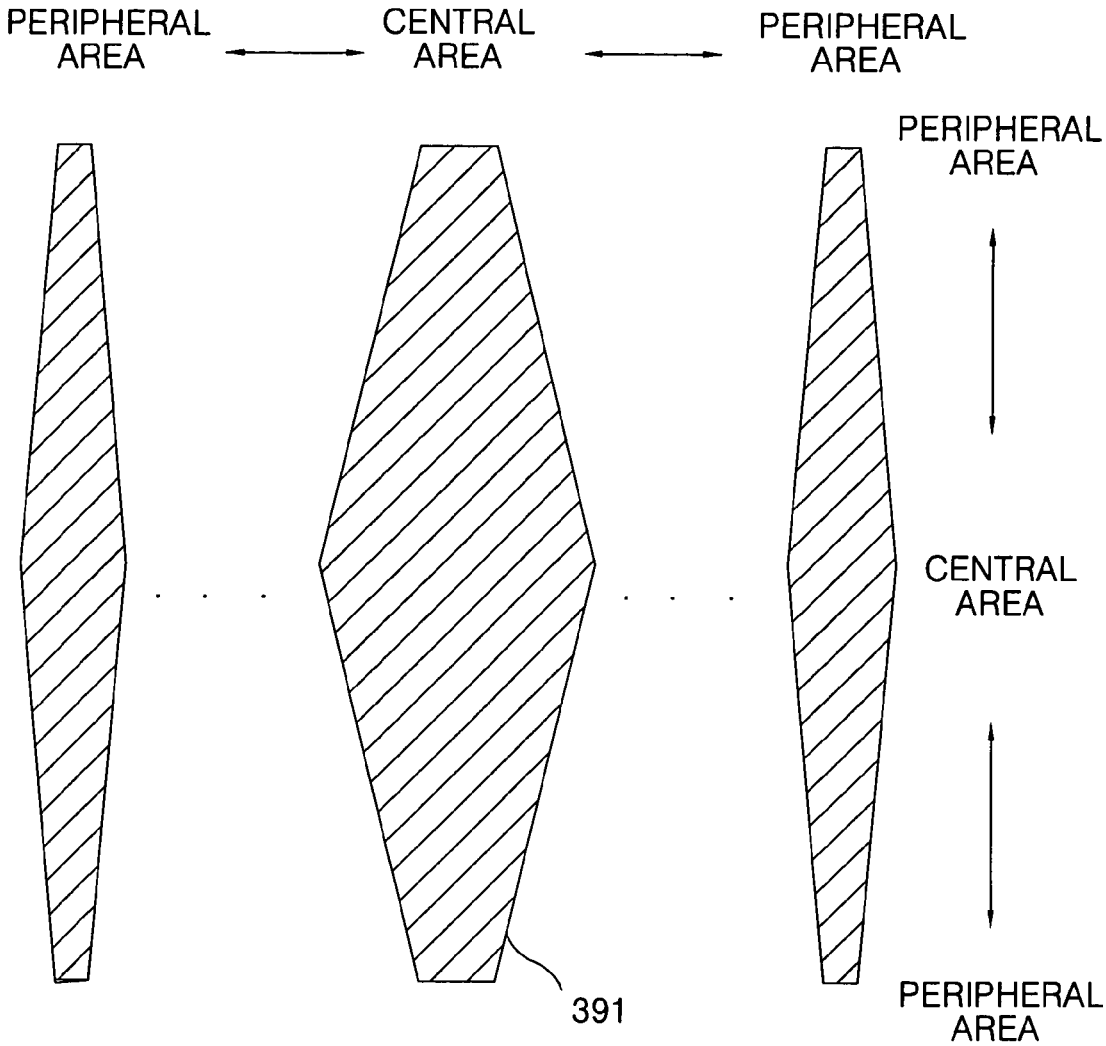
FIG. 39 illustrates address electrodes of a PDP according to the twenty eighth embodiment of the present invention.

FIG. 39 represents an address electrode of a PDP according to the twenty eighth embodiment of the present invention.

Referring to FIG. 39, the PDP according to the twenty eighth embodiment of the present invention gets the width of the address electrode 391 to be wider as it goes from a peripheral area to a central area in horizontal and vertical direction each so as to compensate a brightness difference between the central area and the peripheral area in the horizontal and vertical directions of the PDP.

In this way, it may be possible to combine a transparent electrode having the width and gap of the transparent electrode itself or the area and gap of blanks different and a metal bus electrode having its width or gap in the central area different from that in the peripheral area, with the PDP having the width of the address electrode in the peripheral area different from that in the central area.

Figure 40:
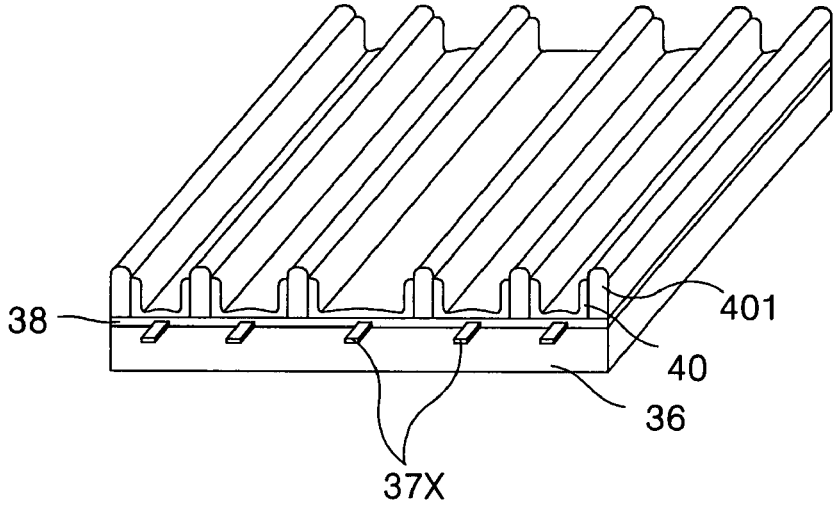
FIG. 40 illustrates a perspective view of a lower plate of a PDP according to the twenty ninth embodiment of the present invention.
Figure 43:
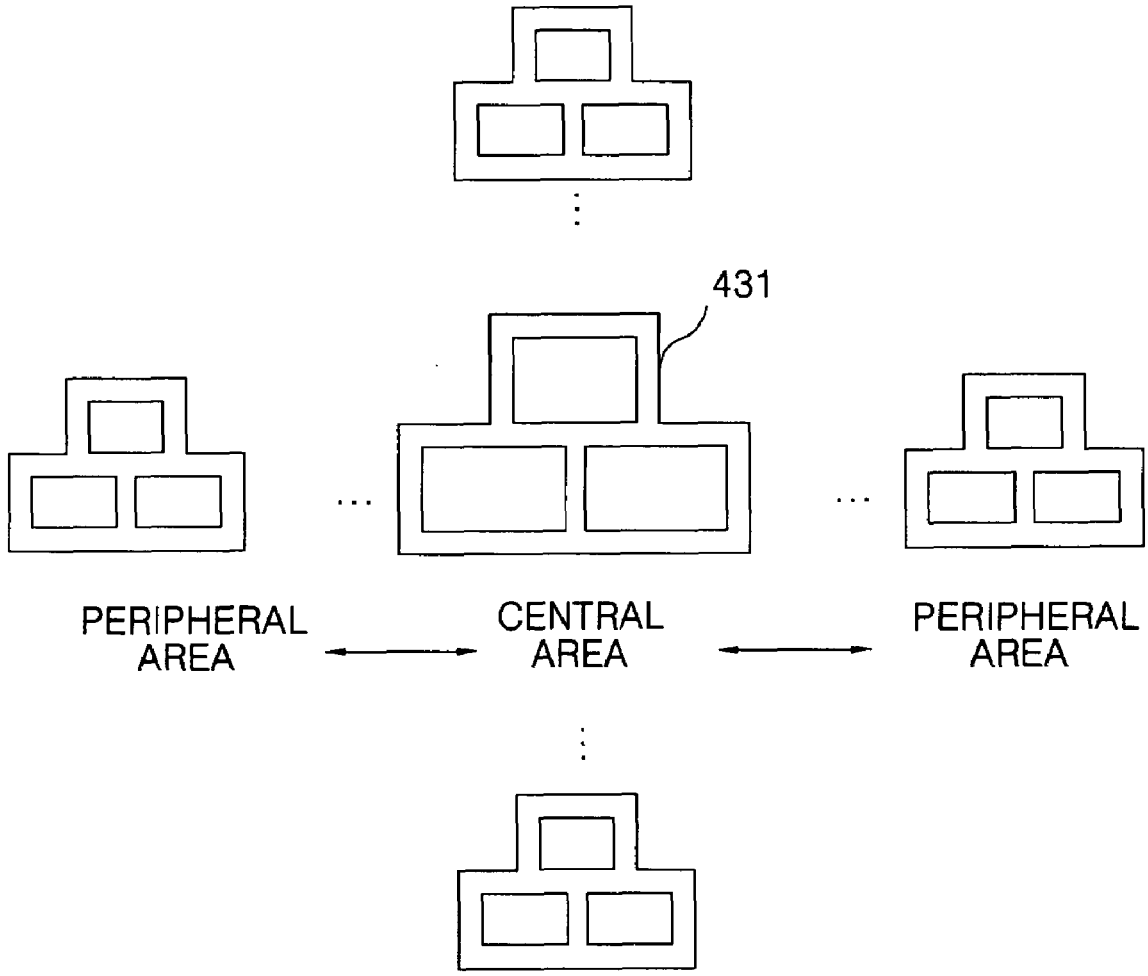
FIG. 43 illustrates a barrier rib of a PDP according to the thirty first embodiment of the present invention.

FIGS. 40 and 43 shows a lower plate of a PDP and barrier ribs formed on the lower plate according to the twenty ninth and thirty first embodiments of the present invention.

Figure 41:
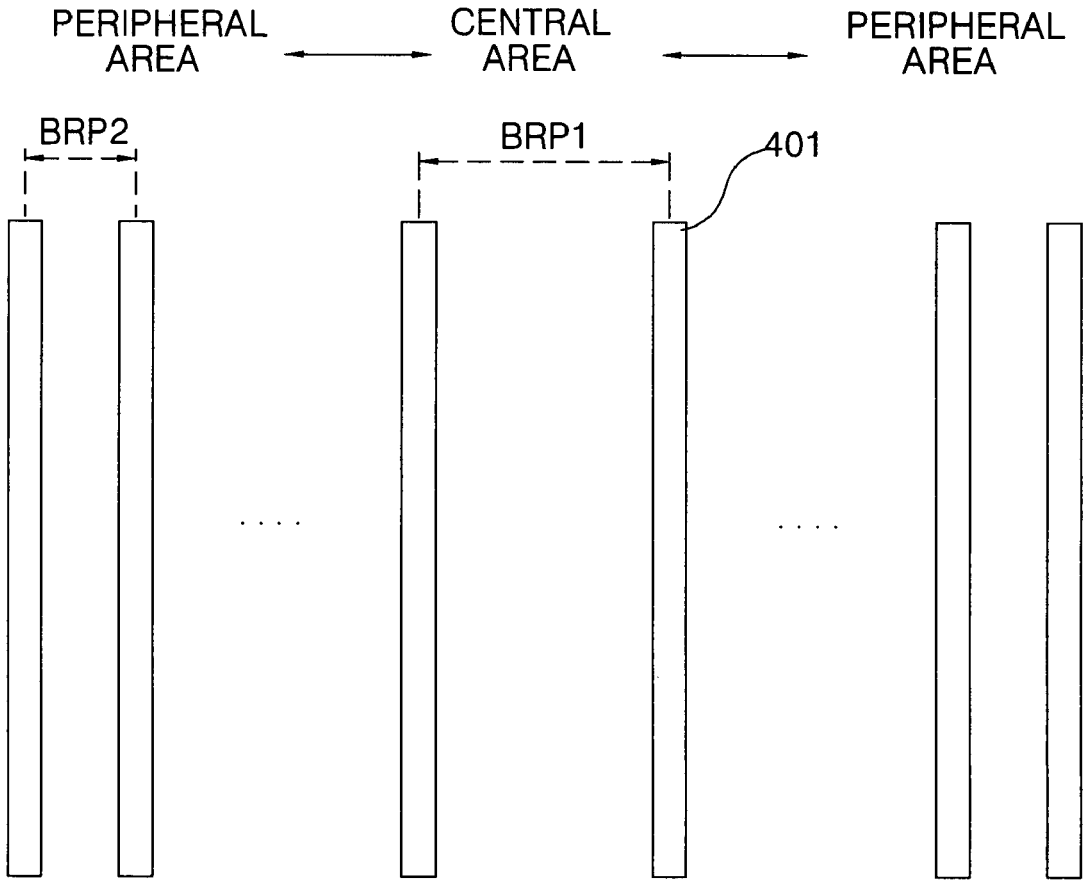
FIG. 41 illustrates gap differences between barrier ribs shown in FIG. 40.

Referring to FIGS. 40 and 41, a PDP according to the twenty ninth embodiment of the present invention has gaps between barrier ribs 401 and pitches BRP1 and BRP2 of the barrier ribs 401 narrowed as it goes from the central area to the peripheral area.

These barrier ribs 401 are formed parallel to an address electrode 37X in a stripe shape with a certain height to prevent electrical and optical interference between adjacent discharge cells. Further, the barrier ribs 401 set a difference of a discharge space of the discharge cells in the peripheral area and the central area so as to compensate a brightness difference between the peripheral area and the central area.

To describe more particularly, the wider the gap between the barrier ribs is, the bigger the discharge space is. If the discharge space is big, the spread area of a fluorescent substance increases, the discharge is generated in a large scale within the discharge cell and the amount of ultraviolet ray increases as much. On the contrary, because the discharge space decreases if the gap between the barrier ribs 401 is narrow, the spread area of the fluorescent substance 40 decreases, the discharge is generated in a small scale within the discharge cell and the amount of ultraviolet ray decreases as much. Accordingly, the brightness of each discharge cell heightens in the central area where the gap between the barrier ribs 401 is relatively wider than in the peripheral area. As a result, because the gaps in the peripheral area are set to be different from the gaps in the central area of the PDP, it is possible to compensate a brightness difference between the central area and the peripheral area of the PDP.

In consideration of a panel size and the brightness of the peripheral area, it is desirable to set a gap difference between the barrier ribs 401 in the peripheral area and those in the central area of the PDP at about 20% or less. It may be applied to the PDP, where quadrangle or wall type barrier ribs 421 and 431 as in FIGS. 42 and 43 are arranged in a matrix or delta shape, as well as the barrier ribs 401 of a stripe shape that the gap between the barrier ribs 401 in the central area is made different from that in the peripheral area of the PDP.

Figure 42:
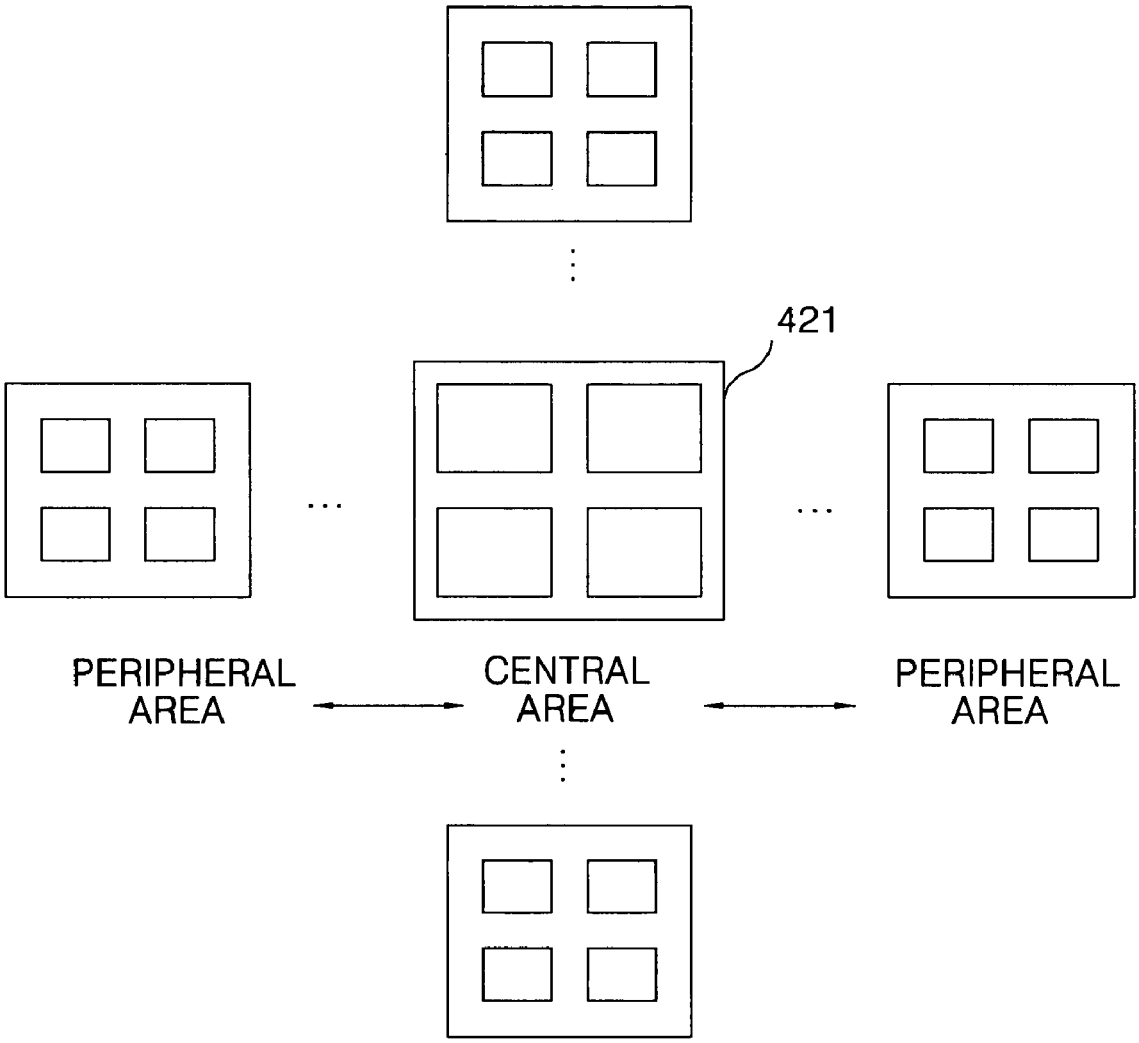
FIG. 42 illustrates a barrier rib of a PDP according to the thirtieth embodiment of the present invention.

Also, in this case, the gaps between the barrier ribs 421 and 431 of a quadrangle or wall type as in FIGS. 42 and 43 are set to be more wider in the central area than in the peripheral area of the PDP.

Figure 44:
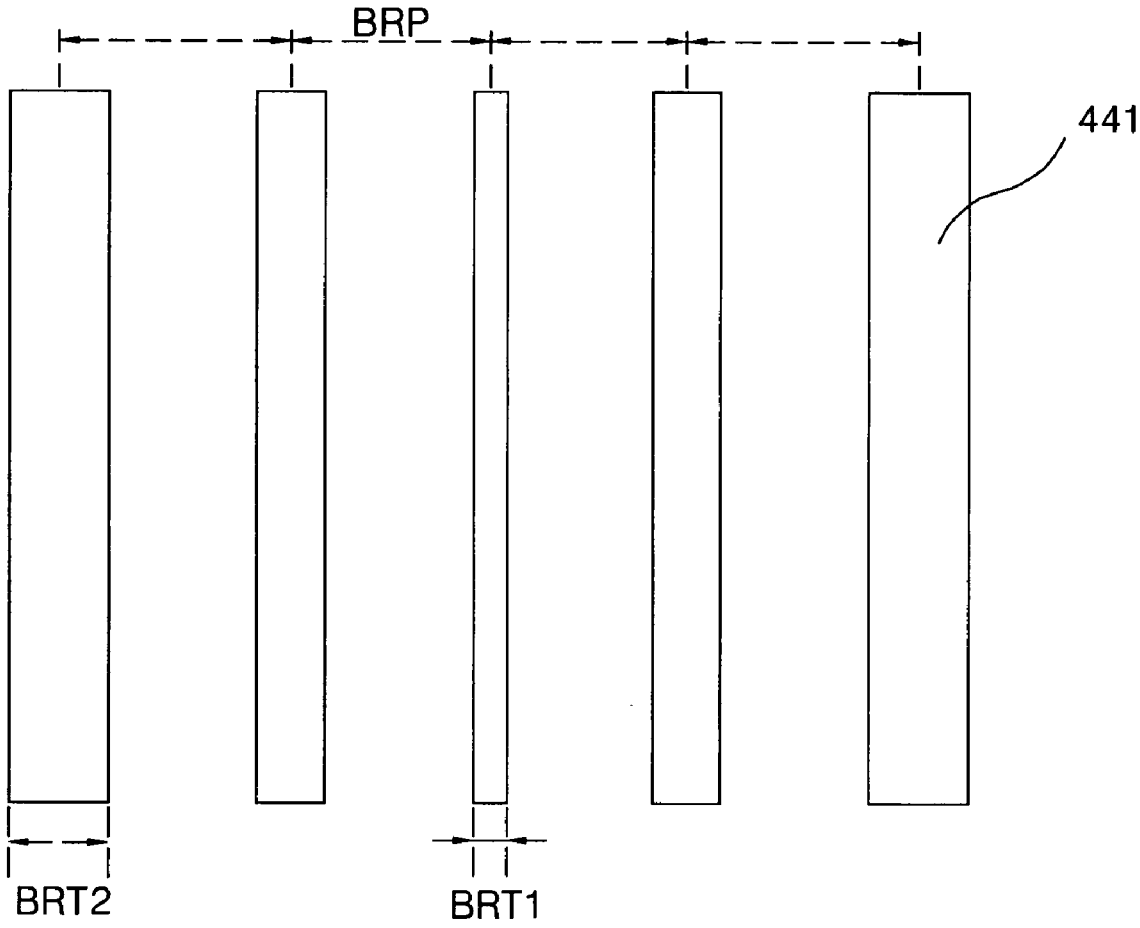
FIG. 44 illustrates a barrier rib of a PDP according to the thirty second embodiment of the present invention.

FIG. 44 trough 46 represent barrier ribs of a PDP according to the thirty second to the thirty fourth embodiments of the present invention.

Referring to FIG. 44, in the PDP according to the thirty second embodiment of the present invention, gaps BRP between barrier ribs 441 are uniform in the entire surface of the PDP, while thickness BRT1 and BRT2 thereof gets thicker as it goes from a central area to a peripheral area of the PDP. The thicker the barrier ribs are, the lower the brightness of discharge cells is. Whereas, the thinner the barrier ribs are, the higher the brightness of the discharge cells is.

These barrier ribs 441 are formed parallel to an address electrode in a stripe shape with a certain height on a lower substrate to prevent electrical and optical interference between adjacent discharge cells. Further, the barrier ribs 441 have their thickness in a central area set to be different from that in a peripheral area to compensate a brightness difference between the central area and the peripheral area of the PDP.

Figure 45:
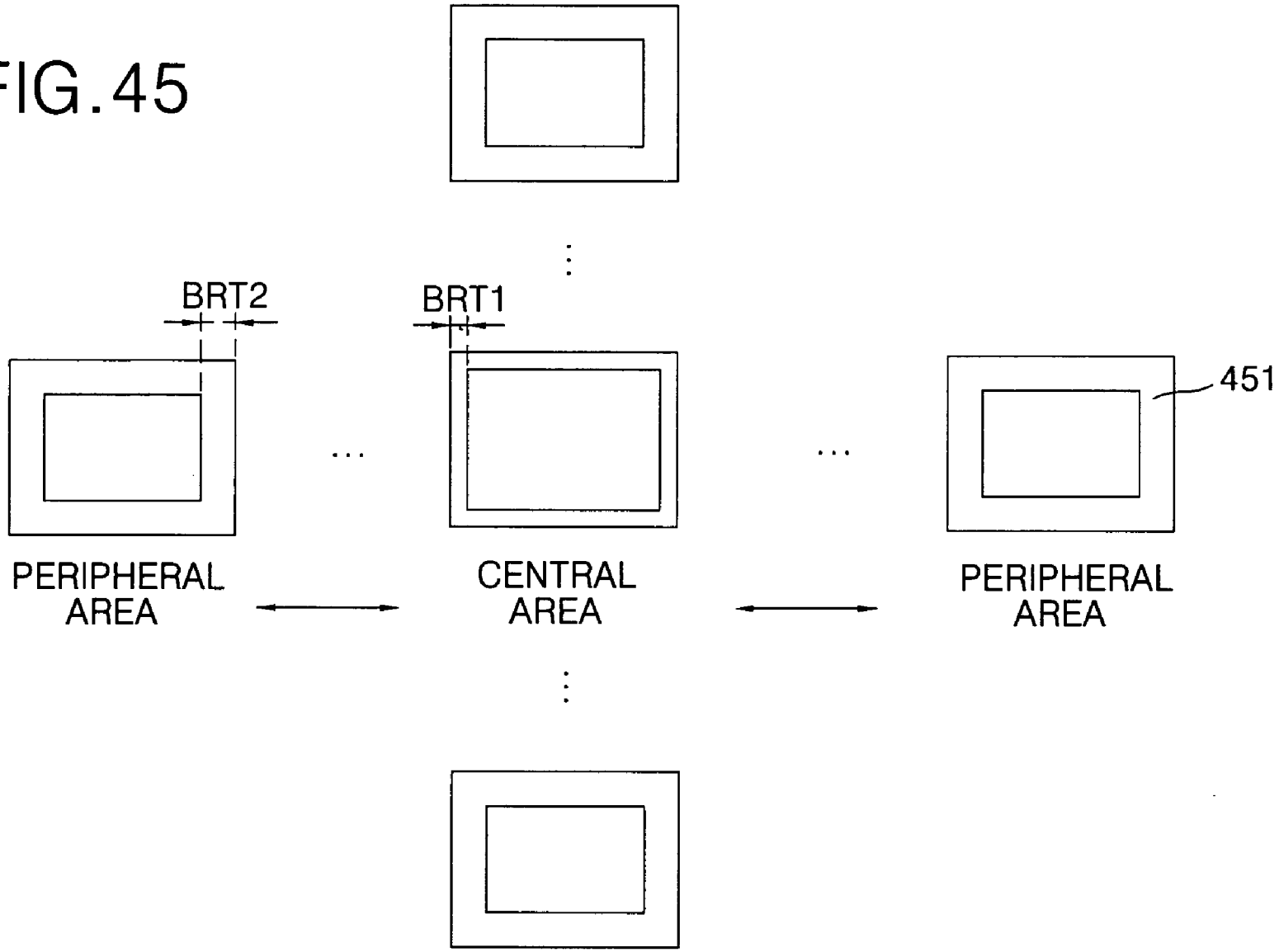
FIG. 45 illustrates a barrier rib of a PDP according to the thirty third embodiment of the present invention.
Figure 46:
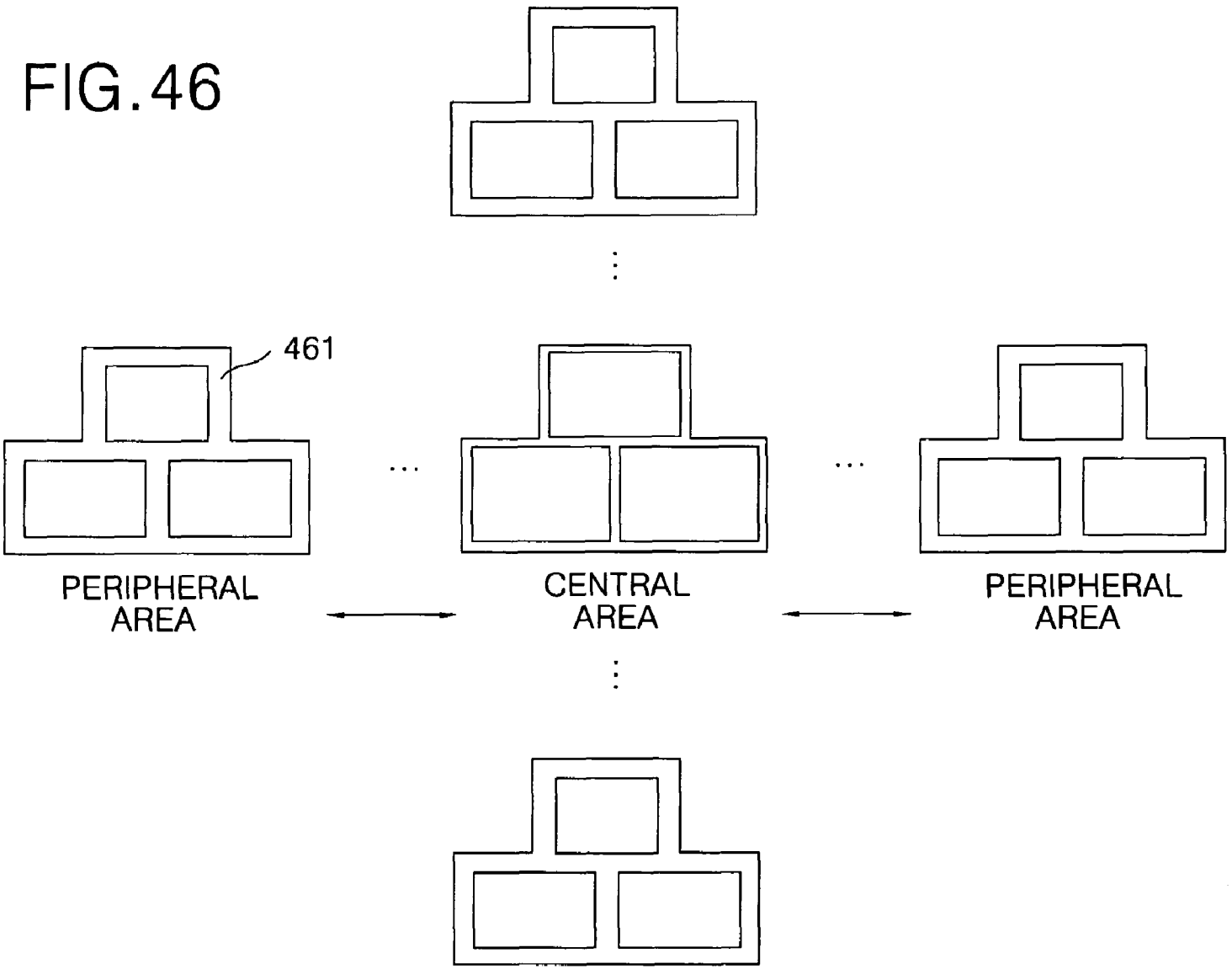
FIG. 46 illustrates a barrier rib of a PDP according to the thirty fourth embodiment of the present invention.

In consideration of a panel size and the brightness of the peripheral area, it is desirable to set the thickness difference BRT1 and BRT2 of the barrier ribs 441 between the central area and the peripheral area of the PDP at about 20% or less. It may be applied to the PDP, where quadrangle or wall type barrier ribs 451 and 461 as in FIGS. 45 and 46 are arranged in a matrix or delta shape, as well as the barrier ribs 441 of a stripe shape that the thickness of the barrier ribs 441 is made to be thin in the central area and thicker as it goes to the peripheral area. Also, in this case, the thickness BRT1 and BRT2 of the barrier ribs 451 and 461 of a quadrangle or wall type as in FIGS. 45 and 46 is thinner in the central area than in the peripheral area of the PDP.

Figure 47:
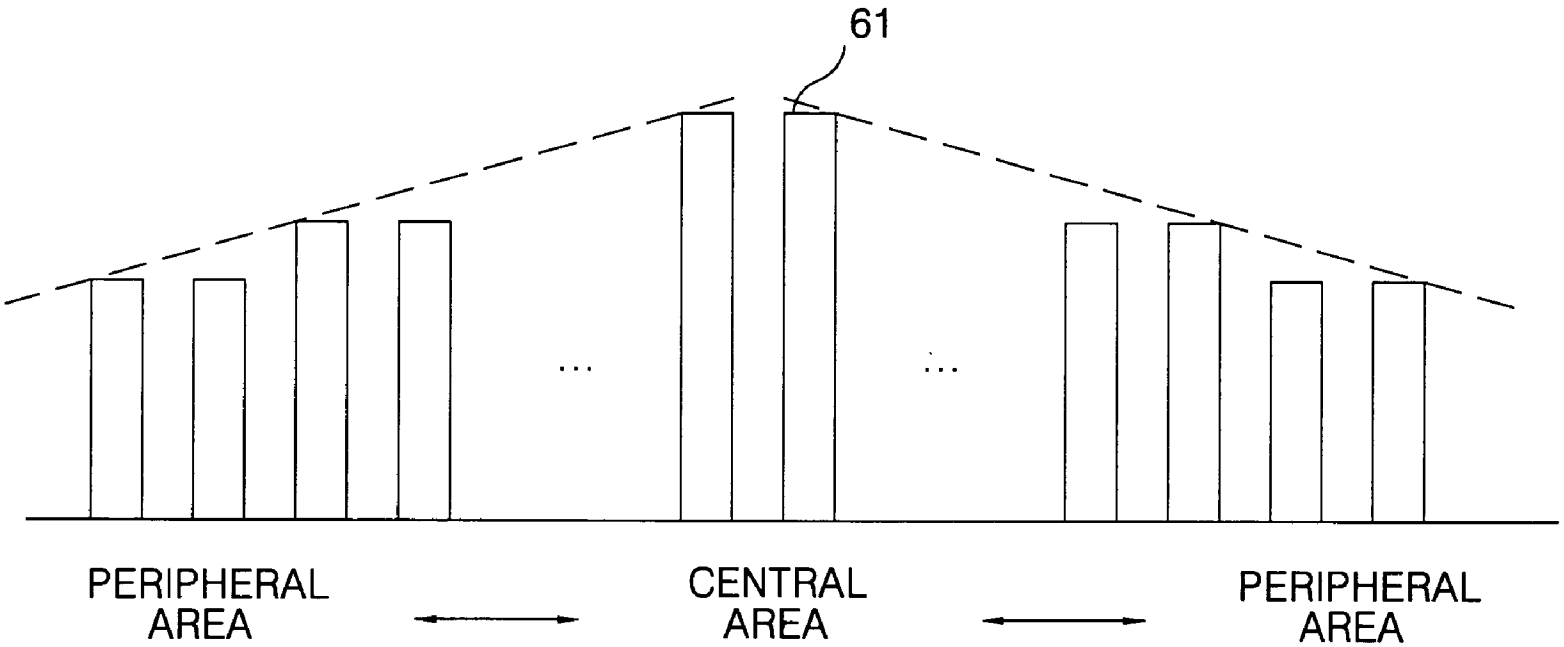
FIG. 47 illustrates a barrier rib of a PDP according to the thirty fifth embodiment of the present invention.

FIG. 47 shows a PDP according to the thirty fifth embodiment of the present invention.

Referring to FIG. 47, in the PDP according to the thirty fifth embodiment of the present invention, the barrier ribs 471 have the thickness and the gap therebetween uniform. Whereas, their heights BRH1 and BRH2 gets higher as it goes from a peripheral area to a central area of the PDP.

These barrier ribs 471 are formed parallel to an address electrode in a stripe shape with a certain height to prevent electrical and optical interference between adjacent discharge cells. Further, the barrier ribs 471 have their thickness in the central area set to be different from that in the peripheral area so as to compensate a brightness difference between the central area and the peripheral area.

Figure 48:
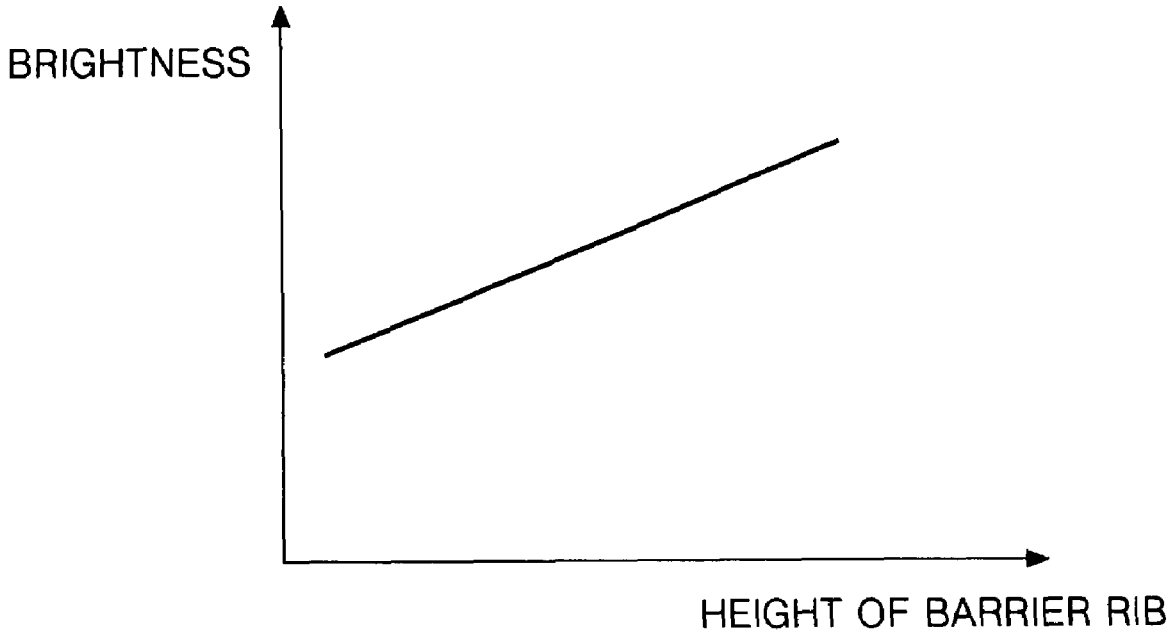
FIG. 48 is a graph representing a brightness change in accordance with a barrier rib height.

To describe more particularly, the higher the barrier ribs 471 are, the bigger the discharge space is. Because of this, the spread area of a fluorescent substance increases, the discharge is generated in a large scale within the discharge cell and the amount of ultraviolet ray increases as much. Accordingly, the brightness of each discharge cell heightens in the central area where the heights BRH1 and BRH2 of the barrier ribs 471 is relatively higher than in the peripheral area of the PDP as in FIG. 48. As a result, because the heights of the barrier ribs 471 in the peripheral area are set to be different from those in the central area of the PDP, it is possible to compensate a brightness difference between the central area and the peripheral area of the PDP.

In consideration of a panel size and the brightness of the peripheral area, it is desirable to set a height difference of the barrier ribs 471 in the peripheral area and those in the central area of the PDP at about 20% or less. It may be applied to the PDP, where the barrier ribs of a stripe shape or quadrangle or wall type barrier ribs are arranged in a matrix or delta shape, that the heights BRH1 and BRH2 of the barrier ribs 471 is made to be low in the central area and to get higher as it goes to the peripheral area of the PDP.

The thirty second and the thirty fifth embodiments of the present invention may be combined together. That is, a difference may be set in the thickness of barrier ribs, the gap between barrier ribs and the height of barrier ribs in a peripheral area and a central area of the same PDP so as to compensate a brightness difference. Such barrier ribs are combined with driving electrodes, such as a transparent electrode, a metal bus electrode and an address electrode, of a PDP described in the foregoing embodiments so as to be able to compensate the brightness difference between a peripheral area and a central area of the PDP, FIGS. 49 to 56 shows a black matrix of a PDP according to the thirty sixth through thirty ninth embodiments of the present invention.

Figure 49:
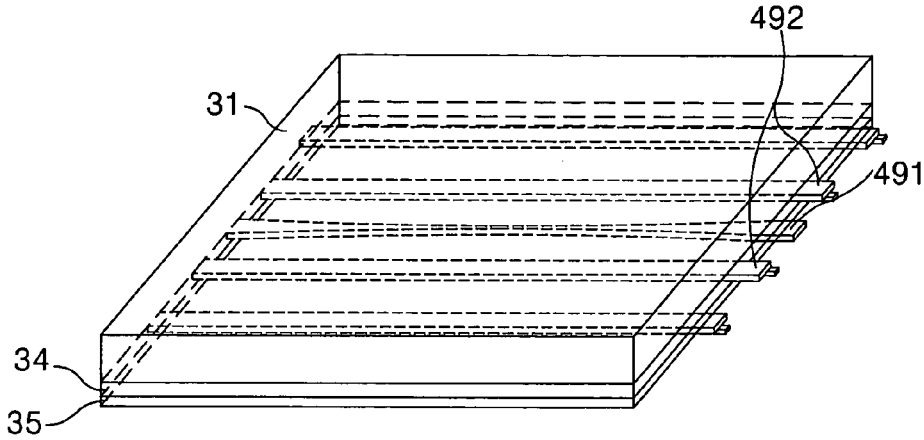
FIG. 49 illustrates a perspective view of an upper plate of a PDP according to the thirty sixth embodiment of the present invention.
Figure 50:
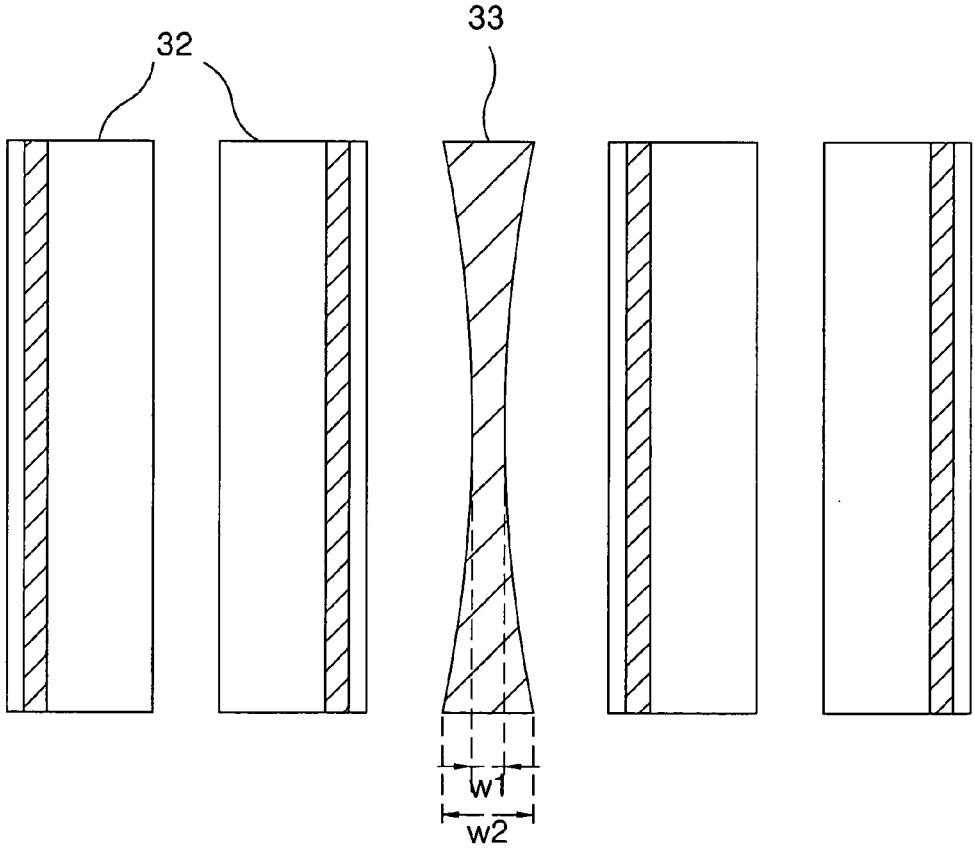
FIG. 50 illustrates a black matrix in detail shown in FIG. 49.
Figure 51:
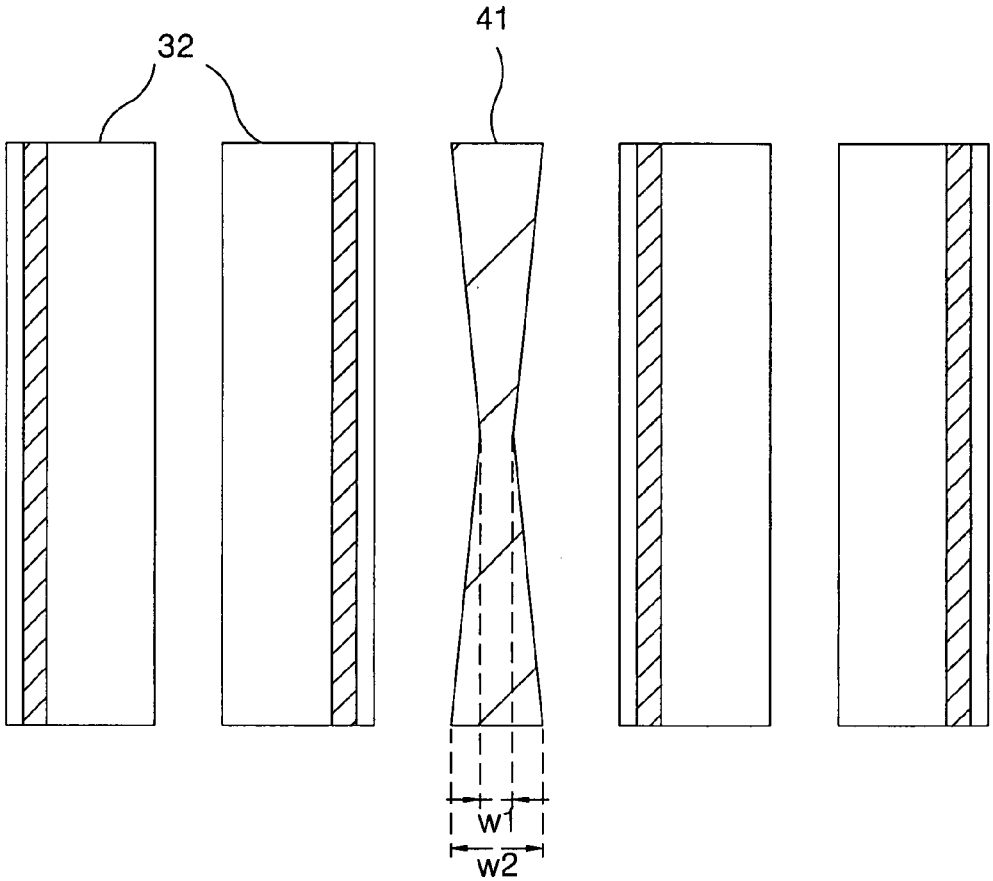
FIG. 51 illustrates another embodiment of the black matrix shown in FIG. 49.
Figure 52:
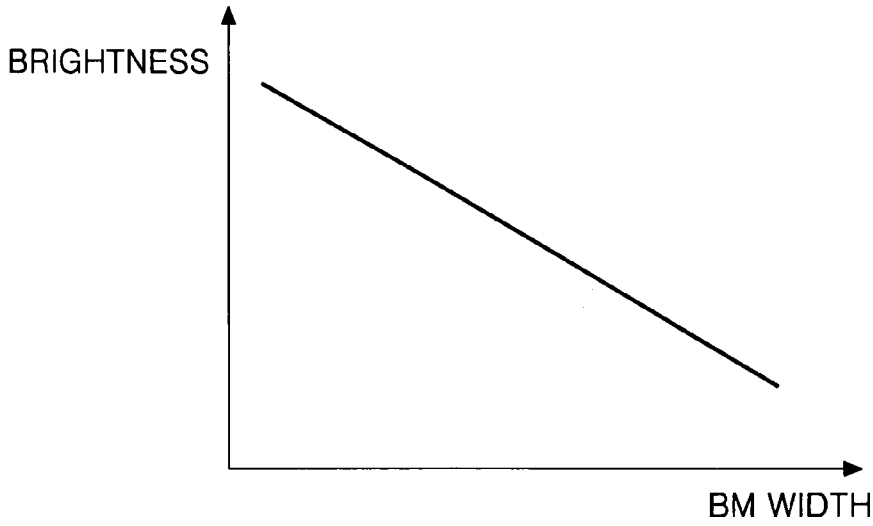
FIG. 52 is a graph showing relation between a width and a brightness of a black matrix.

Referring to FIG. 49, the PDP according to the thirty sixth embodiment of the present invention includes a black matrix 491 having its width in a central area different from that in a peripheral area of the PDP. The black matrix 491 is formed on the boundary area between adjacent discharge cells to prevent optical interference between the adjacent discharge cells. Further, the black matrix 491 has its width set to be narrower in a central area than in a peripheral area of the PDP so as to compensate a brightness difference between the peripheral area and the central area of the PDP. Both sides of the black matrix 491 may be made in a curve shape as in FIG. 50 or in a linear shape as in FIG. 51.

In FIG. 49, a reference numeral '492' represents a pair of sustaining electrodes including a transparent electrode and a metal bus electrode.

If the width of the black matrix 491 is wide, a light-absorbing area gets larger as much. On the contrary, if the width of the black matrix 491 is narrow, the light-absorbing area gets smaller as much. Accordingly, in the relation between the black matrix 491 and the brightness of the PDP, the brightness of the PDP heightens as the width of the black matrix 491 gets narrower as in FIG. 52, In consideration of a panel size and the brightness of a peripheral area, it may be desirable to have a difference between the widths W1 and W2 of the black matrix 491 within about 20% or less.

Figure 53:
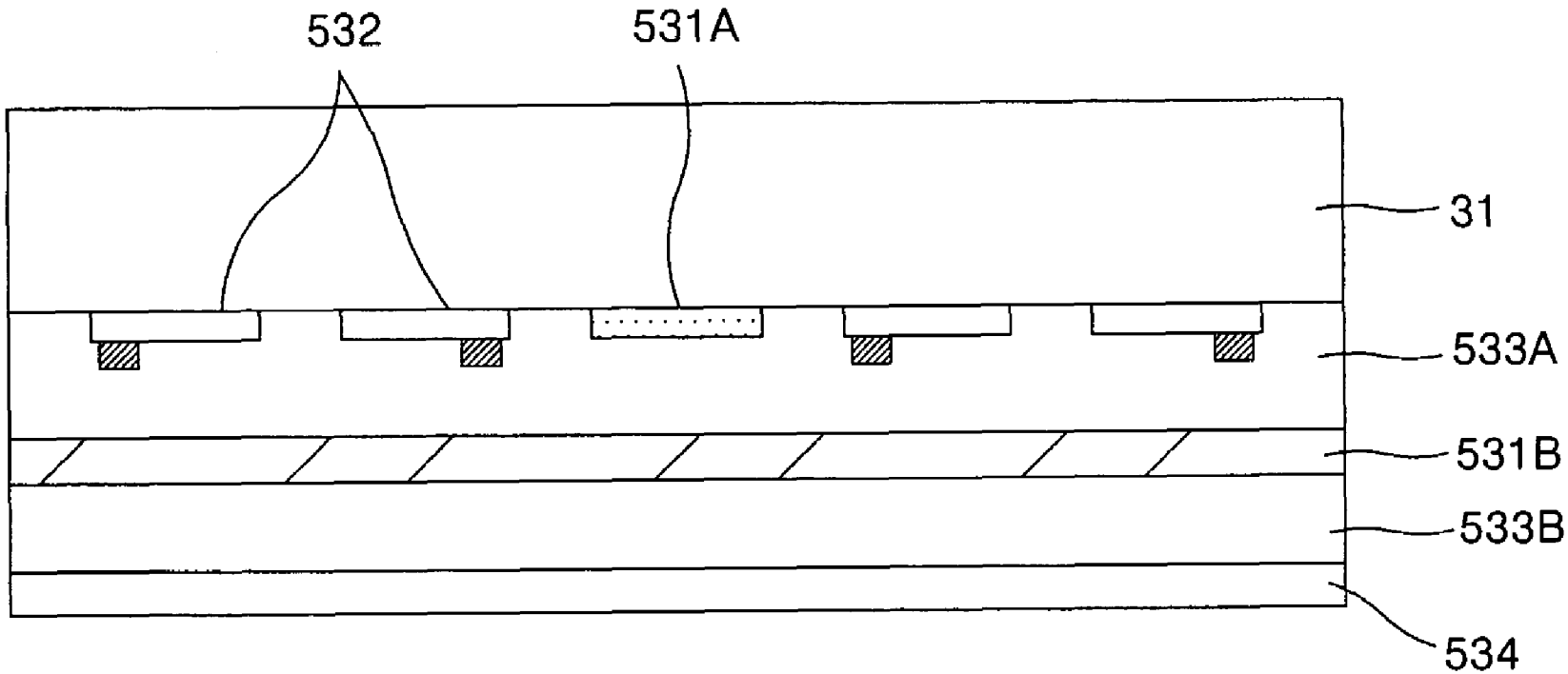
FIG. 53 is a sectional view representing an upper plate of a PDP according to the thirty seventh embodiment of the present invention.
Figure 54:
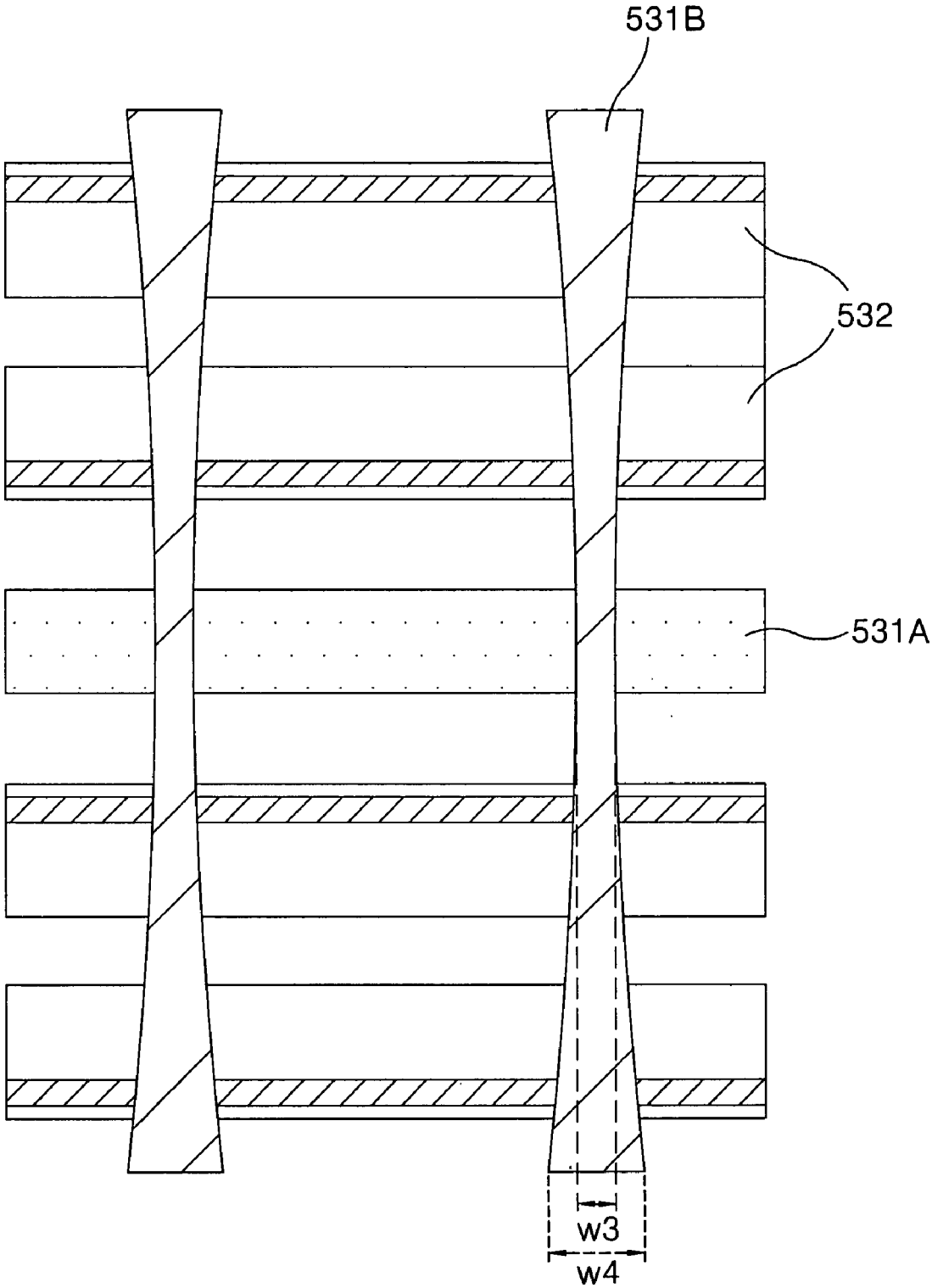
FIG. 54 illustrates an upper plate of the PDP shown in FIG. 53.

Referring to FIGS. 53 and 54, an upper plate of a PDP according to the thirty seventh embodiment of the present invention includes a pair of sustaining electrodes 532 formed on a lower substrate, a horizontal black matrix 531A formed parallel to the pairs of the sustaining electrodes 532 between adjacent discharge cells; and a vertical black matrix 531B perpendicularly intersecting the pairs of the sustaining electrodes 532 and having the width in a peripheral area different from that in a central area of the PDP. In the upper plate of the PDP, there is a first dielectric layer 533A formed on an upper substrate 31 to cover the pairs of the sustaining electrodes 532 and the horizontal black matrix 531A and there is a second dielectric layer 533B formed to cover the vertical black matrix 531B. There is a protective film 534 formed on the entire surface of the second dielectric layer 533B.

The vertical black matrix 531B is formed on the first dielectric layer 533A in a direction of intersecting the horizontal black matrix 531A. Each of the vertical black matrixes 531A has a width narrower in the central area in a vertical direction of the PDP than in the peripheral area. Because the brightness of the central area is relatively higher in a vertical direction by the vertical black matrix 531B than that of the peripheral area, it is possible to compensate a brightness difference between the central area and the peripheral area of the PDP.

In consideration of the PDP's size and the brightness of the peripheral area, it is desirable to form the vertical black matrix 531B that has the difference between the width W3 of the central area and the width W4 of the peripheral area within about 20% or less.

Figure 55:
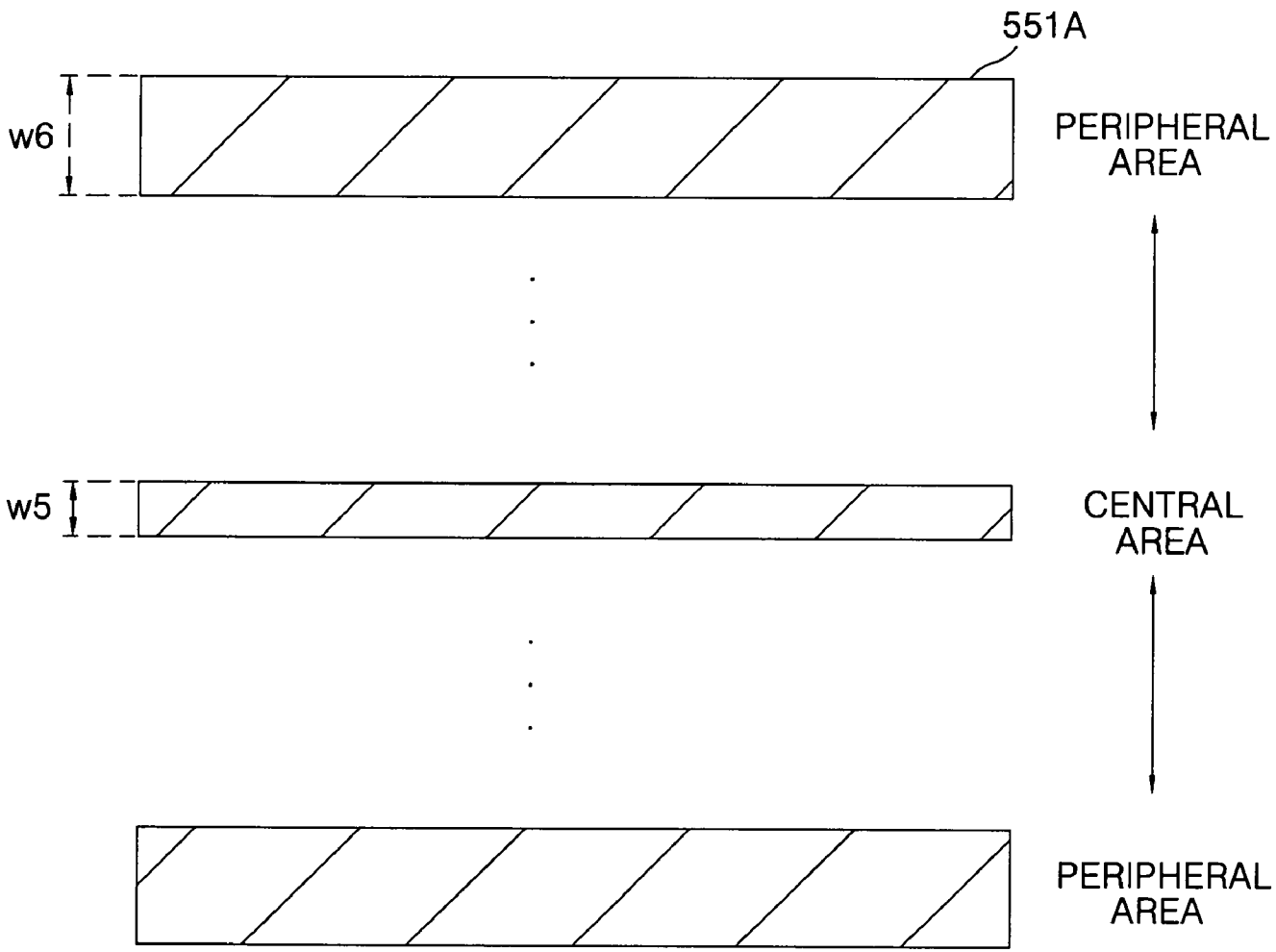
FIG. 55 illustrates a black matrix of a PDP according to the thirty eighth embodiment of the present invention.
Figure 56:
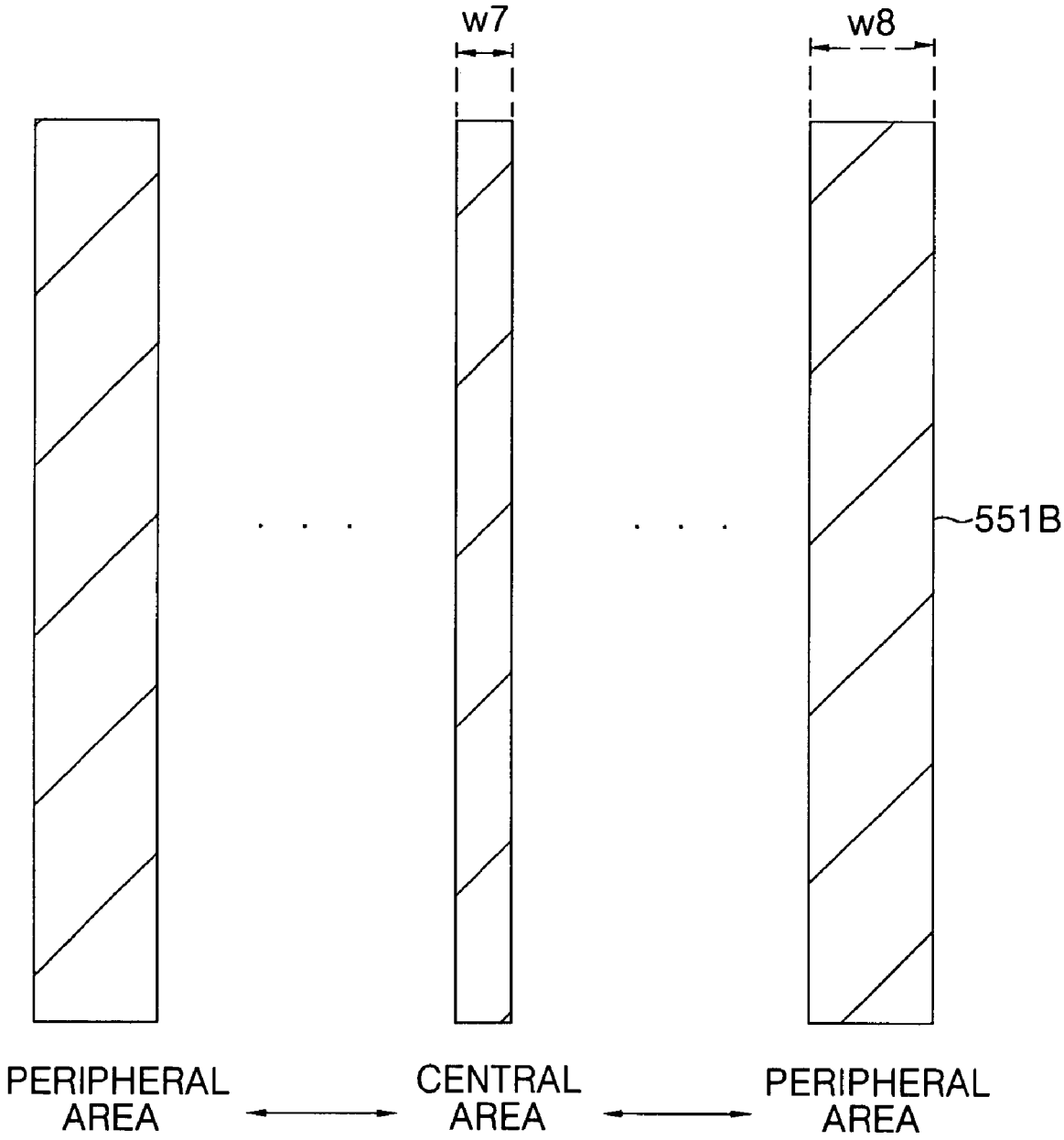
FIG. 56 illustrates a black matrix of a PDP according to the thirty ninth embodiment of the present invention.

Referring to FIGS. 55 and 56, a PDP according to the thirty eighth embodiment of the present invention includes a horizontal black matrix 551A having the width in a central area different from the width in a peripheral area in a vertical direction of the PDP, and a vertical black matrix 551B having the width in a central area different from the width in a peripheral area in a horizontal direction of the PDP.

Each of the horizontal black matrixes 551A has a stripe shape with the width uniform in a horizontal direction of the PDP. And the width W5 of the horizontal black matrix 551A located at the central area in a vertical direction is narrower than that W6 of other horizontal black matrix 551A located at the peripheral area. As it goes from the peripheral area to the central area in a vertical direction of the PDP, the brightness of the PDP horizontal black matrix heightens by the difference of the widths W5 and W6 of the horizontal black matrixes 551A.

Each of the vertical black matrixes 551B has a stripe shape with the width uniform inavertical direction. And, the width W7 of the vertical black matrix 551B located at the central area in the horizontal direction of the PDP is narrower than that W8 of other vertical black matrix 551B located at the peripheral area. As it goes from the peripheral area to the central area in a horizontal direction of the PDP, the brightness heightens by the difference of the widths W7 and W8 of the vertical black matrixes 551B.

In consideration of the PDP's size and the brightness of the peripheral area, it is desirable to form the horizontal black matrix 551A and the vertical black matrix 551B respectively having the width difference between the central area and the peripheral area within about 20% or less.

Accordingly, the black matrixes 551A and 551B shown in FIGS. 55 and 56 compensate a brightness difference between the peripheral area and the central area in the vertical and horizontal directions of PDP, respectively.

The black matrix described in the thirty sixth to the thirty ninth embodiments of the present invention may also compensate the brightness difference between the central area and the peripheral area of the PDP by being combined with the barrier ribs or the driving electrodes, such as the transparent electrode, the metal bus electrode and the address electrode, that were described in the foregoing embodiments.

FIGS. 57 to 61 show a PDP according to the fortieth through forty third embodiments of the present invention.

Figure 57:
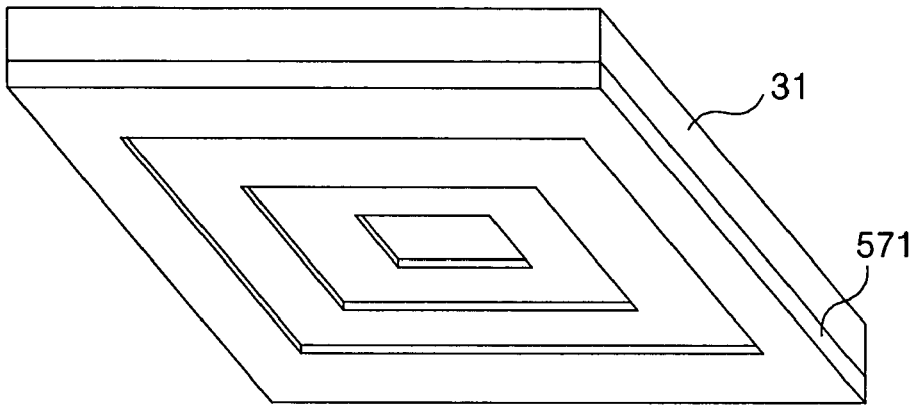
FIG. 57 illustrates a perspective view of a dielectric layer of a PDP according to the fortieth embodiment of the present invention.

Referring to FIG. 57, in a PDP according to the fortieth embodiment of the present invention, the thickness of a dielectric layer 571 formed on an upper substrate 31 gets thinner as it goes from a peripheral area to a central area of the PDP. A MgO protective film (not shown) is deposited or printed on the entire surface of the dielectric layer 571 to cover it.

The dielectric layer 571 has the thinnest thickness in a central area of the PDP and gets its thickness to be thicker step by step as it goes to a peripheral area of the PDP. Accordingly, the dielectric layer 571 has a step shape section. The dielectric layer 571 with a thickness difference between the central area and the peripheral area of the PDP accumulates wall charges and compensates the deterioration of the brightness in the central area of the PDP. To describe more particularly, as in FIG. 58, there is a relation between the brightness and the thickness of the dielectric layer formed on the upper plate of the PDP.

Figure 58:
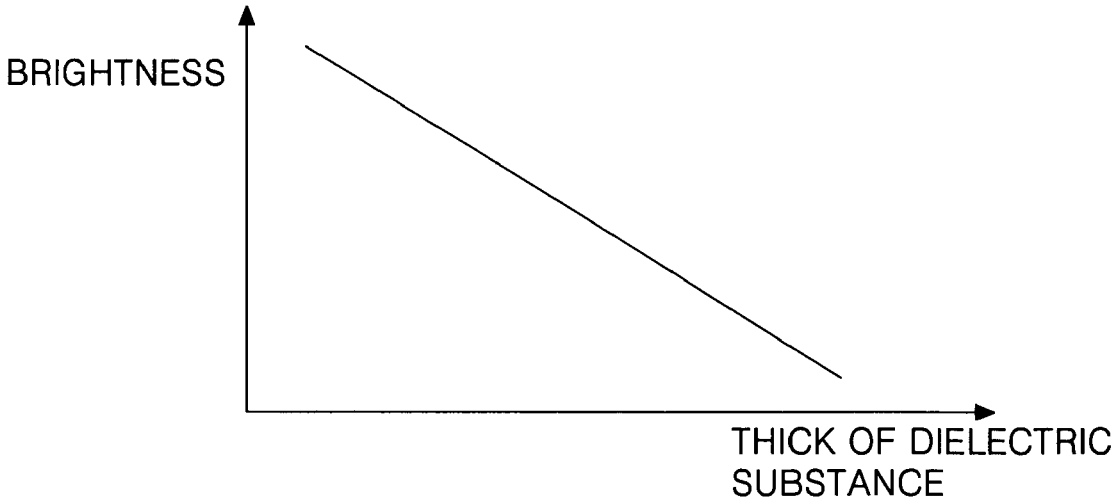
FIG. 58 is a graph representing relation between a thickness and a brightness of a dielectric layer.

As illustrated in FIG. 58, the thicker the thickness of the dielectric layer is, the lower the brightness is. Whereas, the thinner the thickness of the dielectric layer, the higher the brightness is. Accordingly, because the dielectric layer 571 is thin in the central area and relatively thick in the peripheral area of the PDP, it is possible to compensate a brightness difference of the central area and the peripheral area of the PDP. In consideration of a panel size and the brightness of the peripheral area of the PDP, it may be desirable to set a thickness difference of the dielectric layer 571 between the central area and the peripheral area at about 20% or less.

Figure 59:
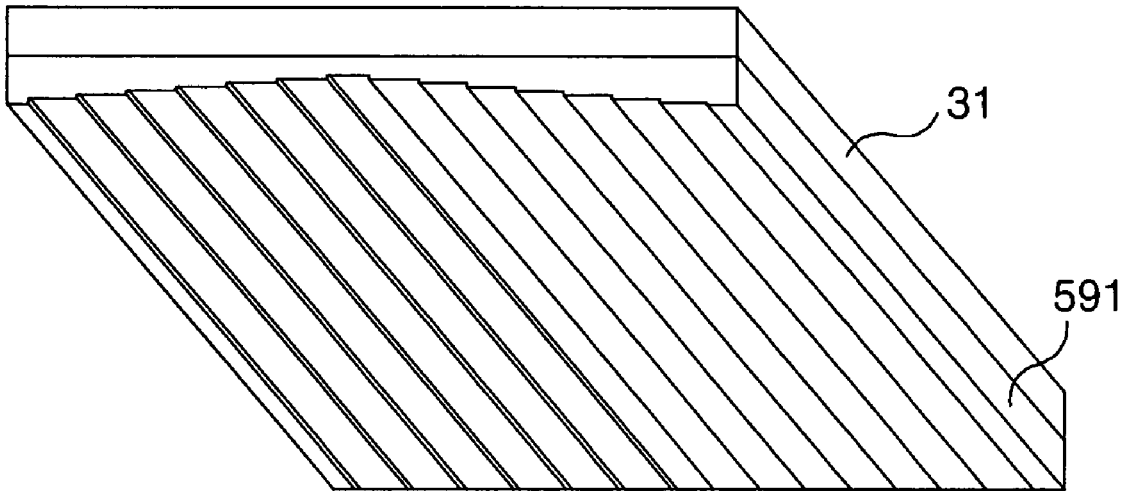
FIG. 59 illustrates a perspective view of a dielectric layer of a PDP according to the forty first embodiment of the present invention.

Referring to FIG. 59, a PDP according to the forty first embodiment of the present invention includes a dielectric layer 591 formed in a step shape section in either a vertical or a horizontal direction of the PDP and having its thickness thinner as, it goes from a peripheral area to a central area. When the dielectric layer 591 is compared with the dielectric layer 571 shown in FIG. 57, the dielectric layer shown in FIG. 57 has its thickness different both in the vertical direction and in horizontal direction of the PDP. On the other hand, the dielectric layer shown in FIG. 59 has its thickness different either in a vertical direction or in a horizontal direction.

The dielectric layer 591 is thinnest in the central area in either a vertical direction or a horizontal direction, and has its thickness thicker step by step as it goes to the peripheral area. The dielectric layer 591 is thinnest in the central area, and has a step shape section with the thickness thicker as it goes to the peripheral area symmetrically. And an area where the thickness of the dielectric layer 591 is the same has a planar structure of a stripe shape. Because the dielectric layer 591 accumulates wall charges and is thinnest in the central area of the PDP, it is possible to compensate the deterioration of the brightness in the central area of the PDP. There is a MgO protective film deposited or printed on the entire surface of the dielectric layer 591. In consideration of a panel size and the brightness of the peripheral area of the PDP, it is desirable to set a thickness difference of the dielectric layer 591 between the central area and the peripheral area of the PDP at about 20% or less.

Figure 60:
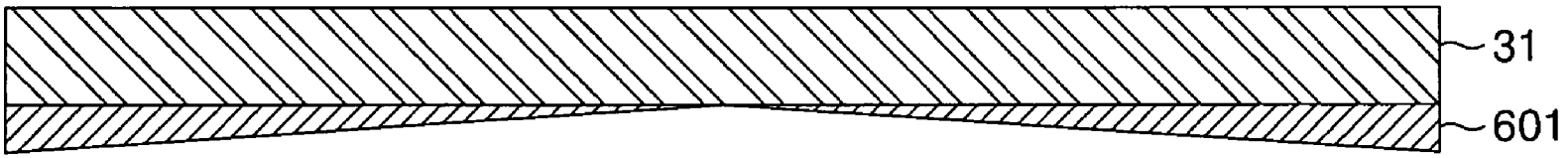
FIG. 60 illustrates a perspective view of a dielectric layer of a PDP according to the forty second embodiment of the present invention.

Referring to FIG. 60, a PDP according to the forty second embodiment of the present invention includes a dielectric layer 601 formed on an upper substrate 31 and having its thickness diminished linearly as it goes from a peripheral area to a central area of the PDP.

The dielectric layer 601 is thinnest in the central area of a vertical direction and/or a horizontal direction of the PDP, and has its thickness thicker linearly as it goes to the peripheral area. Accordingly, the dielectric layer 601 has its surface inclined with a certain gradient in relation to the upper substrate 31. Because the dielectric layer 601 accumulates wall charges and is thinnest in the central area of the PDP, it is possible to compensate the deterioration of the brightness in the central area of the PDP. There is a MgO protective film deposited or printed on the entire surface of the dielectric layer 601. In consideration of a panel size and the brightness of the peripheral area of the PDP, it is desirable to set a thickness difference of the dielectric layer 601 between the central area and the peripheral area of the PDP within about 20% or less.

Figure 61:
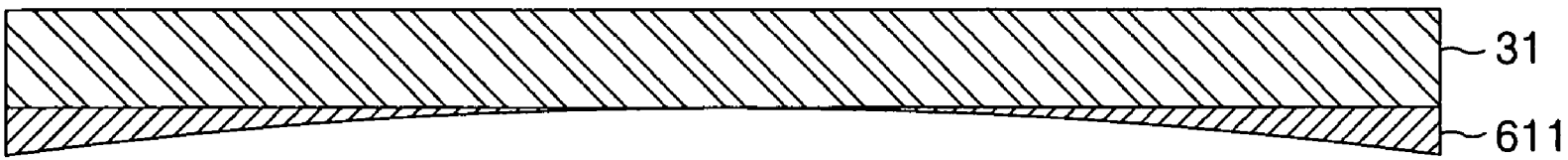
FIG. 61 illustrates a perspective view of a dielectric layer of a PDP according to the forty third embodiment of the present invention.

Referring to FIG. 61, a PDP according to the forty third embodiment of the present invention includes a dielectric layer 611 formed on an upper substrate 31 and having its thickness diminished linearly as it goes from a peripheral area to a central area of the PDP and its surface made in a curve shape.

The dielectric layer 611 is thinnest in the central area in a vertical direction and/or a horizontal direction of the PDP, and has its thickness thicker as it goes to the peripheral of the PDP. The surface of the dielectric layer 611 is inclined in relation to the upper substrate 31 and bent with a certain curvature. Because the dielectric layer 611 accumulates wall charges and is thinnest in the central area of the PDP, it is possible to compensate the deterioration of the brightness in the central area of the PDP. There is a MgO protective film deposited or printed on the entire surface of the dielectric layer 611. In consideration of a panel size and the brightness of the peripheral area of the PDP, it is desirable to set a thickness difference of the dielectric layer 611 between the central area and the peripheral area of the PDP within about 20%.

An upper plate of the PDP that is fabricated for the thickness of the dielectric layers 571, 591, 601 and 611 in the central area to be different from that in the peripheral area, may be joined with a conventional lower plate or a PDP lower plate of this invention described in the foregoing embodiments.

As described above, the PDP according to the present invention makes the width (or thickness) or gap of the barrier ribs and the driving electrodes such as the metal bus electrode, the transparent electrode and the address electrode etc, the thickness of the black matrix and the thickness of the dielectric layer etc different in correspondence to the brightness difference of the peripheral area and the central area of the PDP, as shown in FIG. 62, so as to be able to limit the brightness difference within ±1% or less in the peripheral area and the central area of the PDP, thereby making the brightness of the PDP uniform over the whole screen.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:
- a pair of transparent electrodes configured to generate a sustaining discharge; and
- a plurality of metal bus electrodes formed at each of the pair of the transparent electrodes, wherein at least one of:
  - a width of at least one of the plurality of metal bus electrodes in a central area of the plasma display panel is different than its width in a peripheral area of the plasma display panel; or
  - a width of a gap formed between adjacent metal bus electrodes in a central area of the plasma display panel is different than its width in a peripheral area of the plasma display panel.

2. The plasma display panel according to claim 1, wherein a width of the metal bus electrode is narrower in the central area than in the peripheral area of the plasma display panel.

3. The plasma display panel according to claim 1, wherein the gap between the metal bus electrode is wider in the central area than in the peripheral area of the plasma display panel.

4. A plasma display panel, comprising
- a plurality of pairs of transparent electrodes, wherein
- a width of a gap formed between adjacent transparent electrodes of at least one of the plurality of pairs of transparent electrodes is wider in a central area of the plasma display panel than its width in a peripheral area of the plasma display panel, and wherein a width of each transparent electrode of at least one of the plurality of pairs of transparent electrodes is wider in the central area of the plasma display panel than in the peripheral area of the plasma display panel.

5. A plasma display panel, comprising:
- a plurality of pairs of transparent electrodes, wherein at least one of:
- a width of at least one of the plurality of pairs of transparent electrodes is different in a central area of the plasma display panel than its width in a peripheral area of the plasma display panel;
- a width of a gap formed between adjacent transparent electrodes is different in a central area of the plasma display panel than its width in a peripheral area of the plasma display panel; and
- a plurality of metal bus electrodes formed at each pair of transparent electrodes, wherein at least one of:
  - a width of at least one of the plurality of metal bus electrodes in a central area of the plasma display panel is different than its width in a peripheral area of the plasma display panel;
  - a width of a gap formed between adjacent metal bus electrodes in a central area of the plasma display panel is different than its width in a peripheral area of the plasma display panel.

6. A plasma display panel comprising:
- a plurality of pairs of transparent electrodes, wherein at least one of:
- a width of at least one of the plurality of pairs of transparent electrodes is different in a central area of the plasma display panel than its width in a peripheral area of the plasma display panel;
- a width of a gap formed between adjacent transparent electrodes is different in a central area of the plasma display panel than its width in a peripheral area of the plasma display panel; and
- a plurality of blanks formed in each pair of transparent electrodes.

7. The plasma display panel according to claim 6, wherein at least one of:
- an area of a blank of the plurality of blanks in the central area of the plasma display panel is different from an area of a blank in the peripheral area of the plasma display panel;
- a width of a gap formed between adjacent blanks in the central area of the plasma display panel is different than a width of a gap formed between adjacent blanks in the peripheral area of the plasma display panel.

8. The plasma display panel according to claim 7, wherein a blank located at the peripheral area has a larger are than a blank located at the central area.

9. The plasma display panel according to claim 7, wherein the gap formed between adjacent blanks in the central area is wider than the gap formed between adjacent blanks in the peripheral area.

10. A plasma display panel, comprising:

a plurality of address electrodes configured to receive an address voltage and to select a corresponding cell, wherein a width of at least one of the plurality of address electrodes is wider in a central area of the plasma display panel than its width in a peripheral area of the plasma display panel.

11. A plasma display panel, comprising:

a plurality of address electrodes configured to receive an address voltage and to select a corresponding cell, wherein a width of at least one of the plurality of address electrodes in a central area of the plasma display panel is different from its width in a peripheral area of the plasma display panel; and a plurality of pairs of transparent electrodes configured to receive a sustaining voltage and to generate a sustaining discharge, wherein at least one of:

a width of at least one of the plurality of pairs of transparent electrodes is different in a central area of the plasma display panel than its width in a peripheral area of the plasma display panel;

a width of a gap formed between adjacent transparent electrodes is different in a central area of the plasma display panel than its width in a peripheral area of the plasma display panel.

12. The plasma display panel according to claim 11, further comprising:

a plurality of metal bus electrodes formed at each pair of transparent electrodes, wherein at least one of:

a width of at least one of the plurality of metal bus electrodes in a central area of the plasma display panel is different than its width in a peripheral area of the plasma display panel;

a width of a gap formed between adjacent metal bus electrodes in a central area of the plasma display panel is different than its width in a peripheral area of the plasma display panel.

13. The plasma display panel according to claim 11, further comprising:

a plurality of blanks formed in parallel along a length of each transparent electrode of a pair of transparent electrodes, wherein said plurality of blanks are formed in a hole shape.

14. The plasma display panel according to claim 13, wherein at least one of:

an area of a blank of the plurality of blanks in the central area of the plasma display panel is different from an area of a blank in the peripheral area of the plasma display panel;

a width of a gap formed between adjacent blanks in the central area of the plasma display panel is different than a width of a gap formed between adjacent blanks in the peripheral area of the plasma display panel.

15. The plasma display panel according to claim 14, wherein a blank located at the peripheral area has larger area than a blank located at the central area.

16. The plasma display panel according to claim 14, wherein a gap formed between adjacent blanks located at the central area is wider than a gap formed between adjacent blanks located at the peripheral area.

17. A plasma display panel, comprising:

a plurality of barrier ribs, wherein at least one of a gap formed between adjacent barrier ribs, a thickness of a barrier rib, and a height of a barrier rib in a central area of the plasma display panel is different from that in a peripheral area of the plasma display panel.

18. The plasma display panel according to claim 17, wherein a gap formed between adjacent barrier ribs is wider in the central area than in the peripheral area.

19. The plasma display panel according to claim 17, wherein a thickness of a barrier rib in the central area is thinner than a thickness of a barrier rib in the peripheral area.

20. The plasma display panel according to claim 17, wherein a height of a barrier rib in the central area is higher than a height of a barrier rib in the peripheral area.

21. A plasma display panel including a plurality of discharge cells, comprising a plurality of black matrixes disposed between the plurality of discharge cells, wherein a width of each of the plurality of black matrixes gets wider as it goes from a central area of the plasma display panel to a peripheral area of the plasma display panel.

22. A plasma display panel including a plurality of discharge cells, comprising a plurality of black matrixes disposed between the plurality of discharge cells, wherein a width of each of the plurality of black matrixes is uniform, and each individual black matrix of the plurality of black matrixes has a different width based on its position in the plasma display panel.

23. A plasma display panel including a plurality of discharge cells, comprising a plurality of black matrixes disposed between the plurality of discharge cells, wherein a width of the plurality of black matrixes in a central area of the plasma display panel is different from that in a peripheral area of the plasma display panel, wherein the black matrix comprises:

a horizontal black matrix positioned parallel to a horizontal direction of the display panel; and a vertical black matrix positioned parallel to a vertical direction of the display panel.

24. The plasma display panel according to claim 23, further comprising:

a dielectric layer disposed between the horizontal black matrix and the vertical black matrix.

25. A plasma display panel, comprising:

a substrate; and a dielectric layer formed on the substrate, wherein a thickness of the dielectric layer in a central area of the plasma display panel is different from a thickness of the dielectric layer in a peripheral area of the plasma display panel.

26. The plasma display panel according to claim 25, wherein a thickness of the dielectric layer decreases as it goes from the peripheral area to the central area.

27. The plasma display panel according to claim 25, wherein a thickness of the dielectric layer decreases step by step as it goes from the peripheral area to the central area.

28. The plasma display panel according to claim 25, wherein a thickness of the dielectric layer decreases linearly as it goes from the peripheral area to the central area.

29. The plasma display panel according to claim 5, further comprising a plurality of address electrodes, wherein a width of at least one of the plurality of address electrodes in a central area of the plasma display panel is different from its width in a peripheral area of the plasma display panel.

30. The plasma display panel according to claim 29, further comprising a plurality of barrier ribs, wherein a gap formed between adjacent barrier ribs is wider in the central area than in the peripheral area of the plasma display panel.

31. The plasma display panel according to claim 30, further comprising a plurality of black matrixes, wherein a width of each of the plurality of black matrixes in a central area is different from that in a peripheral area of the plasma display panel.

32. The plasma display panel according to claim 31 further comprising at least one dielectric layer, wherein a thickness of the at least one dielectric layer in a central area is different from a thickness of the at least one dielectric layer in a peripheral area of the plasma display panel.

33. The plasma display panel according to claim 6 wherein the plurality of blanks are formed in parallel to one another along a length of a transparent electrode.

34. The plasma display panel according to claim 33, wherein the plurality of blanks are formed in a hole shape.

* * * * *